US007118843B2

(12) United States Patent
Teshima

(10) Patent No.: US 7,118,843 B2
(45) Date of Patent: Oct. 10, 2006

(54) METHOD FOR MANUFACTURING TONER, TONER, FIXING DEVICE, AND IMAGE FORMING APPARATUS

(75) Inventor: Takashi Teshima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 10/701,372

(22) Filed: Nov. 5, 2003

(65) Prior Publication Data

US 2004/0152006 A1 Aug. 5, 2004

(30) Foreign Application Priority Data

Nov. 5, 2002 (JP) ..... 2002-321889

(51) Int. Cl.
*G03G 9/08* (2006.01)

(52) U.S. Cl. ..... 430/137.14; 430/137.19; 430/109.4; 399/331; 399/328

(58) Field of Classification Search ..... 430/137.14, 430/137.19, 109.4; 399/331, 328
See application file for complete search history.

(56) References Cited

U.S. PATENT DOCUMENTS 3,965,021 A * 6/1976 Clemens et al. ..... 430/109.31
3,967,962 A * 7/1976 O'Malley ..... 430/120
4,671,906 A 6/1987 Yasue et al.
4,940,644 A * 7/1990 Matsubara et al. ..... 430/109.4
5,147,747 A * 9/1992 Wilson et al. ..... 430/108.2
5,240,803 A 8/1993 Ota
5,707,772 A 1/1998 Akimoto et al.
5,738,964 A 4/1998 Uchida et al.
5,858,596 A 1/1999 Tajima et al.
6,022,661 A 2/2000 Kurose et al.
6,063,537 A 5/2000 Nakamura et al.
6,083,454 A 7/2000 Tang et al.
6,117,607 A 9/2000 Shimizu et al.

(Continued)

FOREIGN PATENT DOCUMENTS

DE 40 20 303 A1 1/1992

(Continued)

OTHER PUBLICATIONS

Patent Abstracts of Japan (1981), vol. 0050, No. 52.

(Continued)

*Primary Examiner*—Mark A. Chapman
(74) *Attorney, Agent, or Firm*—Sughrue Mion, PLLC

(57) ABSTRACT

A toner having high mechanical strength and being capable of exhibiting a sufficient fixing property in a wide temperature range, and a method for manufacturing such a toner are provided. Further, a fixing device and an image forming apparatus in which such a toner can be suitably used are also provided. The method for manufacturing a toner comprises a step of spreading a dispersion liquid, in which a dispersoid containing polyester-based resin is dispersed in a dispersion medium, into a laminar flow by pressing it against a smooth surface using a gas flow and then jetting the dispersion liquid in the form of fine particles and a step of solidifying the fine particles of the dispersion liquid while they are being conveyed in a solidifying section. The polyester-based resin includes block polyester mainly composed of a block copolymer, and amorphous polyester having crystallinity lower than that of the block polyester. The block polyester has a crystalline block obtained by condensation of a diol component with a dicarboxylic acid component, and an amorphous block having crystallinity lower than that of the crystalline block.

79 Claims, 24 Drawing Sheets

U.S. PATENT DOCUMENTS

| | | | |
|---|---|---|---|
| 6,146,802 | A | 11/2000 | Okada et al. |
| 6,235,444 | B1 | 5/2001 | Nagai et al. |
| 6,344,302 | B1 | 2/2002 | Kurose et al. |
| 6,653,040 | B1 | 11/2003 | Ohba et al. |
| 6,839,537 | B1 | 1/2005 | Mouri et al. |
| 6,852,463 | B1 | 2/2005 | Teshima |
| 6,864,030 | B1 | 3/2005 | Shirai et al. |
| 2004/0132920 | A1 | 7/2004 | Matsumura et al. |
| 2004/0137354 | A1 | 7/2004 | Yamazaki et al. |
| 2004/0152006 | A1 | 8/2004 | Teshima |
| 2005/0100807 | A1 | 5/2005 | Yamazaki et al. |

FOREIGN PATENT DOCUMENTS

| | | | |
|---|---|---|---|
| JP | 57-109825 | A | 7/1982 |
| JP | 2001-324832 | A | 11/2001 |
| WO | WO 02/084408 | A1 | 10/2002 |

OTHER PUBLICATIONS

European Search Report dated Jul. 12, 2004.

* cited by examiner

METHOD FOR MANUFACTURING TONER, TONER, FIXING DEVICE, AND IMAGE FORMING APPARATUS

BACKGROUND OF THE INVENTION

1. Field of the Invention

This invention relates to a method for manufacturing a toner, a toner, a fixing device, and an image forming apparatus.

2. Description of the Prior Art

There are known various electrophotographic methods. In general, such electrophotographic methods include a step for forming an electrostatic latent image on a photoreceptor by any means utilizing a photoconductive material (that is, an exposure step), a step for developing the latent image by the use of a toner to form a toner image, a step for transferring the toner image onto a transfer material (recording medium) such as paper, and a step for fixing the toner image by, for example, heating using a fixing roller.

The toner for use in such electrophotographic methods is generally composed of a material containing a resin as a main component (hereinafter, also simply referred to as a "resin") and a coloring agent.

As for the resin constituting the toner, polyester resin is widely used, because polyester resin has a feature in that it facilitates the control of various properties of a resultant toner (that is, a toner finally obtained), such as elastic modulus, chargeability, and the like.

Further, such polyester resin is composed of a diol component. As for the diol component, aromatic diol such as bisphenol A has been commonly used (see Japanese Patent Laid-open No. Sho 57-109825 (page 1, lines 1 to 27), for example).

However, since polyester composed of such a diol component has a relatively large coefficient of friction and poor mechanical strength (that is, poor resistance to mechanical stress), obtained toner particles are liable to be fractured in a developing device, thus resulting in a case that problems such as poor electrification, contamination of the device, lowering in a fixing property, and the like occur.

Also, there is known a toner which is manufactured using polyester composed of aliphatic diol instead of aromatic diol such as bisphenol A (see Japanese Patent Laid-open No. 2001-324832 (page 2, lines 1 to 13), for example). In such a toner, a polyester block copolymer, which contains in its molecule a block obtained by condensation of aliphatic diol with carboxylic acids and a polyester block obtained by condensation of alicyclic diol with carboxylic acids, is used as polyester resin. However, a problem exists with such a toner in that a temperature range in which a sufficient fixing property (fixing strength) is ensured is narrow.

Further, as for a method for manufacturing a toner, a grinding method, a polymerization method, or the like is commonly employed.

In a grinding method, a material containing a resin as a main component (hereinafter, also simply referred to as a "resin") and a coloring agent is kneaded at a temperature higher than the softening point of the resin to obtain a kneaded material, and the kneaded material is then cooled and ground. Such a grinding method has an advantage in that various materials can be selectively used and a toner can be manufactured with relative ease. However, a toner obtained by the grinding method has a disadvantage in that there are large variations in shapes of individual particles of the toner and the particle size distribution of the toner also tends to be wide. As a result, variations in charging properties, fixing property and the like among the toner particles also become large, thus resulting in reduced reliability of the toner as a whole.

In a polymerization method, a polymerization reaction is carried out in a liquid phase using a monomer which is a constituent component of a target resin to obtain a raw resin, by which toner particles are manufactured. Such a polymerization method has an advantage in that toner particles having a shape with relatively high sphericity (that is a shape close to a perfect geometrical sphere) can be obtained. However, in a case where the polymerization method is employed, there is a case where a variation in particle size among individual toner particles can not be made sufficiently small. Further, in the polymerization method, the range of choices of resin materials is narrow so that there is a case where it is difficult to obtain a toner having target properties.

SUMMARY OF THE INVENTION

It is therefore an object of the present invention to provide a toner having high mechanical strength (that is, high resistance to mechanical stress) and being capable of exhibiting a sufficient fixing property in a wide temperature range, and a method for manufacturing such a toner. Further, it is another object of the present invention to provide a fixing device and an image forming apparatus in which the toner can be suitably used.

In order to achieve the object mentioned above, the present invention is directed to a method for manufacturing a toner, which comprises the steps of:

preparing a dispersion liquid which comprises a dispersoid containing polyester-based resin and a dispersion medium in which the dispersoid is dispersed;

jetting the dispersion liquid so as to be in the form of fine particles; and solidifying the fine particles of the dispersion liquid while they are being conveyed in a solidifying section, wherein the polyester-based resin contains two or more kinds of different polyesters.

In the present invention, it is preferred that the polyester-based resin contains two kinds of polyesters which have different degrees of crystallinity.

In the present invention, it is also preferred that the polyester-based resin contains two kinds of polyesters which have different softening points $T_{1/2}$, wherein a difference between them is 5° C. or more in absolute value.

In the present invention, it is also preferred that the fine particles of the dispersion liquid are formed by spreading the dispersion liquid into a laminar flow by pressing it against a smooth surface using a gas flow, and then jetting the laminar flow released from the smooth surface to form the fine particles.

In this case, it is preferred that the gas flow is formed by jetting a pressurized gas from a gas outlet into an open space, and the gas flow is jetted toward the smooth surface in a direction that the dispersion liquid flows so that the gas flow can be made to come into contact with the smooth surface and to flow in parallel with the smooth surface in a predetermined direction, wherein the dispersion liquid is supplied on the smooth surface and below the gas flow flowing on the smooth surface such that the direction of the dispersion liquid to be supplied crosses the direction of the gas flow, wherein the dispersion liquid is pressed against the smooth surface by the gas flow and is spread into the laminar flow. Further, it is preferred that the smooth surface is provided as an inclined surface. In this case, it is preferred that there are provided the two inclined surfaces which provide a sharp edge as a boundary of them, wherein the gas flow is made to flow along each of the inclined surfaces to make them come into collision with each other to generate air vibration at the edge, wherein the dispersion liquid is supplied on the inclined surface to make it flow along the inclined surface so that the dispersion liquid is spread into the laminar flow by the gas flow and conveyed to the edge, wherein the laminar flow is divided into fine particles by the air vibration at the tip end of the edge and then the fine particles are jetted into the air.

In the present invention, it is also preferred that the dispersoid contained in the fine particles released from the smooth surface is agglomerated while being conveyed in the solidifying section.

In the present invention, it is also preferred that the dispersion medium is mainly comprised of water and/or a liquid having excellent compatibility with water.

In the present invention, it is also preferred that the dispersion liquid contains an emulsifying and dispersing agent.

In the present invention, it is also preferred that the dispersion liquid is a suspension.

In the present invention, it is also preferred that the dispersion liquid is obtained by dispersing a kneaded material in the dispersion medium, wherein the kneaded material contains at least the polyester-based resin. In this case, it is preferred that various components constituting the polyester-based resin are soluble with each other in the kneaded material.

In the present invention, it is also preferred that the dispersion liquid is prepared by adding a material containing the polyester-based resin or a precursor thereof to a liquid containing at least water.

In the present invention, it is also preferred that the dispersion liquid is prepared through a process of mixing a resin solution which contains at least a resin or a precursor of the resin and a solvent capable of dissolving at least a part the resin or the precursor of the resin, and an aqueous solution containing at least water. In this case, it is preferred that the resin solution and the aqueous solution are mixed by dropping the resin solution into the aqueous solution. Also, it is preferred that the dispersion liquid is prepared by eliminating at least a part of the solvent after the mixing process. In this case, it is preferred that the solvent is eliminated by heating.

In the present invention, it is also preferred that the average particle size of the particle of the dispersoid in the dispersion liquid is in the range of 0.05 to 10 μm.

In the present invention, it is also preferred that when the average particle size of the particle of the dispersoid in the dispersion liquid is defined as Dm (μm), and the average particle size of a manufactured toner particle is defined as Dt (μm), Dm and Dt satisfy the relation $0.005 \leqq Dm/Dt \leqq 0.5$.

In the present invention, it is also preferred that the content of the dispersoid in the dispersion liquid is in the range of 1 to 99 wt %.

In the present invention, it is also preferred that the volume of one drop of the dispersion liquid in the form of a fine particle is in the range of 0.05 to 500 pl.

In the present invention, it is also preferred that when the average particle size of the dispersion liquid in the form of a fine particle is defined as Dd (μm) and the average particle size of the particle of the dispersoid in the dispersion liquid is defined as Dm (μm), Dm and Dd satisfy the relation $Dm/Dd<0.5$.

In the present invention, it is also preferred that the average particle size of the dispersion liquid in the form of a fine particle is defined as Dd (μm) and the average particle size of a manufactured toner particle is defined as Dt (μm), Dd and Dt satisfy the relation $0.05 \leqq Dt/Dd \leqq 1.0$.

In the present invention, it is also preferred that the dispersion liquid is jetted in the form of fine particles from a plurality of jetting ports. In this case, it is preferred that the dispersion liquid is jetted at different times from at least adjacent two jetting ports among the plurality of jetting ports.

In the present invention, it id also preferred that the dispersion liquid is jetted in a state where it is heated. Alternatively, the dispersion liquid may be heated in the solidifying section after it is jetted.

In the present invention, it is also preferred that the dispersion liquid is jetted in a state where a voltage with polarity that is the same as that of the dispersion liquid is applied to the solidifying section.

In the present invention, it is also preferred that the initial velocity of the dispersion liquid when jetted in the form of fine particles is in the range of 0.1 to 10 m/s.

In the present invention, it is also preferred that the viscosity of the dispersion liquid is in the range of 5 to 3,000 cps.

In the present invention, it is also preferred that the dispersion medium is eliminated in the solidifying section.

In the present invention, it is also preferred that a pressure in the solidifying section is 0.15 MPa or less.

In the present invention, it is also preferred that the content of the polyester-based resin in the dispersoid is in the range of 2 to 98 wt %.

In the present invention, it is also preferred that the dispersion liquid contains a wax. In this case, the content of the wax in the dispersion liquid is preferably 1.0 wt % or less.

In the present invention, it is also preferred that the polyester-based resin contains block polyester mainly composed of a block copolymer, and amorphous polyester having crystallinity lower than that of the block polyester, wherein the block polyester has a crystalline block obtained by condensation of a diol component with a dicarboxylic acid component, and an amorphous block having crystallinity lower than that of the crystalline block.

In this case, it is preferred that the melting point of the block polyester is higher than the softening point of the amorphous polyester.

Further, it is also preferred that the amorphous polyester contains a monomer component and the block polyester contains a monomer component, in which 50 molt or more of the monomer component of the amorphous polyester is the same as the monomer component of the amorphous block of the block polyester.

Furthermore, it is also preferred that the compounding ratio between the block polyester and the amorphous polyester is in the range of 5:95 to 45:55 in weight ratio.

Moreover, it is also preferred that the content of the crystalline block in the block polyester is in the range of 5 to 60 mol %.

Moreover, it is also preferred that 80 mol% or more of the diol component constituting the crystalline block of the block polyester is aliphatic diol.

Moreover, it is also preferred that the diol component of the crystalline block of the block polyester has a straight-chain molecular structure containing 3 to 7 carbon atoms and hydroxyl groups at both ends of the chain.

Moreover, it is also preferred that 50 mol% or more of the dicarboxylic acid component constituting the crystalline block of the block polyester has a terephthalic acid structure.

Moreover, it is also preferred that the amorphous block of the block polyester contains a diol component, and at least a part of the diol component is aliphatic diol.

Moreover, it is also preferred that the amorphous block of the block polyester contains a diol component, and at least a part of the diol component has a branched chain.

Moreover, it is also preferred that the melting point of the block polyester is 190° C. or higher.

Moreover, it is also preferred that the heat of fusion of the block polyester determined by measuring the endothermic peak of the block polyester at its melting point according to differential scanning calorimetry is 5 mJ/mg or greater.

Moreover, it is also preferred that the weight average molecular weight Mw of the block polyester is in the range of $1\times10^4$ to $3\times10^5$.

Moreover, it is also preferred that the block polyester is a liner polymer.

Moreover, it is also preferred that the amorphous polyester contains a dicarboxylic acid component, and 80 mol % or more of the dicarboxylic acid component has a terephthalic acid structure.

Moreover, it is also preferred that the weight average molecular weight Mw of the amorphous polyester is in the range of $5\times10^3$ to $4\times10^4$.

Moreover, it is also preferred that the amorphous polyester is a linear polymer.

Moreover, it is also preferred that the block polyester and the amorphous polyester are soluble with each other.

Another aspect of the present invention is directed to a toner manufactured by the method as described above.

In the present invention, it is preferred that the average particle size of the toner is in the range of 1 to 20 μm.

In the present invention, it is also preferred that the standard deviation of the particle size among individual particles of the toner is 1.5 μm or less.

In the present invention, it is also preferred that the average roundness R determined by the following formula (I) is in the range of 0.91 to 0.98.

$$R=L_0/L_1 \quad \text{(I)}$$

(where, $L_0$ is a circumferential length of a projected image of a toner particle of the toner which is an object to be measured, and $L_1$ is a circumferential length of a true circle having an area equal to the area of the projected image of the toner particle of the toner which is an object to be measured.)

In the present invention, it is also preferred that the standard deviation of the average roundness among individual particles of the toner is 0.02 or less.

In the present invention, it is also preferred that the toner is comprised of agglomerations of the dispersoid.

In the present invention, it is also preferred that the content of the polyester-based resin in the toner is in the range of 50 to 98 wt %.

In the present invention, it is also preferred that the toner contains crystals mainly formed of the crystalline blocks. In this case, the average length of the crystals is preferably in the range of 10 to 1,000 nm.

In the present invention, it is also preferred that the toner further comprises a wax. In this case, the content of the wax is preferably in the range of 5 wt % or less.

In the present invention, it is also preferred that the polyester-based resin contains block polyester mainly composed of a block copolymer, wherein the weight average molecular weight Mw of the block polyester is in the range of $1\times10^4$ to $3\times10^5$.

In the present invention, it is also preferred that the polyester-based resin contains block polyester mainly composed of a block copolymer, and an amorphous polyester having crystallinity lower than that of the block polyester, wherein the weight average molecular weight Mw of the amorphous polyester is in the range of $5\times10^3$ to $4\times10^4$.

In the present invention, it is also preferred that he toner further comprises an external additive.

In the present invention, it is also preferred that the toner is to be used with a fixing device which comprises a fixing roller, a pressure roller which is in contact with the fixing roller under pressure through a fixing nip part, and a release member for use in releasing a recording medium, which has been passed through the fixing nip part, from the fixing roller.

In this case, it is preferred that the fixing device has a recording medium feed speed of 0.05 to 1.0 m/s.

Further, it is also preferred that the release member is a plate-shaped member having a predetermined length in the axial direction of the fixing roller and/or the pressure roller.

Furthermore, it is also preferred that the release member is disposed on the further downstream side than the fixing nip part in the direction of conveying the recording medium.

Moreover, it is also preferred that the release member is disposed in the vicinity of the fixing roller and/or the pressure roller.

Moreover, it is also preferred that the fixing roller and the pressure roller are arranged almost in the horizontal state.

Moreover, it is also preferred that the release member is disposed such that a gap between the fixing roller and the release member is kept substantially constant when the fixing device is operated.

Moreover, it is also preferred that the release member is disposed along the axial direction of the fixing roller, and has a shape that is suited for the shape of the exit of the fixing nip part.

Moreover, it is also preferred that when an angle on the side of the fixing roller with respect to a tangent at the exit of the fixing nip part is defined as a positive angle and an angle on the side of the pressure roller with respect to the tangent at the exit of the fixing nip part is defined as a negative angle, the arrangement angle $\theta_A$ of the release member with respect to the tangent at the exit of the fixing nip part is in the range of −5 to +25°.

Moreover, it is also preferred that the release member extends along the axial direction of the fixing roller and the pressure roller, and is disposed in the vicinity of the fixing roller and the pressure roller on the further downstream side than the fixing nip part in the direction of conveying the recording medium, and the fixing device further comprises a release member for the pressure roller, wherein the positioning of the release member for the fixing roller is performed by the surface of the fixing roller and the positioning of the release member for the pressure roller is performed by the surfaces of both bearings of the pressure roller. In this case, it is preferred that the length in the axial direction of the pressure roller is shorter than that of the fixing roller so that spaces are created at each end of the pressure roller, wherein the bearings are provided in the spaces, respectively.

Moreover, it is also preferred that a gap G2 (μm) between the fixing roller and the release member in the vicinity of each end in the axial direction of the fixing roller is larger than a gap G1 (μm) between the fixing roller and the release member in the vicinity of the central part in the axial direction of the fixing roller.

Still another aspect of the present invention is directed to a fixing device for fixing the toner as described above onto a recording medium, the fixing device comprising:

a fixing roller;

a pressure roller which is in contact with the fixing roller under pressure through a fixing nip part; and a release member for use in releasing a recording medium, which has been passed through the fixing nip part, from the fixing roller.

In the present invention, it is also preferred that the fixing device has a recording medium feed speed of 0.05 to 1.0 m/s.

In the present invention, it is also preferred that the release member is a plate-shaped member having a predetermined length in the axial direction of the fixing roller and/or the pressure roller.

In the present invention, it is also preferred that the release member is disposed on the further downstream side than the fixing nip part in the direction of conveying the recording medium.

In the present invention, it is also preferred that the release member is disposed in the vicinity of the fixing roller and/or the pressure roller.

In the present invention, it is also preferred that the fixing roller and the pressure roller are arranged almost in the horizontal state.

In the present invention, it is also preferred that the release member is disposed such that a gap between the fixing roller and the release member is kept substantially constant when the fixing device is operated.

In the present invention, it is also preferred that the release member is disposed along the axial direction of the fixing roller, and has a shape that is suited for the shape of the exit of the fixing nip part.

In the present invention, it is also preferred that when an angle on the side of the fixing roller with respect to a tangent at the exit of the fixing nip part is defined as a positive angle and an angle on the side of the pressure roller with respect to the tangent at the exit of the fixing nip part is defined as a negative angle, the arrangement angle $\theta_A$ of the release member with respect to the tangent at the exit of the fixing nip part is in the range of −5 to +25°.

In the present invention, it is also preferred that the release member extends along the axial direction of the fixing roller and the pressure roller, and is disposed in the vicinity of the fixing roller and the pressure roller on the further downstream side than the fixing nip part in the direction of conveying the recording medium, and the fixing device further comprises a release member for the pressure roller, wherein the positioning of the release member for the fixing roller is performed by the surface of the fixing roller and the positioning of the release member for the pressure roller is performed by the surfaces of both bearings of the pressure roller. In this case, it is preferred that the length in the axial direction of the pressure roller is shorter than that of the fixing roller so that spaces are created at each end of the pressure roller, wherein the bearings are provided in the spaces, respectively.

In the present invention, it is also preferred that a gap G2 (μm) between the fixing roller and the release member in the vicinity of each end in the axial direction of the fixing roller is larger than a gap G1 (μm) between the fixing roller and the release member in the vicinity of the central part in the axial direction of the fixing roller.

Yet another aspect of the present invention is directed to an image forming apparatus comprising the fixing device as described above

BRIEF DESCRIPTION OF THE DRAWINS

DETAILED DESCRIPTION OF THE INVENTION

Hereinbelow, a detailed description will be made with regard to a method for manufacturing a toner, a toner, a fixing device, and an image forming apparatus according to the present invention based on preferred embodiments with reference to the accompanying drawings.

First, the method for manufacturing a toner according to the present invention will be described.

Figure 1:
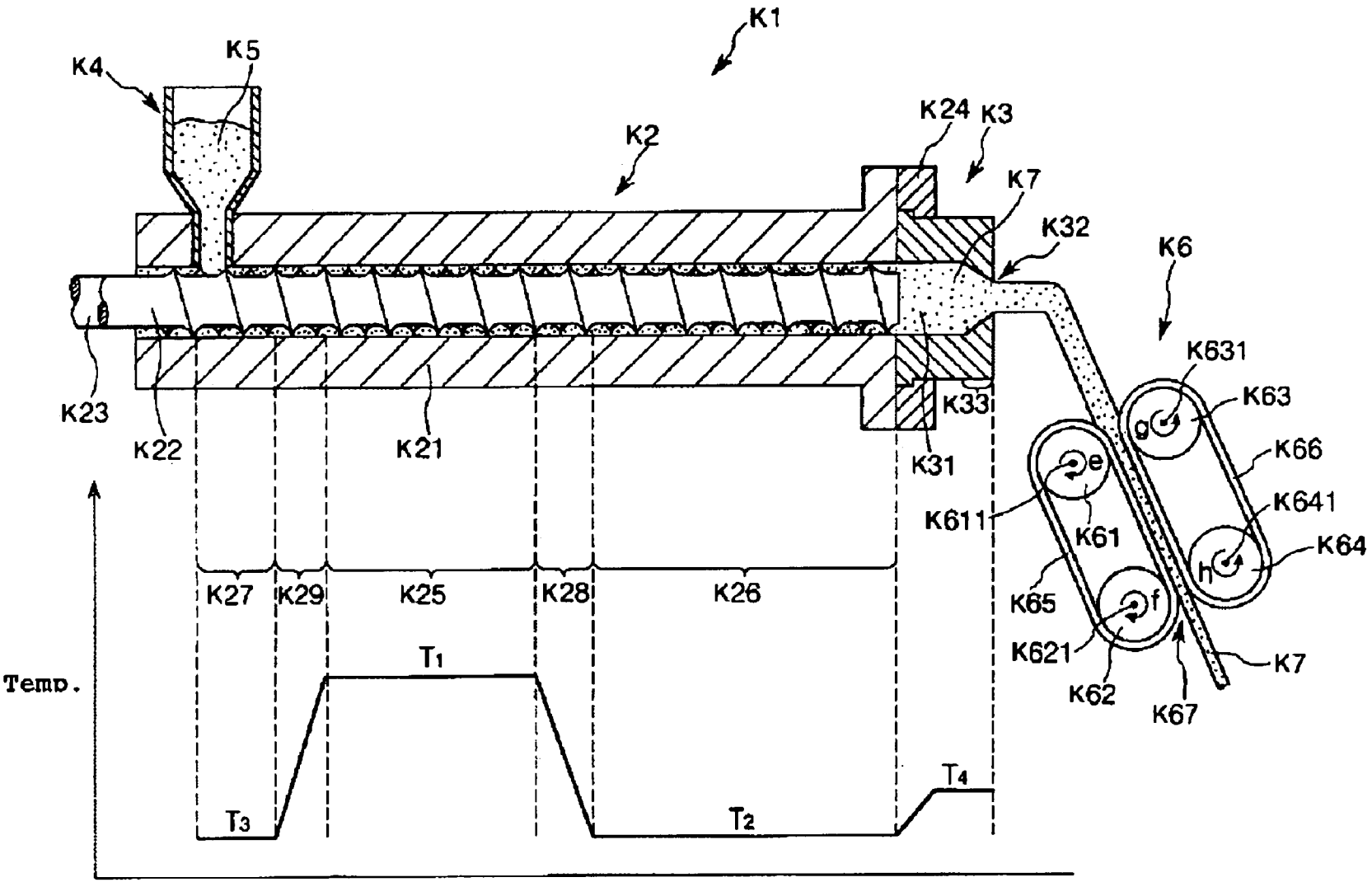
FIG. 1 is a longitudinal sectional view which schematically shows one example of the structure of a kneading machine for manufacturing a kneaded material for use in preparing a dispersion liquid, and one example of the structure of a cooling machine.
Figure 2:
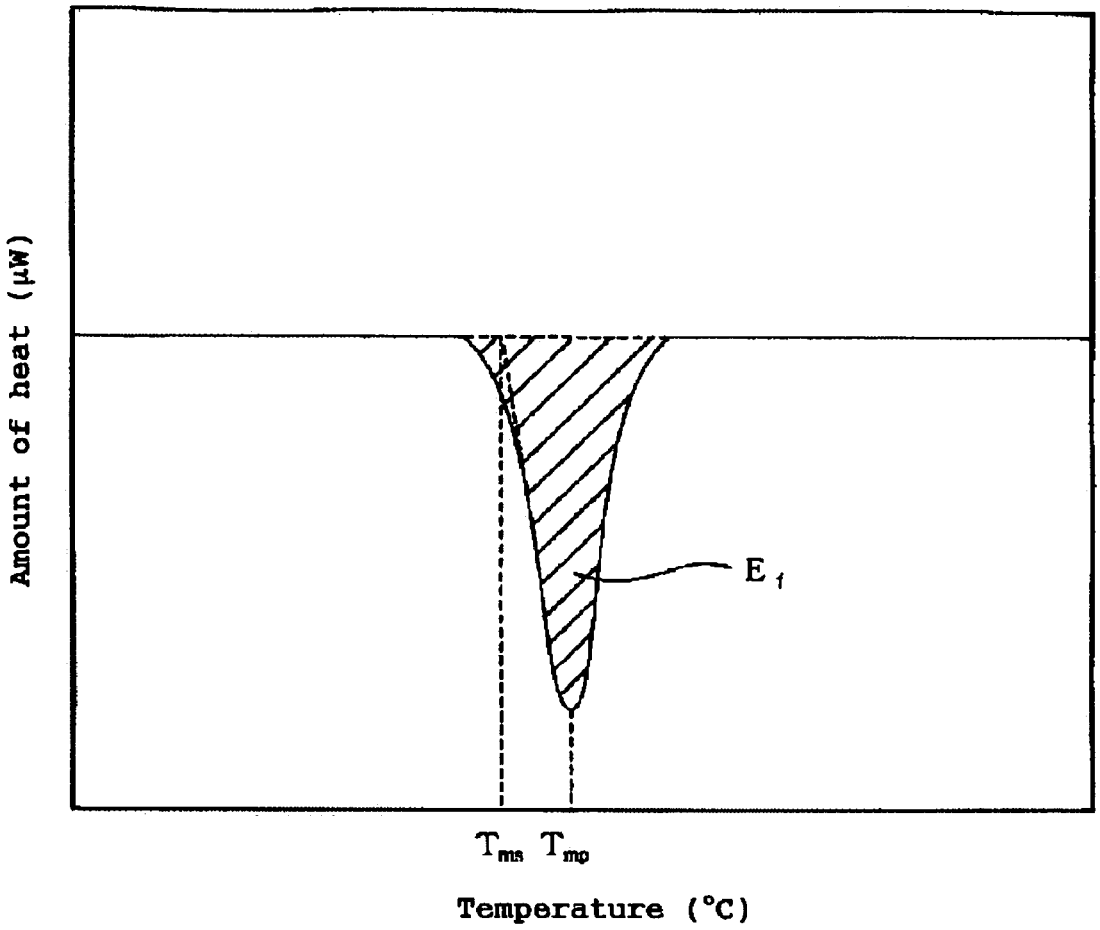
FIG. 2 is a model diagram of a differential scanning calorimetry curve of block polyester in the vicinity of its melting point.
Figure 3:
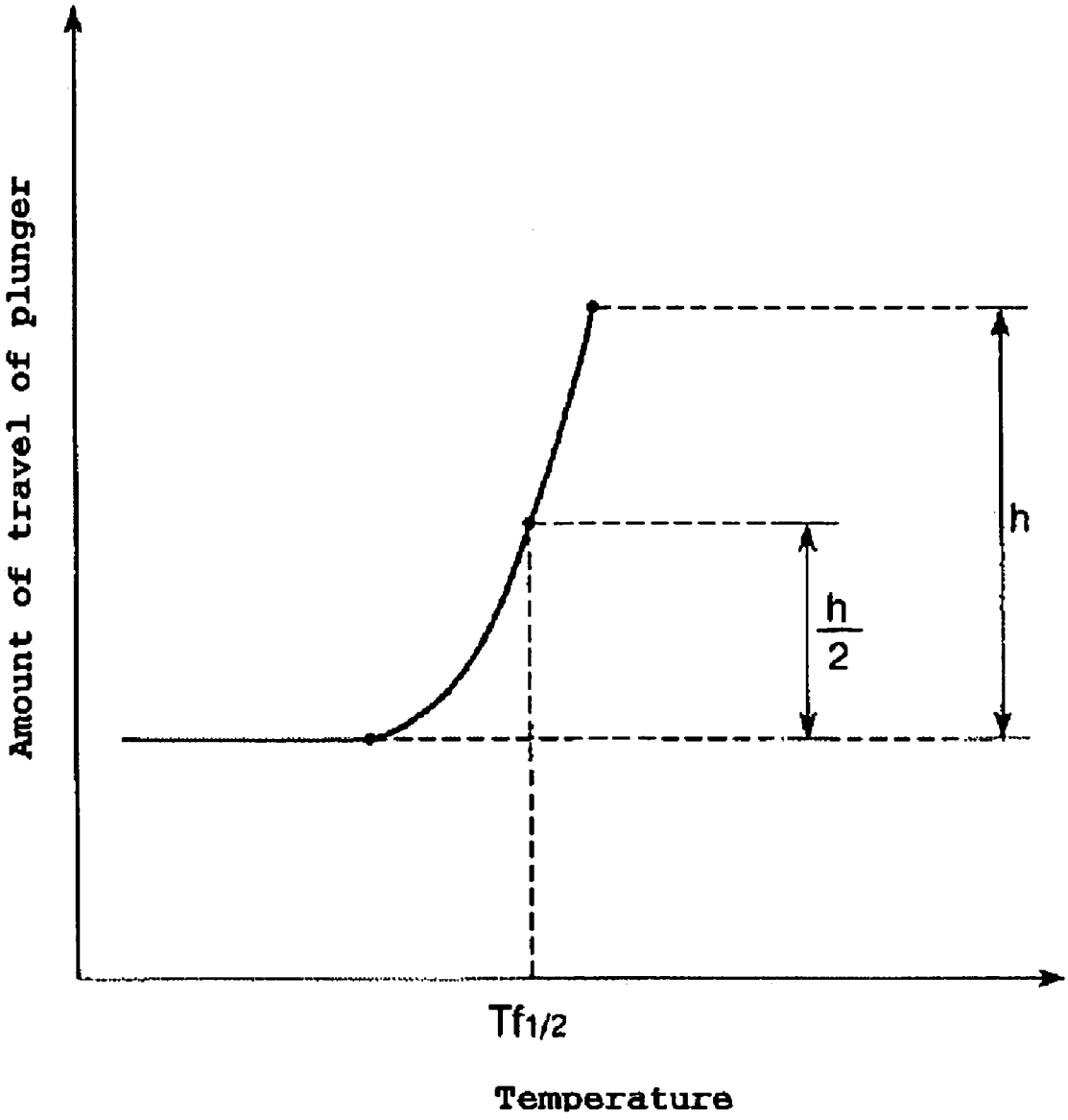
FIG. 3 is a flow chart for analyzing a melting point.
Figure 4:
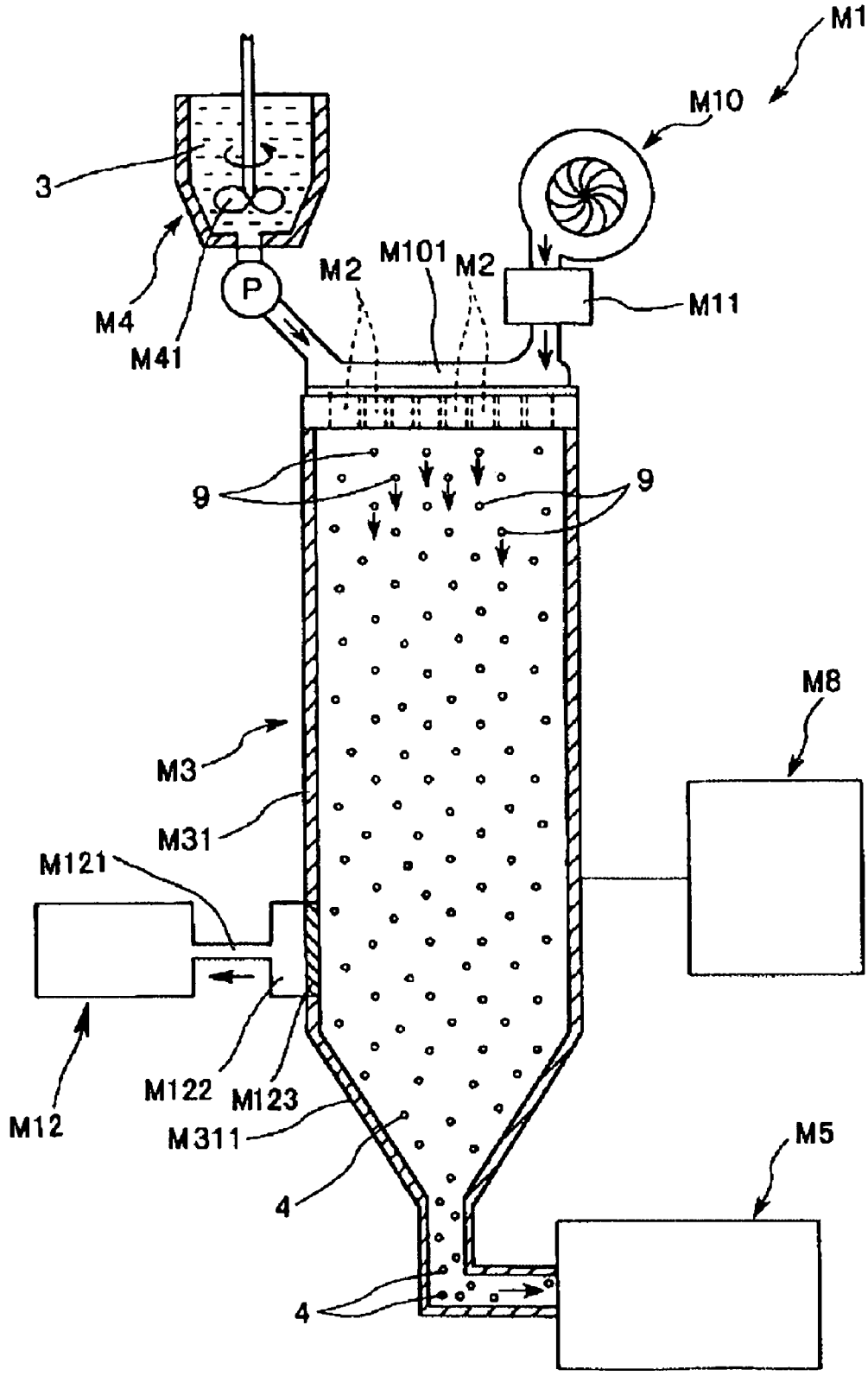
FIG. 4 is a vertical sectional view which schematically shows a preferred embodiment of a toner manufacturing device for use in manufacture of a toner of the present invention.
Figure 5:
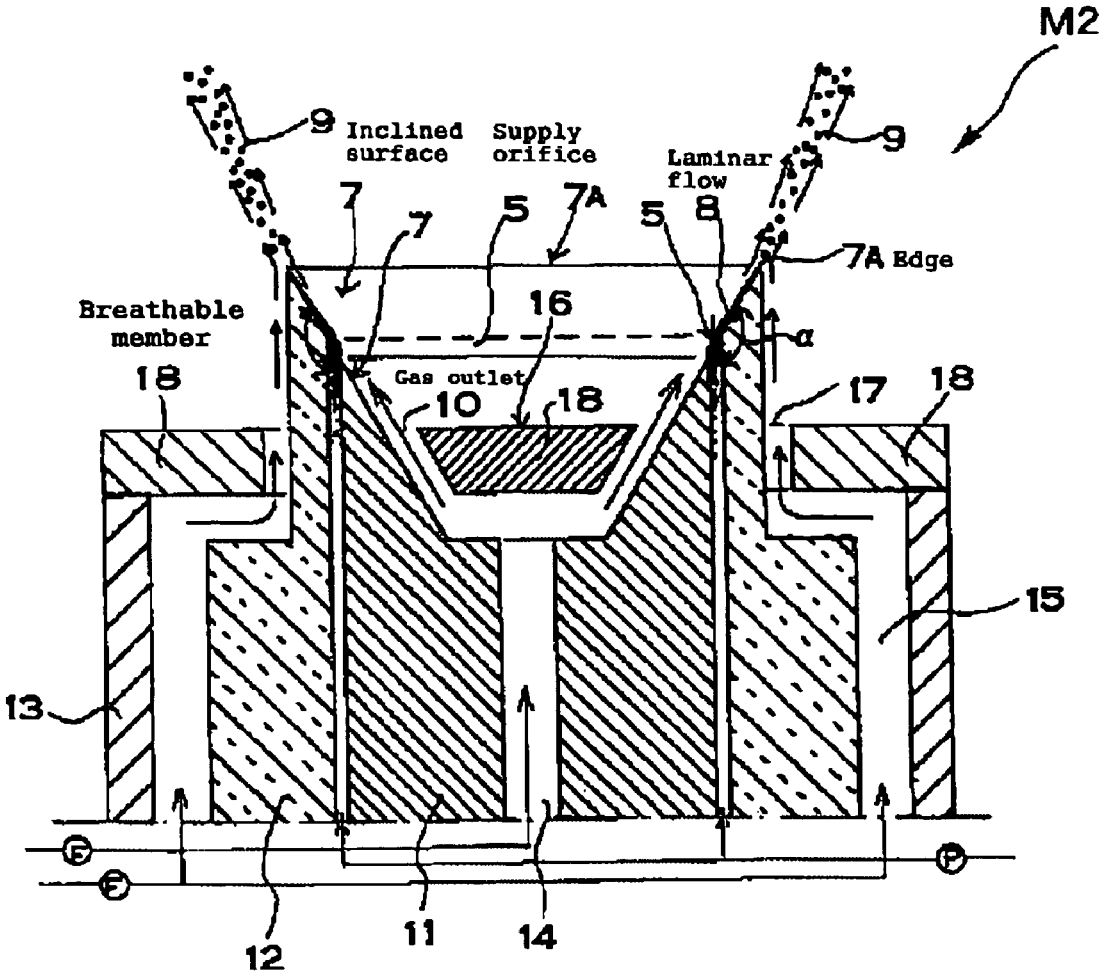
FIG. 5 is a cross sectional view which shows a preferred embodiment of a nozzle for jetting a dispersion liquid in the form of fine particles.
Figure 6:
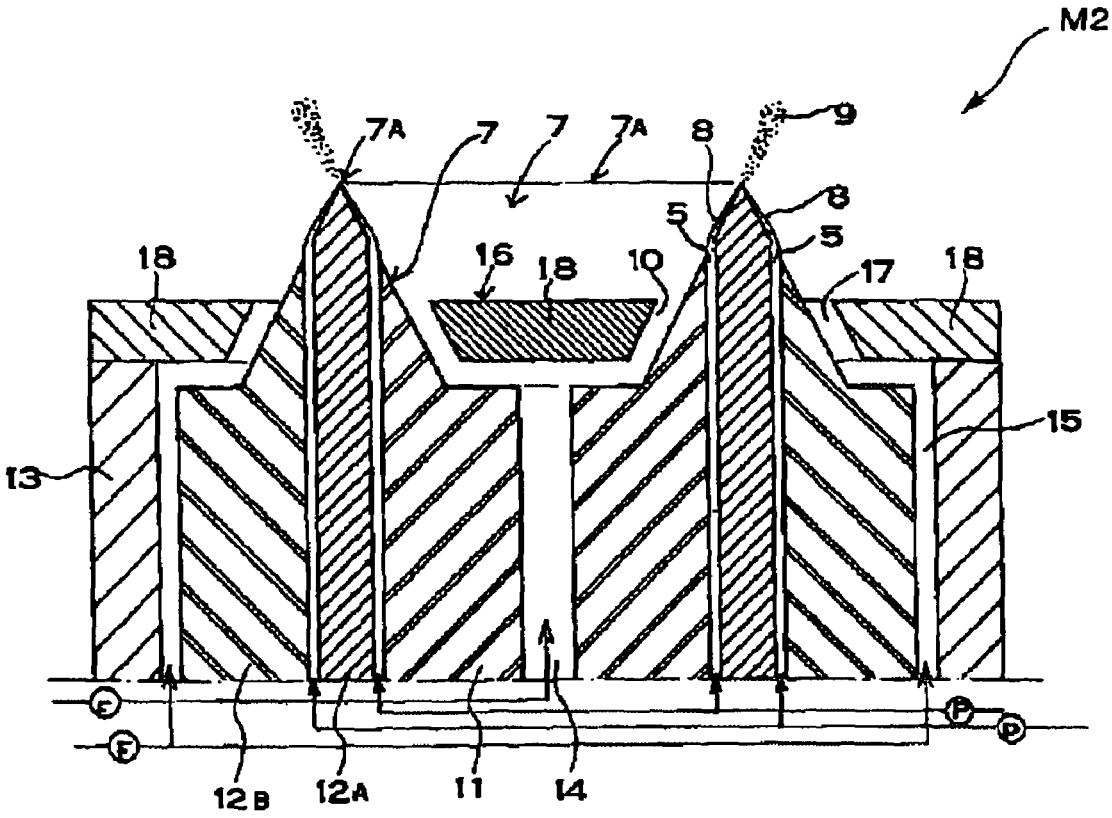
FIG. 6, is a cross sectional view which shows another embodiment of the nozzle for jetting a dispersion liquid in the form of fine particles.
Figure 7:
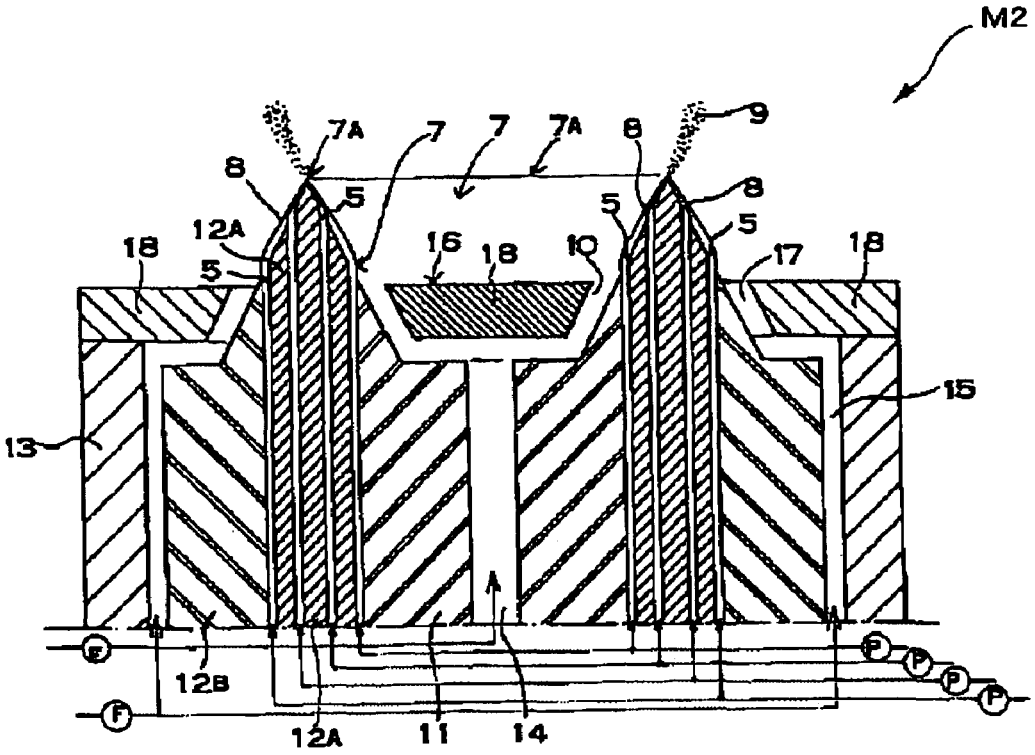
FIG. 7, is a cross sectional view which shows still another embodiment of the nozzle for jetting a dispersion liquid in the form of fine particles.
Figure 8:
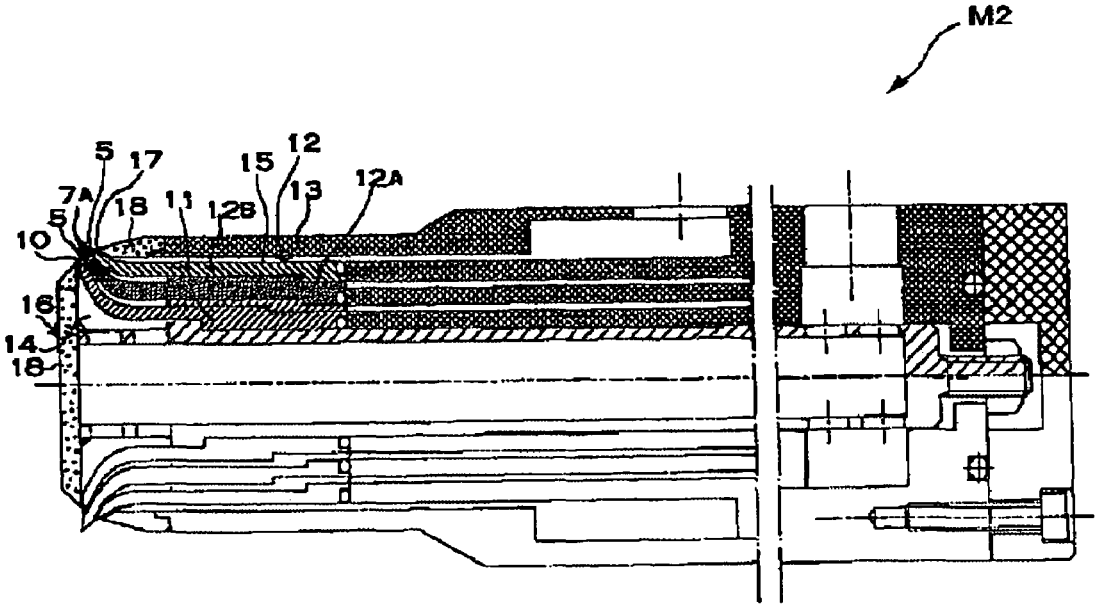
FIG. 8, is a cross sectional view which shows yet another embodiment of the nozzle for jetting a dispersion liquid in the form of fine particles.
Figure 9:
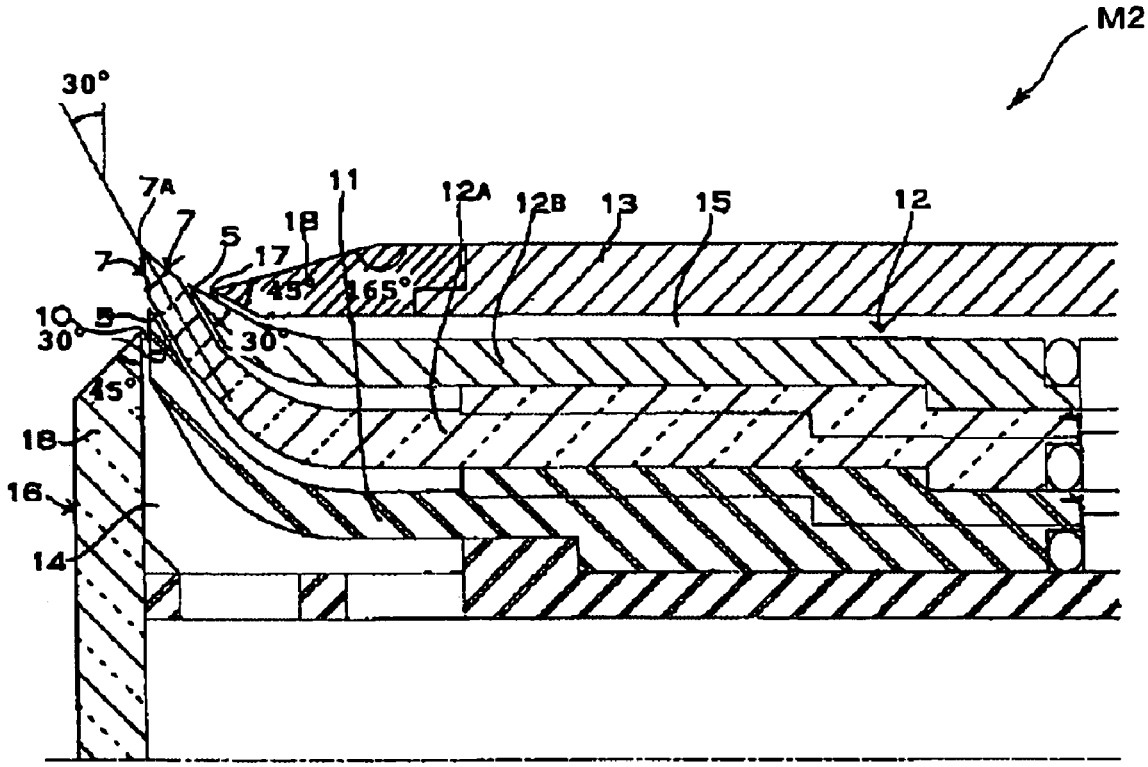
FIG. 9 is an enlarged fragmentary cross sectional view of an important part of the nozzle shown in FIG. 8.
Figure 10:
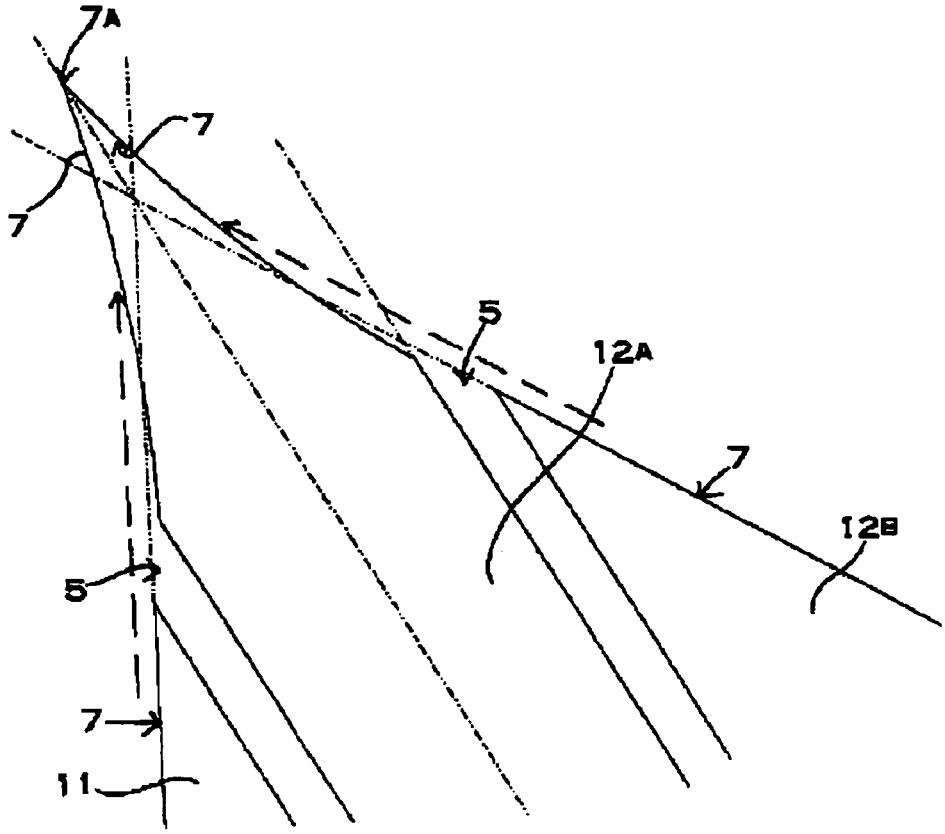
FIG. 10 is an enlarged cross sectional view which shows a tip part of an inner middle ring of the nozzle shown in FIG. 9.
Figure 11:
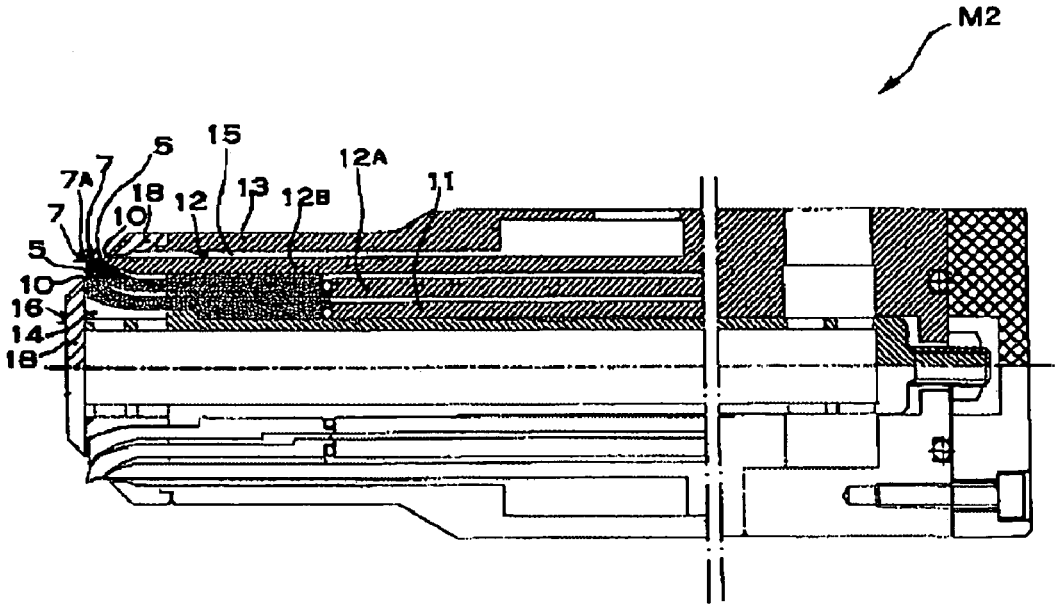
FIG. 11 is a cross sectional view which shows yet another embodiment of the nozzle for jetting a dispersion liquid in the form of fine particles.
Figure 12:
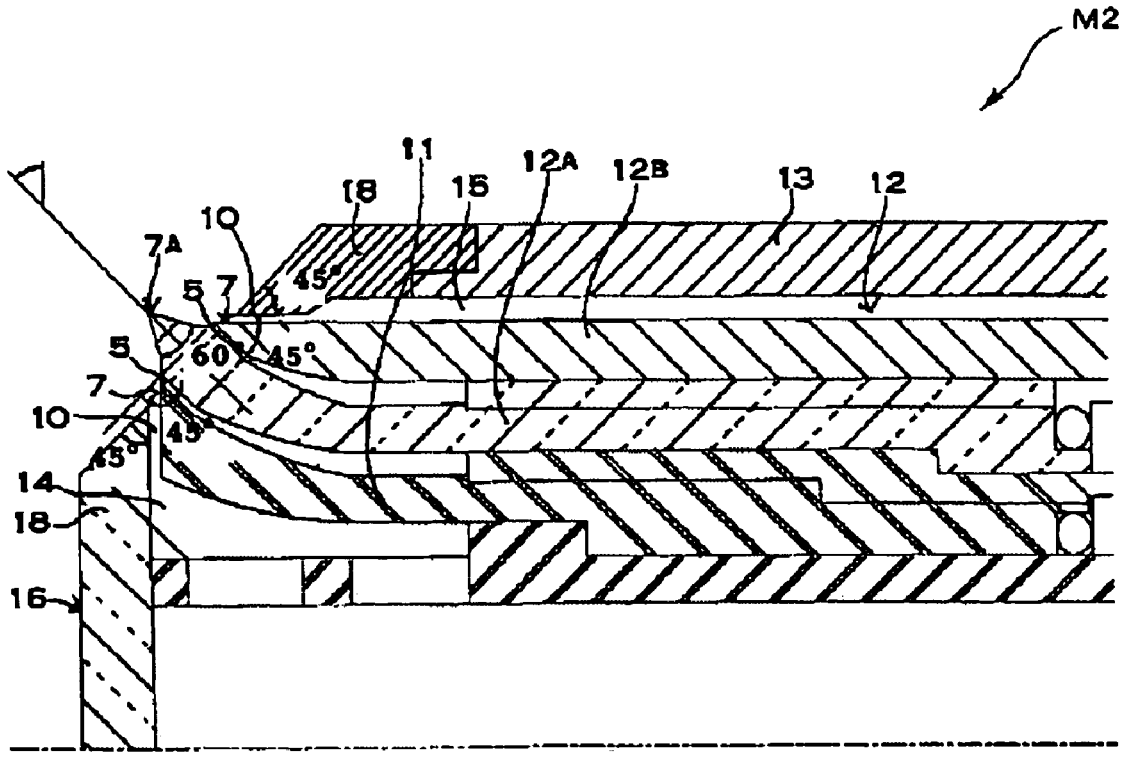
FIG. 12 is an enlarged fragmentary cross sectional view of an important part of the nozzle shown in FIG. 11.
Figure 13:
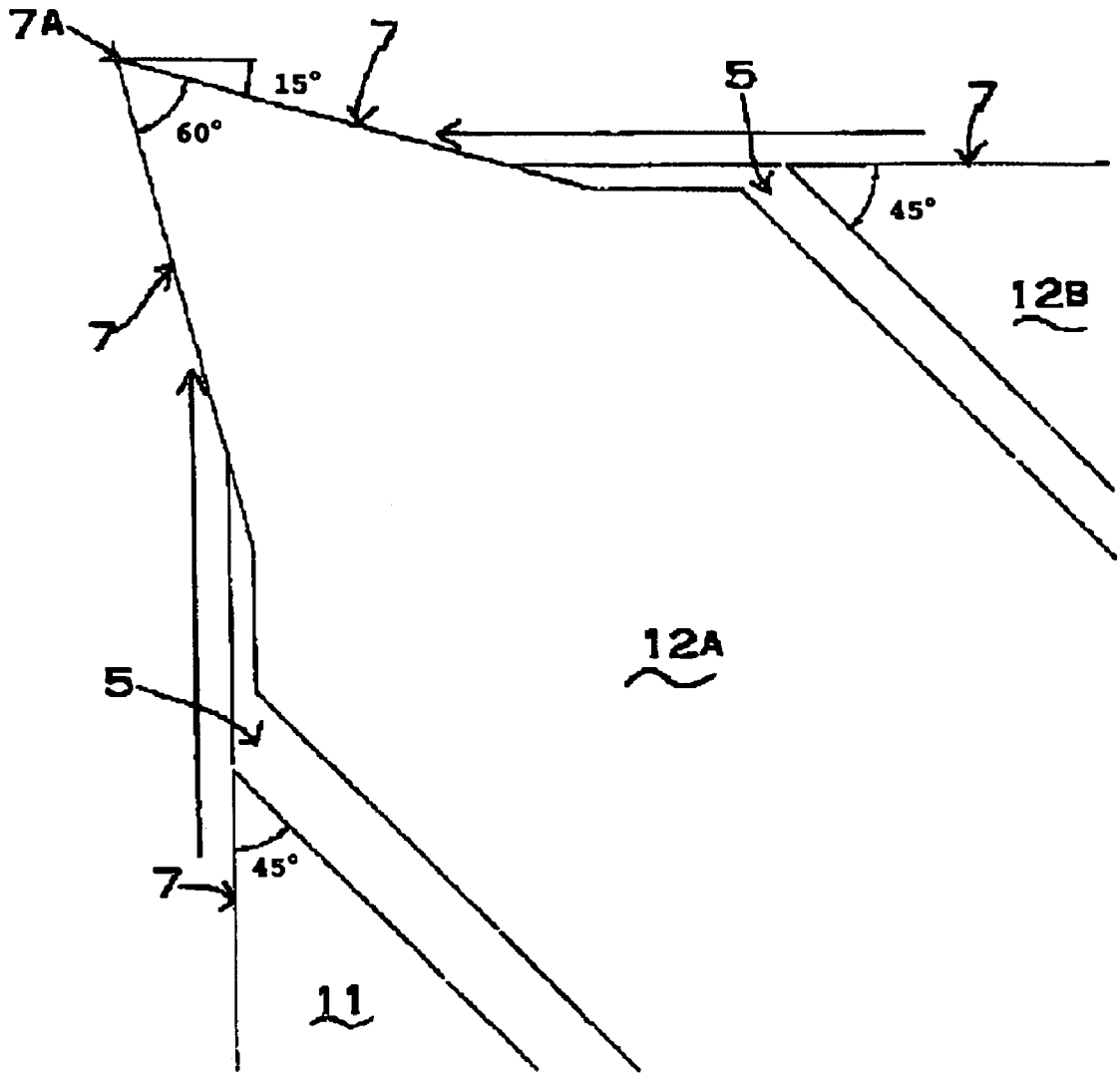
FIG. 13 is an enlarged cross sectional view which shows a tip part of an inner middle ring of the nozzle shown in FIG. 11.
Figure 14:
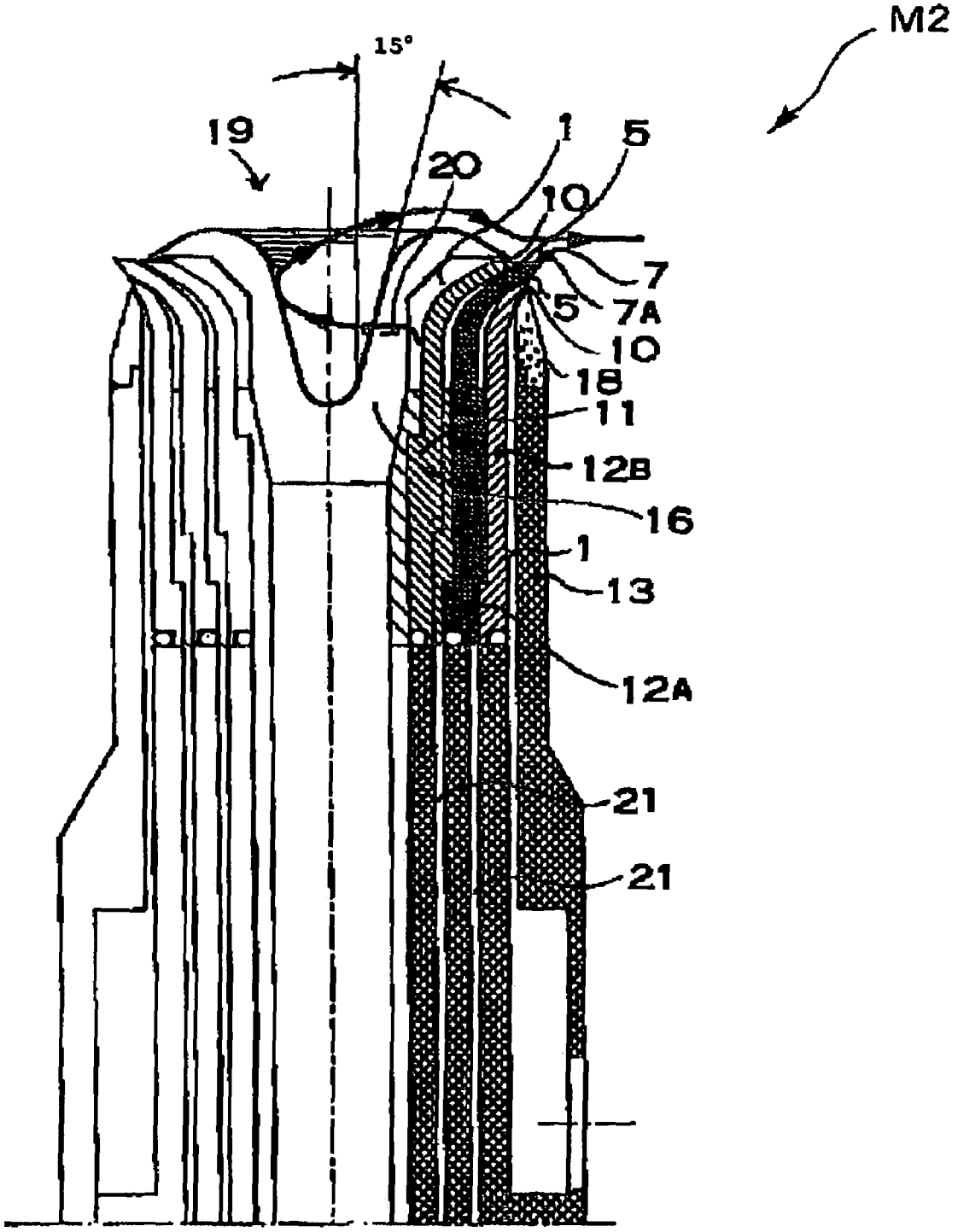
FIG. 14 is a cross sectional view which shows yet another embodiment of the nozzle for jetting a dispersion liquid in the form of fine particles.
Figure 15:
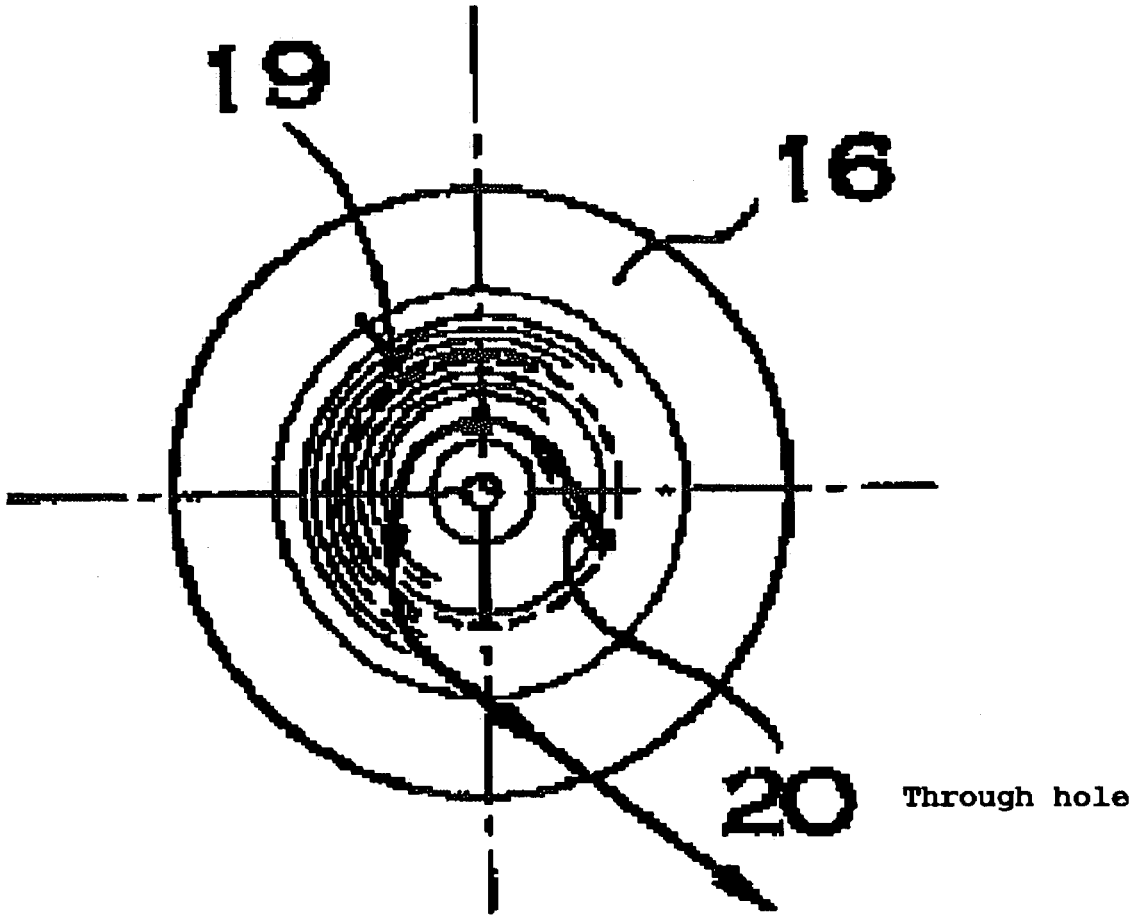
FIG. 15 is a plan view of a gas releasing concave part shown in FIG. 14.
Figure 16:
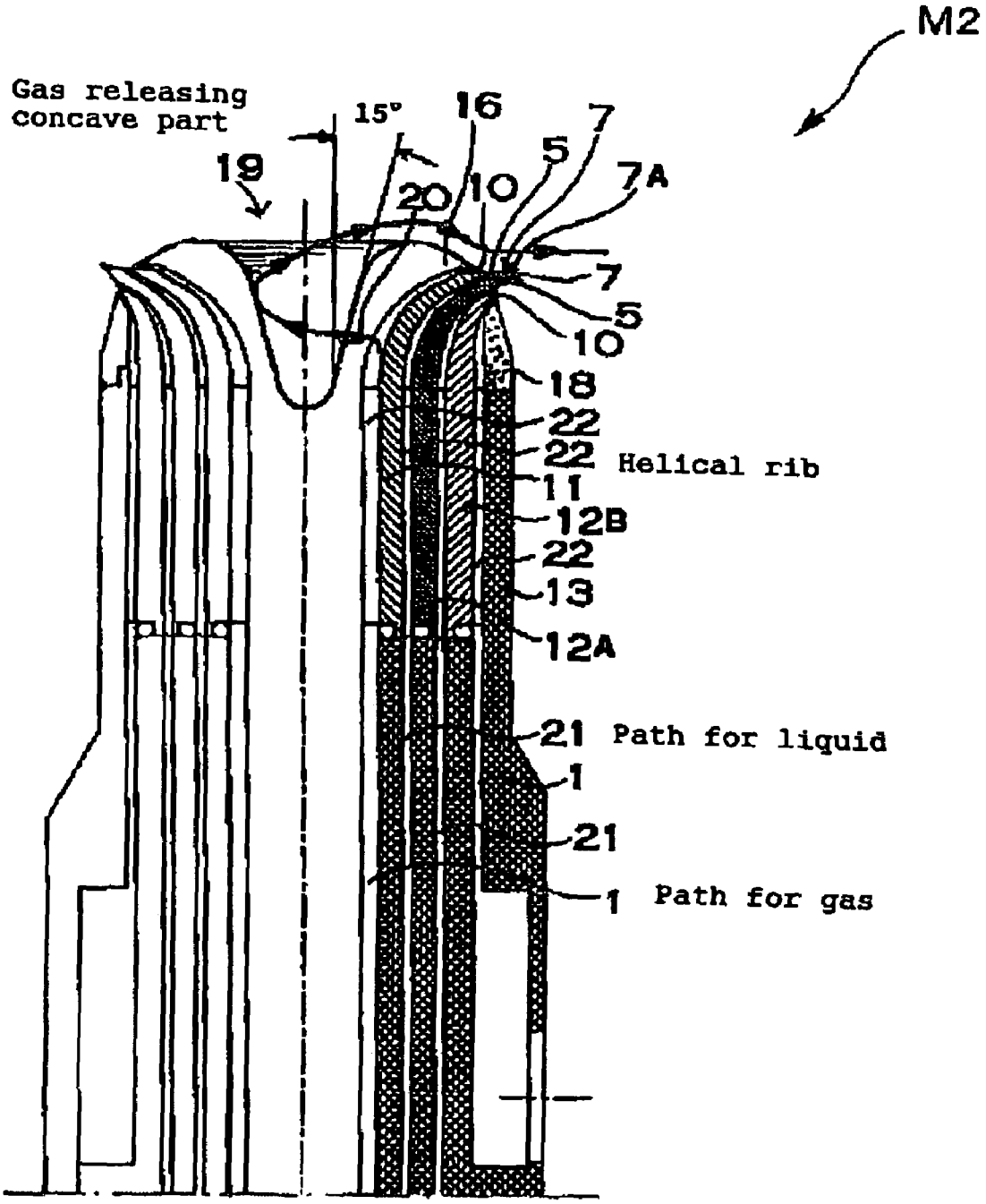
FIG. 16 is a cross sectional view which shows yet another embodiment of the nozzle for jetting a dispersion liquid in the form of fine particles.
Figure 17:
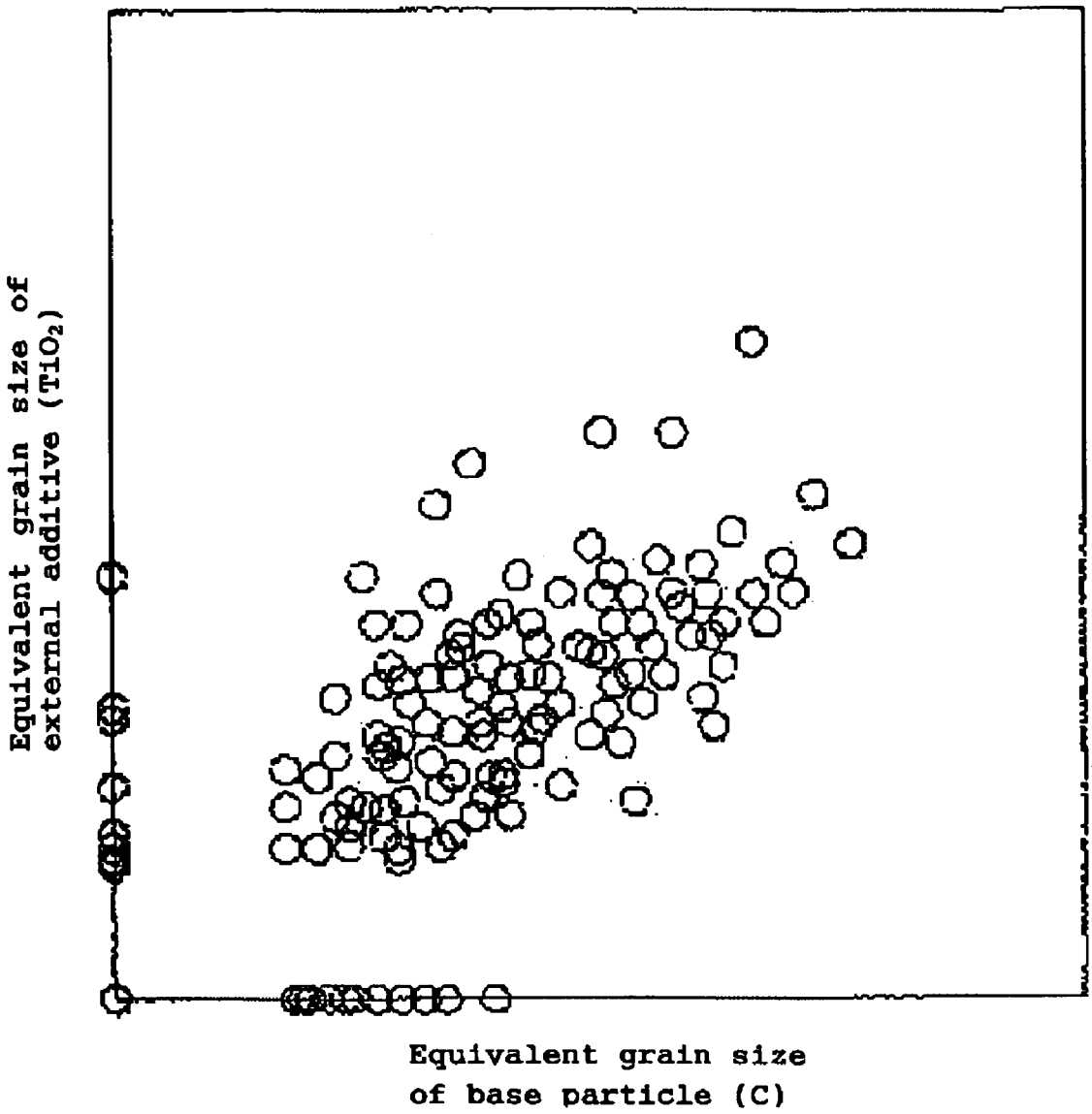
FIG. 17 is a diagram for explaining a method for measuring the amount of rutile-anatase type titanium oxide liberated from toner particles contained in the toner.

FIG. 1 is a longitudinal sectional view which schematically shows one example of the structure of a kneading machine for manufacturing a kneaded material for use in preparing a dispersion liquid, and one example of the structure of a cooling machine; FIG. 2 is a model diagram of a differential scanning calorimetry curve of block polyester in the vicinity of its melting point; FIG. 3 is a flow chart for analyzing a melting point; FIG. 4 is a vertical sectional view which schematically shows a preferred embodiment of a toner manufacturing device for use in manufacture of a toner of the present invention; FIG. 5 is a cross sectional view which shows a preferred embodiment of a nozzle for jetting a dispersion liquid in the form of fine particles; FIGS. 6, 7 and 8 are cross sectional views which show other embodiments of the nozzle for jetting a dispersion liquid in the form of fine particles; FIG. 9 is an enlarged fragmentary cross sectional view of an important part of the nozzle shown in FIG. 8; FIG. 10 is an enlarged cross sectional view which shows a tip part of an inner middle ring of the nozzle shown in FIG. 9; FIG. 11 is a cross sectional view which shows still another embodiment of the nozzle for jetting a dispersion liquid in the form of fine particles; FIG. 12 is an enlarged fragmentary cross sectional view of an important part of the nozzle shown in FIG. 11; FIG. 13 is an enlarged cross sectional view which shows a tip part of an inner middle ring of the nozzle shown in FIG. 11; FIG. 14 is a cross sectional view which shows yet another embodiment of the nozzle for jetting a dispersion liquid in the form of fine particles; FIG. 15 is a plan view of a gas releasing concave part shown in FIG. 14; FIG. 16 is a cross sectional view which shows yet another embodiment of the nozzle for jetting a dispersion liquid in the form of fine particles; and FIG. 17 is a diagram for explaining a method for measuring the amount of rutile-anatase type titanium oxide liberated from toner particles contained in the toner. Hereinbelow, in FIG. 1, the left side will be described as a "proximal end" and the right side will be described as a "distal end".

<Dispersion Liquid>

First, a dispersion liquid 3 to be used in the present invention will be described. The toner of the present invention is manufactured using the dispersion liquid 3. The dispersion liquid 3 is comprised of a dispersion medium 32 and a dispersoid (dispersed phase) 31, in which the dispersoid 31 is dispersed in the dispersion medium 32 in the form of fine particles.

(Dispersion Medium)

Any dispersion medium can be used as the dispersion medium 32 as long as it can disperse the dispersoid 31 (which will be described later) therein. However, it is preferred that such a dispersion medium 32 is comprised of a material which is commonly used as a solvent.

Examples of such a material include: inorganic solvents such as water, carbon disulfide, carbon tetrachloride, and the like: and organic solvents such as ketone-based solvents (e.g., methyl ethyl ketone (MEK), acetone, diethyl ketone, methyl isobutyl ketone (MIBK), methyl isopropyl ketone (MIPK), cyclohexanone, 3-heptanone, 4-heptanone, and the like); alcohol-based solvents (e.g., methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, phenol, and the like); ether-based solvents (e.g., diethyl ether, dipropyl ether, diisopropyl ether, dibutyl ether, 1,2-dimethoxyethane (DME), 1,4-dioxane, tetrahydrofuran (THF), tetrahydropyran (THP), anisole, diethylene glycol dimethyl ether (diglyme), 2-methoxyethanol, and the like); cellosolve-based solvents (e.g., methyl cellosolve, ethyl cellosolve, phenyl cellosolve, and the like); aliphatic hydrocarbon-based solvents (e.g., hexane, pentane, heptane, cyclohexane, methylcyclohexane, octane, didecane, methylcyclohexene, isoprene, and the like); aromatic hydrocarbon-based solvents (e.g., toluene, xylene, benzene, ethylbenzene, naphthalene, and the like); aromatic heterocyclic compound-based solvents (e.g., pyridine, pyrazine, furan, pyrrole, thiophene, 2-methyl pyridine, 3-methyl pyridine, 4-methyl pyridine, furfuryl alcohol, and the like); amide-based solvents (e.g., N,N-dimethyl formamide (DMF), N,N-dimethyl acetamide (DMA), and the like); halogenated compound-based solvents (e.g., dichloromethane, chloroform, 1,2-dichloroethane, trichloroethylene, chlorobenzene, and the like); ester-based solvents (e.g., acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate, ethyl benzoate, and the like); amine-based solvents (e.g., trimethylamine, hexylamine, triethylamine, aniline, and the like); nitrile-based solvents (e.g., acrylonitrile, acetonitrile, and the like); nitro-based solvents (e.g., nitromethane, nitroethane, and the like); aldehyde-based solvents (e.g., acetaldehyde, propionaldehyde, butyraldehyde, pentanal, acrylaldehyde, and the like); and the like. These materials can be used singly or in combination of two or more.

Among these materials, it is preferred that the dispersion medium 32 is mainly comprised of water and/or a liquid having high compatibility with water (that is a liquid having a solubility of 30 g or more/100 g $H_2O$ at 25° C., for example). By using such a dispersion medium, it is possible to improve dispersibility of the dispersoid 31 in the dispersion medium 32, so that the particle size of the particle of the dispersoid 31 becomes relatively small, and a variation in size of particles of the dispersoid 31 also becomes small. As a result, it is possible to obtain toner particles 4 having small variations in size and shape, and relatively high roundness.

Further, in a case where a constituent material of the dispersion medium 32 is a mixture of a plurality of components, it is preferred that at least two components of the constituent material (mixture) can form a constant boiling mixture (constant boiling mixture with a minimum boiling point). When the dispersion medium 32 is comprised of such a constituent material, it is possible to effectively eliminate the dispersion medium 32 in a solidifying section or the like in a toner manufacturing device (which will be described later). Also, it is possible to eliminate the dispersion medium 32 at a relatively low temperature in the solidifying section or the like of the toner manufacturing device, so that deterioration in properties of the obtained toner particles 4 can be effectively prevented. Examples of a liquid which can form a constant boiling mixture with water include carbon disulfide, carbon tetrachloride, methyl ethyl ketone (MEK), acetone, cyclohexanone, 3-heptanone, 4-heptanone, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, phenol, dipropyl ether, dibutyl ether, 1,4-dioxane, anisole, 2-methoxyethanol, hexane, heptane, cyclohexane, methylcyclohexane, octane, didecane, methylcyclohexene, isoprene, toluene, benzene, ethyl benzene, naphthalene, pyridine, 2-methylpyridine, 3-methylpyridine, 4-methylpyridine, chloroform, 1,2-dichloroethane, trichloroethylene, chlorobenzene, acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate, ethyl benzoate, trimethylamine, hexylamine, triethylamine, aniline, acrylonitrile, acetonitrile, nitromethane, nitroethane, acrylaldehyde, and the like.

Although the boiling point of the dispersion medium 32 is not limited to any specific value, it is preferably 180° C. or less, more preferably 150° C. or less, and even more preferably in the range of 35 to 130° C. When the dispersion medium 32 has such a relatively low boiling point, the dispersion medium 32 is relatively easily eliminated in the solidifying section or the like of the toner manufacturing apparatus (which will be described later). Further, by using such a material as the dispersion medium 32, the amount of the dispersion medium 32 remained in the toner particles 4 finally obtained can be made especially small. As a result, reliability of the obtained toner is further improved.

In this connection, the dispersion medium 32 may contain a component other than the above-mentioned materials. For example, the dispersion medium 32 may contain a material which will be given later as an example of a component of the dispersoid 31, and various additives such as an inorganic fine powder made of silica, titanium oxide or iron oxide, and an organic fine powder made of fatty acid or a metal salt of fatty acid, and the like.

(Dispersoid)

In general, the dispersoid 31 is composed of a material containing at least a resin as a main component.

Hereinbelow, a description will be made with regard to constituent materials of the dispersoid 31.

1. Resin (Binder Resin)

In the present invention, the resin (binder resin) is mainly composed of polyester-based resin. The content of the polyester-based resin in the resin is preferably 50 wt % or more, and more preferably 80 wt % or more.

The polyester-based resin contains two or more kinds of polyesters (which are different in at least one of the conditions of composition, physical properties, chemical properties, and the like). By using two or more kinds of polyesters in combination, an obtained toner can simultaneously have both of high mechanical strength (that is a stability for mechanical stress) and a sufficient fixing property (in a wide temperature range). As for such polyester-based resin, polyester-based resin containing two kinds of polyesters which have different crystallinity, polyester-based resin containing two kinds of polyesters which have different melting points $T_{1/2}$, or the like can be employed, for example. In the present invention, it is particularly preferred that the polyester-based resin contains at least block polyester and amorphous polyester as will be described later. By using such polyester-based resin, especially excellent effects as will be described later can be obtained. Hereinbelow, a description will be made as an example with regard to a case where the polyester-based resin containing both of the block polyester and the amorphous polyester is used.

1-1. Block Polyester

The block polyester comprises a block copolymer which has a crystalline block obtained by condensation of a diol component with a dicarboxylic acid component and an amorphous block having crystallinity lower than that of the crystalline block.

<1> Crystalline Block

The crystalline block has higher crystallinity as compared with the amorphous block or the amorphous polyester. That is, the crystalline block has a firmer and more stable molecular arrangement or structure as compared with the amorphous block or the amorphous polyester. Therefore, the crystalline block contributes to improving mechanical strength of a resultant toner as a whole, and as a result, the resultant toner can have high mechanical strength (that is, high resistance to mechanical stress) and excellent durability and storage stability.

In the meantime, in general, a resin with high crystallinity has the so-called sharp-melt property. That is, when an endothermic peak of a resin with high crystallinity at its melting point is measured according to differential scanning calorimetry (DSC), the resin with high crystallinity exhibits a sharper endothermic peak as compared with a resin with low crystallinity.

As described above, since the crystalline block has high crystallinity, the crystalline block can impart a sharp-melt property to the block polyester. This makes it possible for the toner of the present invention to keep excellent shape stability even at a relatively high temperature (temperature in the vicinity of the melting point of the block polyester) at which the amorphous polyester (which will be described later) can be sufficiently softened. Therefore, the toner of the present invention can exhibit a sufficient fixing property (fixing strength) in a wide temperature range.

Now, a description will be made with regard to components constituting the crystalline block.

The crystalline block is composed of a diol component and a dicarboxylic acid component, for example.

The diol component to be used in the present invention is not particularly limited as long as it has two hydroxyl groups Examples of such a diol component include aromatic diol having an aromatic ring structure, aliphatic diol having no aromatic ring structure, and the like. As for such aromatic diol, bisphenol A, alkylene oxide adduct of bisphenol A, or the like can be mentioned, for example. As for such aliphatic diol, chain diols such as ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol; or ring diols such as 2,2-bis(4-hydroxycyclohexyl) propane, an alkylene oxide adduct of 2,2-bis(4-hydroxycyclohexyl)propane, 1,4-cyclohexanediol, 1,4-cyclohexanedimethanol, hydrogenated bisphenol A, and an alkylene oxide adduct of hydrogenated bisphenol A can be mentioned, for example.

As described above, although such a diol component constituting the crystalline block is not particularly limited, it is preferred that at least a part of the diol component is aliphatic diol, it is more preferred that 80 mol % or more of the diol component is aliphatic diol, and it is even more preferred that 90 mol % or more of the diol component is aliphatic diol. This makes it possible for an obtained block polyester (crystalline block) to have especially high crystallinity, and as a result, the effects described above become more conspicuous.

Further, it is preferred that the diol component constituting the crystalline block includes diol having a straight-chain molecular structure containing 3 to 7 carbon atoms and hydroxyl groups at both ends of the chain (that is a diol represented by the general formula $HO—(CH_2)_n—OH$, where n=3 to 7). When the diol component includes such diol, an obtained block polyester can have higher crystallinity and a lower coefficient of friction, thereby enabling a resultant toner to have high mechanical strength and excellent durability and storage stability. Examples of such diol include 1,3-propanediol, 1,4-butanediol, 1,5-pentanediol, 1,6-hexanediol, and the like. Among them, 1,4-butanediol is preferable. When the diol component includes 1,4-butanediol, the effects described above become more conspicuous.

In a case where the diol component constituting the crystalline block includes 1,4-butanediol, it is preferred that 50 mol % or more of the diol component is 1,4-butanediol, and it is more preferred that 80 mol % or more of the diol component is 1,4-butanediol. This makes the effects described above more conspicuous.

As for the dicarboxylic acid component constituting the crystalline block, divalent carboxylic acid or derivatives thereof (acid anhydride, lower alkyl ester, and the like, for example) can be employed. Examples of such divalent carboxylic acid and derivatives thereof include o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid and their derivatives (anhydride, lower alkyl ester, and the like, for example).

Although the dicarboxylic acid component constituting the crystalline block is not particularly limited, it is preferred that at least a part of the dicarboxylic acid component has a terephthalic acid structure, it is more preferred that 50 mol % or more of the dicarboxylic acid component has a terephthalic acid structure, and it is even more preferred that 80 mol % or more of the dicarboxylic acid component has a terephthalic acid structure. This makes it possible for a resultant toner to have an especially excellent balance of various properties required of a toner. It is to be noted here that what is meant by "dicarboxylic acid component" is a dicarboxylic acid component which exists in an obtained block polyester. In preparation of block polyester, (in formation of a crystalline block), the dicarboxylic acid component itself, or its derivative such as acid anhydride, lower alkyl ester, or the like can be employed.

The content of the crystalline block in the block polyester is not limited to any specific value, but it is preferably in the range of 5 to 60 mol %, and more preferably in the range of 10 to 40 mol %. If the content of the crystalline block is less than the above lower limit value, there is a case that the above-described effects obtained by the inclusion of the crystalline block can not be sufficiently exhibited, depending on the amount of the block polyester to be contained in a resultant toner, or the like. On the other hand, if the content of the crystalline block exceeds the above upper limit value, the content of the amorphous block is relatively decreased, so that there is a possibility that compatibility between the block polyester and the amorphous polyester (which will be described later) is lowered.

In this connection, the crystalline block may contain other components in addition to the above-mentioned diol component and dicarboxylic acid component. Examples of such other components include a trivalent or higher valent alcohol component, a trivalent or higher valent carboxylic acid component, and the like.

<2> Amorphous Block

The amorphous block has lower crystallinity as compared with the above-described crystalline block. Also, the amorphous polyester (which will be described later) has lower crystallinity as compared with the crystalline block. That is, like the amorphous polyester, the amorphous block has lower crystallinity as compared with the crystalline block.

In the meantime, in general, in a case where resins are compounded, if the resins have a large difference in crystallinity, compatibility between them tends to be low, whereas if the resins have a small difference in crystallinity, compatibility between them tends to be high. For this reason, inclusion of the amorphous block in the block polyester makes it possible to improve compatibility (dispersibility) between the block polyester and the amorphous polyester (which will be described later). As a result, it is possible to effectively prevent phase separation between the block polyester and the amorphous polyester (in particular, macro-phase separation) from occurring in a resultant toner, thereby enabling the toner to sufficiently and stably exhibit the advantages of both of the block polyester and the amorphous polyester.

Now, a description will be made with regard to components constituting the amorphous block.

The amorphous block is composed of a diol component and a dicarboxylic acid component, for example.

The diol component to be used in the present invention is not particularly limited as long as it has two hydroxyl groups. Examples of such a diol component include aromatic diol having an aromatic ring structure, aliphatic diol having no aromatic ring structure, and the like. As for such aromatic diol, bisphenol A, alkylene oxide adduct of bisphenol A, or the like can be mentioned, for example. As for such aliphatic diol, chain diols such as ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol; or ring diols such as 2,2-bis(4-hydroxycyclohexyl)propane, an alkylene oxide adduct of 2,2-bis(4-hydroxycyclohexyl)propane, 1,4-cyclohexanediol, 1,4-cyclohexanedimethanol, hydrogenated bisphenol A, and an alkylene oxide adduct of hydrogenated bisphenol A can be mentioned, for example.

As described above, although the diol component constituting the amorphous block is not limited to any specific one, it is preferred that at least a part of the diol component is aliphatic diol, and it is more preferred that 50 mol % or more of the diol component is aliphatic diol. This makes it possible to obtain an effect that an obtained fixed image can have excellent toughness (that is, an obtained fixed image can have high resistance to bending).

Further, in the diol component constituting the amorphous block, it is preferred that at least a part of the diol component has a branched chain (side chain), and it is more preferred that 30 mol % or more of the diol component has a branched chain. This makes it possible to obtain an effect that a regular arrangement of molecules is suppressed so that crystallinity is lowered and transparency is improved.

As for the dicarboxylic acid component constituting the amorphous block, divalent carboxylic acid or derivatives thereof (acid anhydride, lower alkyl ester, and the like, for example) can be employed. Examples of such divalent carboxylic acid and derivatives thereof include o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid and their derivatives (anhydride, lower alkyl ester, and the like, for example).

As described above, although the dicarboxylic acid component constituting the amorphous block is not limited to any specific one, it is preferred that at least a part of the dicarboxylic acid component has a terephthalic acid structure, and it is more preferred that 80 mol % or more of the dicarboxylic acid component has a terephthalic acid structure. This makes it possible for a resultant toner to have an especially excellent balance of various properties required of a toner. It is to be noted here that what is meant by "dicarboxylic acid component" is a dicarboxylic acid component which exists in an obtained block polyester. In preparation of block polyester (in formation of an amorphous block), the dicarboxylic acid component itself, or its derivative such as acid anhydride, lower alkyl ester or the like can be employed.

In this connection, the amorphous block may contain other components in addition to the above-mentioned diol component and dicarboxylic acid component. Examples of such other components include a trivalent or higher valent alcohol component, a trivalent or higher valent carboxylic acid component, and the like.

The average molecular weight (weight average molecular weight) Mw of the block polyester having the above-described crystalline block and amorphous block is not limited to any specific value, but it is preferably in the range of $1\times10^4$ to $3\times10^5$, and more preferably in the range of $1.2\times10^4$ to $1.5\times10^5$. If the average molecular weight Mw of the block polyester is less than the above lower limit value, there is a possibility that the mechanical strength of a resultant toner is lowered so that the toner can not have sufficient durability (storage stability). Further, if the average molecular weight Mw of the block polyester is too small, cohesive failure is likely to occur when the toner is fixed and thus the anti-offset property of the toner tends to lower. On the other hand, if the average molecular weight Mw of the block polyester exceeds the above upper limit value, intergranular fracture is likely to occur when the toner is fixed, and wettability to a transfer material (recording medium) such as paper is lowered so that a required amount of heat for fixation is increased.

The glass transition point $T_g$ of the block polyester is not limited to any specific value, but it is preferably in the range of 50 to 75° C., and more preferably in the range of 55 to 70° C. If the glass transition point of the block polyester is less than the above lower limit value, storage stability (heat resistance) of a resultant toner is lowered, thus resulting in a case that fusion occurs between toner particles of the toner depending on an environment where the toner is used. On the other hand, if the glass transition point of the block polyester exceeds the above upper limit value, a fixing property at low temperature or transparency of a resultant toner is lowered. In this connection, the glass transition point can be measured according to the method defined by JIS K 7121.

The softening point $T_{1/2}$ of the block polyester is not limited to any specific value, but it is preferably in the range of 90 to 160° C., and more preferably in the range of 100 to 150° C. If the softening point of the block polyester is less than the above lower limit value, there is a possibility that the storage stability of a resultant toner is lowered so that the toner can not have sufficient durability. Further, if the softening point of the block polyester is too low, cohesive failure is likely to occur when the toner is fixed, and thus the anti-offset property of the toner tends to lower. On the other hand, if the softening point of the block polyester exceeds the above upper limit value, intergranular fracture is likely to occur when the toner is fixed, and wettability to a transfer material (recording medium) such as paper is lowered so that a required amount of heat for fixation is increased. In this connection, the softening point $T_{1/2}$ can be determined as a temperature on the flow curve corresponding to h/2 in the analytical flow chart shown in FIG. 3 which is obtained when measurement is carried out using a flow tester under the conditions of a sample amount of 1 g, a die hole diameter of 1 mm, a die length of 1 mm, a load of 20 kgf, a pre-heating time of 300 seconds, a measurement start temperature of 50° C., and a rate of temperature rise of 5° C./min.

The melting point $T_m$ of the block polyester (that is, the peak central value $T_{mp}$ of endothermic peak of the block polyester in the vicinity of its melting point determined according to differential scanning calorimetry which will be described later) is not limited to any specific value, but it is preferably 190° C. or higher, and more preferably in the range of 190 to 230° C. If the melting point of the block polyester is lower than 190° C., there is a possibility that an effect such as an improved anti-offset property, or the like can not be sufficiently obtained. In this connection, the melting point can be determined by, for example, measuring an endothermic peak according to differential scanning calorimetry (DSC).

Further, in a case where a resultant toner is to be used with a fixing device having a fixing roller as will be described later, when the melting point of the block polyester is defined as $T_m$ (B) (° C.), and a predetermined normal temperature at the surface of the fixing roller is defined as $T_{fix}$ (° C.), it is preferred that $T_m$ (B) and $T_{fix}$ satisfy the relation $T_{fix} \leqq T_m(B) \leqq (T_{fix}+100)$, and it is more preferred that they satisfy the relation $(T_{fix}+10) \leqq T_m(B) \leqq (T_{fix}+70)$. When they satisfy such a relation, the crystalline component contained in a resultant toner is not fused when the toner is fixed so that the viscosity of the toner is not lowered below a certain value, and therefore releasability of the toner from the fixing roller is ensured.

Furthermore, it is preferred that the melting point of the block polyester is higher than the softening point of the amorphous polyester (which will be described later). This improves the shape stability of a resultant toner so that the toner can stably exhibit high mechanical strength As described above, since the block polyester used in the present invention has a crystalline block with high crystallinity, the block polyester has the so-called sharp-melt property in contrast to a resin material with relatively low crystallinity (amorphous polyester which will be described later, or the like, for example).

As for an index of crystallinity, the value of ΔT determined by the equation $\Delta T=T_{mp}-T_{ms}$ can be mentioned (see FIG. 2), where $T_{mp}$ (° C.) represents the peak central value of an endothermic peak obtained when a melting point is measured according to differential scanning calorimetry (DSC), and $T_{ms}$ (° C.) represents the shoulder peak value of the peak. In this connection, a smaller value of ΔT means higher crystallinity.

The value of ΔT of the block polyester is preferably 50° C. or less, and more preferably 20° C. or less. Conditions for measuring $T_{mp}$ (° C.) and $T_{ms}$ (° C.) are not particularly limited. For example, they can be measured under the condition that the block polyester as a sample is heated to 200° C. at a temperature rise rate of 10° C./min, cooled at a temperature drop rate of 10° C./min, and then heated again at a temperature rise rate of 10° C./min.

Further, as described above, the block polyester has crystallinity higher than that of the amorphous polyester (which will be described later). Therefore, when the value of ΔT of the amorphous polyester is defined as $\Delta T_A$ (° C.), and the value of ΔT of the block polyester is defined as $\Delta T_B$ (° C.), $\Delta T_A$ and $\Delta T_B$ satisfy the relation $\Delta T_A>\Delta T_B$. In particular, in the present invention, it is preferred that $\Delta T_A$ and $\Delta T_B$ satisfy the relation $\Delta T_A-\Delta T_B>10$, and it is more preferred that they satisfy the relation $\Delta T_A-\Delta T_B>30$. When such a relation is satisfied, the effects described above become more conspicuous. When the crystallinity of the amorphous polyester is particularly low, there is a case that one of $T_{mp}$ and $T_{ms}$ or both of $T_{mp}$ and $T_{ms}$ are difficult to be measured (difficult to be discriminated). In such a case, $\Delta T_A$ is indicated by ∞ (° C.).

The heat of fusion $E_f$ of the block polyester determined by the measurement of endothermic peak of the block polyester at its melting point according to differential scanning calorimetry is preferably 5 mJ/mg or greater, and more preferably 15 mJ/mg or greater. If the heat of fusion $E_f$ of the block polyester is less than 5 mJ/mg, there is a possibility that the above-described effects obtained by the inclusion of the crystalline block are not sufficiently exhibited. In this regard, it is to be noted that the heat of fusion does not include an amount of heat of an endothermic peak at a glass transition point (see FIG. 2). Conditions for measuring an endothermic peak at a melting point are not particularly limited. For example, an endothermic peak of the block polyester at its melting point can be measured under the condition that the block polyester as a sample is heated to 200° C. at a temperature rise rate of 10° C./min, cooled at a temperature drop rate of 10° C./min, and then heated again at a temperature rise rate of 10° C./min, and the heat of fusion of the block polyester can be determined from the thus obtained endothermic peak.

Further, the block polyester is preferably a linear polymer (that is a polymer having no cross-linked structure). Such a linear polymer has a smaller coefficient of friction as compared with a cross-linked type polymer. This makes it possible for a resultant toner to have especially excellent releasability so that the transfer efficiency of the toner is further improved.

In this connection, the block polyester may have other blocks in addition to the crystalline block and the amorphous block.

1-2. Amorphous Polyester

The amorphous polyester has crystallinity lower than that of the block polyester.

Such amorphous polyester is a component which mainly contributes to improving dispersibility of various components constituting a toner (a coloring agent, a wax, a charge control agent, and the like, for example), cohesiveness (cohesive strength) of the dispersoid 31 at the time when fine particles of the dispersion liquid 3 (droplets 9) are solidified, and various properties of a toner, such as a fixing property (in particular, a fixing property at low temperature), transparency, mechanical properties (elasticity, mechanical strength, and the like, for example), chargeability and moisture resistance. In other words, if a resultant toner does not contain the amorphous polyester as will be described later in detail, it is difficult for the toner to sufficiently exhibit the above-described properties required of a toner.

Now, a description will be made with regard to components constituting the amorphous polyester.

The amorphous polyester is composed of a diol component and a dicarboxylic acid component, for example.

The diol component to be used in the present invention is not particularly limited as long as it has two hydroxyl groups. Examples of such a diol component include aromatic diol having an aromatic ring structure, aliphatic diol having no aromatic ring structure, and the like. As for such aromatic diol, bisphenol A, alkylene oxide adduct of bisphenol A, or the like can be mentioned, for example. As for such aliphatic diol, chain diols such as ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol; or ring diols such as 2,2-bis(4-hydroxycyclohexyl)propane, an alkylene oxide adduct of 2,2-bis(4-hydroxycyclohexyl)propane, 1,4-cyclohexanediol, 1,4-cyclohexanedimethanol, hydrogenated bisphenol A, and an alkylene oxide adduct of hydrogenated bisphenol A can be mentioned, for example.

As for the dicarboxylic acid component constituting the amorphous polyester, divalent carboxylic acid or derivatives thereof (acid anhydride, lower alkyl ester, and the like, for example) can be employed. Examples of such divalent carboxylic acid and derivatives thereof include o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid and their derivatives (anhydride, lower alkyl ester, and the like, for example).

As described above, although the dicarboxylic acid component constituting the amorphous polyester is not limited to any specific one, it is preferred that at least a part of the dicarboxylic acid component has a terephthalic acid structure, it is more preferred that 80 mol % or more of the dicarboxylic acid component has a terephthalic acid structure, and it is even more preferred that 90 mol % or more of the dicarboxylic acid component has a terephthalic acid structure. This makes it possible for a resultant toner to have an especially excellent balance of various properties required of a toner. It is to be noted here that what is meant by "dicarboxylic acid component" is a dicarboxylic acid component which exists in an obtained amorphous polyester. In preparation of amorphous polyester, the dicarboxylic acid component itself, or its derivative such as acid anhydride, lower alkyl ester or the like can be employed.

Further, it is preferred that 50 mol % or more (more preferably 80 mol % or more) of a monomer component constituting the amorphous polyester is the same as a monomer component constituting the above-described amorphous block. Namely, it is preferred that the amorphous polyester is composed of a monomer component that is the same as a monomer component of the amorphous block. This makes the compatibility between the amorphous polyester and the block polyester especially excellent. In this regard, it is to be noted that the "monomer component" here does not mean a monomer which is to be used for manufacturing amorphous polyester and block polyester, but a monomer component which is contained in obtained amorphous polyester and block polyester.

In this connection, the amorphous polyester may contain other components in addition to the above-described diol component and dicarboxylic acid component. Examples of such other components include a trivalent or higher valent alcohol component, a trivalent or higher valent carboxylic acid component, and the like.

The average molecular weight (weight average molecular weight) Mw of the amorphous polyester is not limited to any specific value, but it is preferably in the range of $5\times10^3$ to $4\times10^4$, and more preferably in the range of $8\times10^3$ to $2.5\times10^4$. If the average molecular weight Mw of the amorphous polyester is less than the above lower limit value, there is a possibility that the mechanical strength of a resultant toner is lowered so that the toner can not have sufficient durability (storage stability). Further, if the average molecular weight Mw of the amorphous polyester is too small, cohesive failure is likely to occur when the toner is fixed and thus the anti-offset property of the toner tends to lower. On the other hand, if the average molecular weight Mw of the amorphous polyester exceeds the above upper limit value, intergranular fracture is likely to occur when the toner is fixed, and wettability to a transfer material (recording medium) such as paper is lowered so that a required amount of heat for fixation is increased.

The glass transition point $T_g$ of the amorphous polyester is not limited to any specific value, but it is preferably in the range of 50 to 75° C., and more preferably in the range of 55 to 70° C. If the glass transition point of the amorphous polyester is less than the above lower limit value, storage stability (heat resistance) of a resultant toner is lowered, thus resulting in a case where fusion occurs between toner particles of the toner depending on an environment where the toner is used. On the other hand, if the glass transition point of the amorphous polyester exceeds the above upper limit value, a fixing property at low temperature or transparency of a resultant toner is lowered. In this connection, the glass transition point can be measured according to the method defined by JIS K 7121.

The softening point $T_{1/2}$ of the amorphous polyester is not limited to any specific value, but it is preferably in the range of 90 to 160° C., more preferably in the range of 100 to 150° C., and even more preferably in the range of 100 to 130° C. If the softening point of the amorphous polyester is less than the above lower limit value, there is a possibility that the storage stability of a resultant toner is lowered so that the toner can not have sufficient durability. Further, if the softening point of the amorphous polyester is too low, cohesive failure is likely to occur when the toner is fixed, and thus the anti-offset property of the toner tends to lower. On the other hand, if the softening point of the amorphous polyester exceeds the above upper limit value, intergranular fracture is likely to occur when the toner is fixed, and wettability to a transfer material (recording medium) such as paper is lowered so that a required amount of heat for fixation is increased.

Further, when the softening point of the amorphous polyester is defined as $T_{1/2}$ (A) (° C.), and the melting point of the block polyester described above is defined as $T_m$ (B), it is preferred that $T_{1/2}$ (A) and $T_m$ (B) satisfy the relation $T_m$ (B)>($T_{1/2}$ (A)+60), and it is preferred that they satisfy the relation ($T_{1/2}$ (A)+60)<$T_m$ (B)<($T_{1/2}$ (A)+150). When such a relation is satisfied, a resultant toner can exhibit an excellent fixing property in a wider temperature range. Further, when such a relation is satisfied, cohesive strength among the particles of the dispersoid 31 at the time when the particles of the dispersoid 31 are agglomerated through the elimination of the dispersion medium 32 from fine particles (droplets 9) of the dispersion liquid 3 jetted toward a solidifying section M3 of a toner manufacturing device M1 (which will be described later) can be made especially high.

In this connection, the softening point of the amorphous polyester $T_{1/2}$ (A) (° C.) and the softening point of the block polyester $T_{1/2}$ (B) (° C.) may be the same, but it is preferred that they are different (in particular, a difference between them is preferably 5° C./ or more).

The softening point $T_{1/2}$ can be determined as a temperature on the flow curve corresponding to h/2 in the analytical flow chart shown in FIG. 3 which is obtained when measurement is carried out using a flow tester under the conditions of a sample amount of 1 g, a die hole diameter of 1 mm, a die length of 1 mm, a load of 20 kgf, a pre-heating time of 300 seconds, a measurement start temperature of 50° C., and a rate of temperature rise of 5° C./min.

Further, the amorphous polyester is preferably a linear polymer (that is a polymer having no cross-linked structure). Such a linear polymer has a smaller coefficient of friction as compared with a cross-linked type polymer. This makes it possible for a resultant toner to have especially excellent releasability so that the transfer efficiency of the toner is further improved.

As has been described above, the present invention has a feature in that the block polyester (containing the crystalline component) and the amorphous polyester are used in combination. By using the block polyester and the amorphous polyester in combination, a resultant toner can simultaneously exhibit the advantages of both of the block polyester and the amorphous polyester. That is, such a toner can have high mechanical strength (sufficient physical stability) and exhibit a sufficient fixing property (fixing strength) in a wide temperature range.

Such a synergistic effect can not be obtained, in a case where only one of the block polyester and the amorphous polyester is used.

Specifically, in a case where the block polyester is used singly (in a case where a resultant toner contains no amorphous polyester), a fixing property (in particular, a fixing property in low temperature range) of the toner is lowered. Further, in a case where the block polyester is used singly (in a case where a resultant toner contains no amorphous polyester), functions of the toner such as transparency are also lowered, and dispersibility of various components constituting the toner (a coloring agent, a wax, a charge control agent, and the like which will be described later, for example) and cohesiveness (cohesive strength) of the dispersoid 31 at the time when fine particles (droplets 9) of the dispersion liquid 3 are solidified are also lowered.

On the other hand, in a case where the amorphous polyester is used singly (in a case where a resultant toner contains no block polyester), the toner can not have sufficient mechanical strength, durability and storage stability. Further, in a case where the amorphous polyester is used singly (in a case where a resultant toner contains no block polyester), a sharp-melt property can not be obtained, so that it becomes difficult to ensure a sufficient fixing property (fixing strength) in a wide temperature range (in particular, in high temperature range).

In the meantime, polyester having high crystallinity (hereinafter, referred to as "crystalline polyester") generally has a stable molecular arrangement or structure. Therefore, crystalline polyester other than the above-described block polyester can also improve the mechanical strength of a resultant toner. However, since such crystalline polyester other than the block polyester is inferior in compatibility with the amorphous polyester, in a case where the crystalline polyester other than the block polyester is used in combination with the amorphous polyester, phase separation is likely to occur. Therefore, in a case where the crystalline polyester other than the block polyester is used in combination with the amorphous polyester, the synergistic effect described above obtained by using the block polyester and the amorphous polyester in combination can not be obtained.

The compounding ratio between the block polyester and the amorphous polyester in weight ratio is preferably in the range of 5:95 to 45:55, and more preferably in the range of 10:90 to 30:70. If the compounding ratio of the block polyester is too low, there is a possibility that it is difficult to sufficiently improve the anti-offset property of a resultant toner. On the other hand, if the compounding ratio of the amorphous polyester is too low, there is a possibility that a sufficient fixing property at low temperature and transparency can not be obtained. Further, if the compounding ratio of the amorphous polyester is too low, there is a case that it is difficult to sufficiently improve the cohesiveness (cohesive strength) of the dispersoid 31 at the time when fine particles (droplets 9) of the dispersion liquid 3 are solidified, for example. Furthermore, in a case where the dispersion liquid 3 is prepared using a kneaded material K7, it becomes difficult to efficiently grind the kneaded material K7 so that obtained particles can not have a uniform particle size.

Although the content of the polyester-based resin in the dispersoid 31 is not limited to any specific value, it is preferably in the range of 2 to 98 wt %, and more preferably in the range of 5 to 95 wt %.

In this connection, the resin (binder resin) may contain other components (third resin component) in addition to the above-described block polyester and amorphous polyester.

As for such a resin component (third resin component) other than the block polyester and the amorphous polyester, a monomer or a copolymer of styrene resin that includes styrene or a styrene substitution product, such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-acrylate-methacrylate copolymer, styrene-α-methyl chloroacrylate copolymer, styrene-acrylonitrile-acrylate copolymer, styrene-vinylmethylether copolymer, or the like; polyester resin (which is different from the above-described block polyester and amorphous polyester); epoxy resin; urethane modified epoxy resin; silicone modified epoxy resin; vinyl chloride resin; rosin modified maleic acid resin; phenyl resin; polyethylene; polyprorylene; ionomer resin; polyurethane resin; silicone resin; ketone resin; ethylene-ethyl acrylate copolymer; xylene resin; polyvinyl butyral resin; terpene resin; phenol resin; aliphatic or alicyclic hydrocarbon resin; or the like can be mentioned. These resin components can be used alone or in combination of two or more.

2. Solvent

The dispersoid 31 may contain a solvent which can dissolve at least a part of the components thereof. This makes it possible to improve the fluidity of the dispersoid 31 in the dispersion liquid 3 (droplets 9), for example. Also, it is possible to make the particle size of the particle of the dispersoid 31 in the dispersion liquid 3 relatively small as well as to make a variation in size among the particles of the dispersoid 31 small. As a result, the finally obtained toner particles 4 have small variations in size and shape, and relatively high roundness.

Such a solvent is not limited to any specific one as long as it can dissolve at least a part of the components constituting the dispersoid 31. However, it is preferred that the solvent can be easily eliminated in the solidifying section or the like of the toner manufacturing device as will be described later.

Further, it is preferred that the solvent has low compatibility with the dispersion medium 32 (that is a solvent having a solubility of 30 g or less/100 g of dispersion medium at 25° C., for example). By using such a solvent, it is possible to disperse the dispersoid 31 in the dispersion liquid 3 (droplets 9) in the form of fine particles with stability.

Furthermore, the composition of the solvent can be appropriately determined depending on the composition of the resin described above (compounding ratio between the block polyester and the amorphous polyester, and average molecular weight and constituent monomer of each of the block polyester and the amorphous polyester), the composition of a coloring agent, the composition of the dispersion medium, and the like.

Examples of such a solvent include: inorganic solvents such as water, carbon disulfide, carbon tetrachloride, and the like: and organic solvents such as ketone-based solvents (e.g., methyl ethyl ketone (MEK), acetone, diethyl ketone, methyl isobutyl ketone (MIBK), methyl isopropyl ketone (MIPK), cyclohexanone, 3-heptanone, and 4-heptanone); alcohol-based solvents (e.g., methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, and phenol); ether-based solvents (e.g., diethyl ether, dipropyl ether, diisopropyl ether, dibutyl ether, 1,2-dimethoxyethane (DME), 1,4-dioxane, tetrahydrofuran (THF), tetrahydropyran (THP), anisole, diethylene glycol dimethyl ether (diglyme), and 2-methoxyethanol); cellosolve-based solvents (e.g., methyl cellosolve, ethyl cellosolve, and phenyl cellosolve); aliphatic hydrocarbon-based solvents (e.g., hexane, pentane, heptane, cyclohexane, methylcyclohexane, octane, didecane, methylcyclohexene, and isoprene); aromatic hydrocarbon-based solvents (e.g., toluene, xylene, benzene, ethylbenzene, and naphthalene);

aromatic heterocyclic compound-based solvents (e.g., pyridine, pyrazine, furan, pyrrole, thiophene, 2-methyl pyridine, 3-methyl pyridine, 4-methyl pyridine, and furfuryl alcohol); amide-based solvents (e.g., N,N-dimethyl formamide (DMF), and N,N-dimethyl acetamide (DMA)); halogenated compound-based solvents (e.g., dichloromethane, chloroform, 1,2-dichloroethane, trichloroethylene, and chlorobenzene); ester-based solvents (e.g., acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate, and ethyl benzoate); amine-based solvents (e.g., trimethylamine, hexylamine, triethylamine, and aniline); nitrile-based solvents (e.g., acrylonitrile, and acetonitrile); nitro-based solvents (e.g., nitromethane, and nitroethane); aldehyde-based solvents (e.g., acetaldehyde, propionaldehyde, butyraldehyde, pentanal, and acrylaldehyde); and the like. These solvents can be used singly or in combination of two or more.

Among these solvents, it is preferred that the solvent to be used in the present invention contains an organic solvent, and it is more preferred that the solvent contains one or two or more of solvents selected from the group containing ether-based solvents, cellosolve-based solvents, aliphatic hydrocarbon-based solvents, aromatic hydrocarbon-based solvents, aromatic heterocyclic compound-based solvents, amide-based solvents, halogenated compound-based solvents, ester-based solvents, amine-based solvents, nitrile-based solvents, nitro-based solvents, and aldehyde-based solvents. By using such a solvent, it is possible to homogeneously disperse the various components described above in the dispersoid 31 with relative ease.

Further, in general, the dispersion liquid 3 contains a coloring agent. As for the coloring agent, pigments, dyes, or the like can be used. Examples of such pigments and dyes include Carbon Black, Spirit Black, Lamp Black (C.I. No.77266), Magnetite, Titanium Black, Chrome Yellow, Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Waching Red Calcium Salt, Eosine Lake, Brilliant Carmine 3B, Manganese Violet, Fast Violet B, Methyl violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162 and Nigrosine Dye (C.I. No. 50415B); metal oxides such as metal complex dye, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co and Ni; and the like. These pigments and dyes can be used singly or in combination of two or more. In general, in the dispersion liquid 3 (droplets 9), such a coloring agent is contained in the dispersoid 31.

The content of the coloring agent in the dispersion liquid 3 is not limited to any specific value, but it is preferably in the range of 0.1 to 10 wt %, and more preferably in the range of 0.3 to 3.0 wt %. If the content of the coloring agent is less than the above lower limit value, there is a possibility that it is difficult to form a visible image having a sufficient density depending on the kind of the coloring agent. On the other hand, if the content of the coloring agent exceeds the above upper limit value, there is a possibility that the fixing property or the charging properties of a resultant toner (that is, a toner finally obtained) is lowered.

Further, the dispersion liquid 3 may contain a wax. In general, a wax is used for the purpose of improving releasability.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Among these waxes, in a case where an ester wax (carnauba wax, rice wax or the like, for example) is used, the following effect can be obtained particularly.

Since such an ester wax has the ester structure in its molecule as is the same with the above-mentioned polyester-based resin, the ester wax has excellent compatibility with the polyester-based resin. For this reason, it is possible to prevent generation of liberated wax and formation of lumps of wax in a resultant toner particles (that is, it is possible to easily achieve fine dispersion or micro-phase separation of wax in a resultant toner). As a result, the resultant toner can have especially excellent releasability from a fixing roller.

The melting point $T_m$ of the wax is not limited to any specific value, but it is preferably in the range of 30 to 160° C., and more preferably in the range of 50 to 100° C. In this connection, the melting point $T_m$ and heat of fusion of the wax can be measured, for example, according to differential scanning calorimetry (DSC) under the condition that the wax is heated to 200° C. at a temperature rise rate of 10° C./min, cooled at a temperature drop rate of 10° C./min, and then again heated at a temperature rise rate of 10° C./min.

Further, polyester having a low melting point (hereinafter, also referred to as a "low-melting point polyester") can also be used as a component which can impart an effect that is the same as the effect obtained by the wax, for example. It is preferred that such a low-melting point polyester has a melting point in the range of about 70 to 90° C. Further, it is preferred that the weight average molecular weight Mw of such a low-melting point polyester is in the range of about 3,500 to 6,500. Furthermore, the low-melting point polyester is preferably a polymer composed of an aliphatic monomer. When the low-melting point polyester satisfy the above conditions (at least one condition, and preferably two or more conditions), it is possible to make compatibility with the above-described polyester-based resin especially excellent as well as to impart releasability to an obtained toner without lowering the durability of the toner. Moreover, since the low-melting point polyester has a relatively low melting point, the obtained toner can have an improved fixing property at low temperature.

The content of the wax in the dispersion liquid 3 is not limited to any specific value, but it is preferably 1.0 wt % or less, and more preferably 0.5 wt % or less. If the content of the wax is too high, liberated wax is generated and lumps of the wax are formed in a resultant toner (toner particles), and thereby conspicuous exudation of the wax to the surface of the toner particles or the like occurs, thus resulting in a case that the transfer efficiency of the toner tends to lower.

Further, the dispersion liquid 3 may contain a component other than the components described above. As for such a component, an emulsifying and dispersing agent, a charge control agent, a magnetic powder, and the like can be mentioned. Among them, in a case where the dispersion liquid 3 contains the emulsifying and dispersing agent, it becomes possible to improve dispersibility of the dispersoid 31 in the dispersion liquid 3 (droplets 9), for example. In this connection, examples of such an emulsifying and dispersing agent include an emulsifier, a dispersant, a dispersion aid, and the like.

Examples of the dispersant include: inorganic dispersants such as tricalcium phosphate; nonionic organic dispersants such as polyvinyl alcohol, carboxymethyl cellulose and polyethylene glycol; anionic organic dispersants such as metal tristearate (e.g., aluminum salt), metal distearate (e.g., aluminum salt or barium salt), metal stearate (e.g., calcium salt, lead salt or zinc salt), metal linolenate (e.g., cobalt salt, manganese salt, lead salt or zinc salt), metal octanoate (e.g., aluminum salt, calcium salt or cobalt salt), metal oleate (e.g., calcium salt or cobalt salt), metal palmitate (e.g., zinc salt), metal naphthenate (e.g., calcium salt, cobalt salt, manganese salt, lead salt or zinc salt), metal resinate (calcium salt, cobalt salt, manganese salt, lead salt or zinc salt), metal polyacrylate (e.g., sodium salt), metal polymethacrylate (e.g., sodium salt), metal polymaleate (e.g., sodium salt), metal salt of an acrylic acid-maleic acid copolymer (e.g., sodium salt), and metal polystyrene sulfonate (e.g., sodium salt); and cationic organic dispersants such as quaternary ammonium salt. Among these dispersants, nonionic organic dispersants or anionic organic dispersants are particularly preferable.

The content of the dispersant in the dispersion liquid 3 is not limited to any specific value, but it is preferably 3.0 wt % or less, and more preferably in the range of 0.01 to 1.0 wt %.

Examples of the dispersion aid include anionic surfactants, cationic surfactants, and nonionic surfactants.

The dispersion aid is preferably used with the dispersant. In a case where the dispersion liquid 3 contains the dispersant, the content of the dispersion aid is not limited to any specific value, but it is preferably 2.0 wt % or less, and more preferably in the range of 0.005 to 0.5 wt %.

Examples of the charge control agent include a metal salt of benzoic acid, a metallic salt of salicylic acid, a metallic salt of alkylsaliicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, a material other than the above-mentioned materials, such as zinc stearate, zinc oxide, cerium oxide or the like may be added to the dispersion liquid 3.

Furthermore, a component other than the dispersoid 31 may be dispersed as an insoluble content in the dispersion liquid 3. For example, in the dispersion liquid 3, inorganic fine powder made of silica, titanium oxide, or iron oxide and/or organic fine powder made of fatty acid or metallic salt of fatty acid may be dispersed.

In the dispersion liquid 3, the dispersoid 31 is dispersed in the dispersion medium 32 in the form of fine particles. The average particle size of the particle of the dispersoid 31 in the dispersion liquid 3 is not limited to any specific value, but it is preferably in the range of 0.05 to 10 μm, and more preferably in the range of 0.1 to 1.0 μm. When the average particle size of the particle of the dispersant 31 lies in the above range, the finally obtained toner particles 4 can have sufficiently high roundness, and highly uniform properties and shape.

The content of the dispersoid 31 in the dispersion liquid 3 is not limited to any specific value, but it is preferably in the range of 1 to 99 wt %, and more preferably in the range of 5 to 95 wt %. If the content of the dispersoid 31 is less than the above lower limit value, the roundness of the toner particle 4 finally obtained tends to lower. On the other hand, if the content of the dispersoid 31 exceeds the above upper limit value, the viscosity of the dispersion liquid 3 increases depending on the composition of the dispersion medium 32 so that variations in shape and size among the toner particles 4 finally obtained tend to be great.

The dispersoid 31 dispersed in the dispersion medium 32 may have different compositions among individual particles thereof, but it is preferred that the dispersoid 31 has substantially the same composition among individual particles thereof. In a case where the dispersoid 31 has different compositions among individual particles thereof, the dispersion liquid 3 may contain as the dispersoid 31 particles mainly composed of a resin material and particles mainly composed of a wax, for example.

It is preferred that such a dispersion liquid 3 is a suspension, that is it is preferred that the dispersoid 31 is a solid. When the dispersion liquid 3 is a suspension, the dispersion medium is effectively prevented from being remained in the dispersoid (inside of toner particles). As a result, storage stability of a resultant toner is improved, and further, disagreeable odor can be prevented from being generated after the toner is fixed.

Further, when the average particle size of the particle of the dispersoid 31 in the dispersion liquid 3 is defined as Dm (μm) and the average particle size of the toner particle 4 is defined as Dt (μm), it is preferred that Dm and Dt satisfy the relation $0.005 \leqq Dm/Dt \leqq 0.5$, and it is more preferred that they satisfy the relation $0.01 \leqq Dm/Dt \leqq 0.2$. When such a relation is satisfied, a toner having especially small variation in shape and size among individual particles thereof can be obtained.

In the meantime, when the conventional kneading and grinding method is used, even if kneading time and kneading strength are optimized, there is a limit in improvement of homogeneity (dispersibility) among components in a toner. In particular, in a case where different two or more kinds of resin components are included, homogeneity of components in a resultant toner becomes particularly low.

On the other hand, the present invention has a feature in that a toner is manufactured by jetting the dispersion liquid in the form of droplets (fine particles) and then solidifying them. This makes it possible to obtain a toner in which various components are sufficiently and homogeneously soluble or dispersed with each other.

Such a dispersion liquid 3 as described above can be prepared as follows, for example.

First, water or a liquid having high compatibility with water is prepared. When necessary, a dispersant and/or a dispersion medium may be added thereto to prepare an aqueous solution.

Then, a resin solution containing a resin or its precursor (hereinafter, generically referred to as a "resin material") as a main component of a toner is prepared. In this connection, the resin solution may contain the solvent described above in addition to the resin material, for example. Further, the resin solution may be a liquid obtained by melting the resin material.

Next, the resin solution is added drop by drop to the aqueous solution under stirring, thereby enabling to obtain a dispersion liquid 3 in which a dispersoid 31 containing the resin material is dispersed in an aqueous dispersion medium 32. By preparing a dispersion liquid 3 in such a manner, it is possible for the particles of the dispersoid 31 in the dispersion liquid 3 (droplets 9) to have higher roundness. As a result, obtained toner particles 4 can have sufficiently high roundness, and an especially small variation in shape. In this connection, the aqueous solution and/or the resin solution may be heated during dropping of the resin solution. Further, in a case where a solvent is used for preparing the resin solution, at least a part of the solvent contained in the dispersoid 31 may be eliminated by, for example, heating the obtained dispersion liquid 3 or setting the obtained dispersion liquid 3 under a reduced pressure atmosphere, after dropping of the resin solution is completed.

Although one example of a method for preparing a dispersion liquid 3 has been described, the dispersion liquid to be used in the present invention is not limited to one prepared by such a method. For example, the dispersion liquid 3 can also be prepared by a method as will be described below.

First, water or a liquid having high compatibility with water is prepared. When necessary, a dispersant and/or a dispersion medium may be added thereto to prepare an aqueous solution.

Then, a powdery or particulate material containing the resin material is prepared.

Next, the powdery or particulate material is added little by little to the aqueous solution under stirring, thereby enabling to obtain a dispersion liquid 3 in which a dispersoid 31 containing the resin material is dispersed in the aqueous dispersion medium 32. In a case where a dispersion liquid 3 is prepared by such a method, it is possible to substantially prevent the volatilization of an organic solvent in the solidifying section or the like of the toner manufacturing device as will be described later. As a result, a toner can be manufactured in such a manner that an adverse effect is hardly given to the environment. In this connection, the aqueous solution may be heated during addition of the powdery or particulate material, for example.

Further, the dispersion liquid 3 can also be prepared by a method as will be described later.

First, a dispersion liquid of resin in which at least the resin material is dispersed, and a dispersion liquid of coloring agent in which at least a coloring agent is dispersed are prepared.

Next, the dispersion liquid of resin and the dispersion liquid of coloring agent are mixed and stirred. At this time, a flocculant such as an inorganic metal salt may be added under stirring, as required. By stirring the mixture for a predetermined period of time, the resin material and the coloring agent are agglomerated so that agglomerations having appropriate sizes are formed. As a result, a dispersion liquid 3 in which the agglomerations are dispersed as the dispersoid 31 can be obtained.

Further, the dispersion liquid 3 can also be prepared by, for example, using a kneaded material K7 obtained by kneading a material K5 containing at least a part of the above-described constituent materials of the toner (resin, coloring agent, wax, charge control agent, magnetic powder and the like, for example). For example, the kneaded material K7 may be used as the above-described resin solution, powdery or particulate material or dispersion liquid of resin. By preparing a dispersion liquid 3 using the kneaded material K7, it is possible to make dispersibility of the dispersoid 31 in the dispersion liquid 3 (droplets 9) especially excellent. Therefore, variations in composition and properties among individual toner particles of a finally obtained toner become small. As a result, the finally obtained toner can have especially excellent properties as a whole.

Hereinbelow, a description will be made with regard to a method for obtaining a kneaded material K7 by the use of a material K5 containing at least a part of the constituent materials of the toner.

For example, the kneaded material 7 can be manufactured using the device shown in FIG. 1.

<Kneading Process>

The material K5 to be kneaded is prepared in advance by mixing the above-mentioned various components.

In this embodiment, a twin screw extruder (kneader) is used as a kneading machine, a detail of which will be described below.

The kneading machine K1 includes a process section K2 which kneads the material K5 while conveying it, a head section K3 which extrudes a kneaded material K7 so that an extruded kneaded material can have a prescribed cross-sectional shape, and a feeder K4 which supplies the material K5 into the process section K2.

The process section K2, has a barrel K21, screws K22 and K23 inserted into the barrel K21, and a fixing member K24 for fixing the head section K3 to the front portion of the barrel K21.

In the process section K2, a shearing force is applied to the material K5 supplied from the feeder K4, through the rotation of the screws K22 and K23, so that a homogeneous kneaded material K7, that is, a kneaded material K7 in which the block polyester and the amorphous polyester are sufficiently soluble with each other is obtained.

In this embodiment, it is preferred that the total length of the process section K2 is in the range of 50 to 300 cm, and more preferably in the range of 100 to 250 cm. If the total length of the process section K2 is less than the above lower limit value, there is a case that it is difficult to make the block polyester and the amorphous polyester sufficiently soluble with each other. On the other hand, if the total length of the process section K2 exceeds the above upper limit value, there is a case that thermal modification of the material K5 is likely to occur depending on the temperature inside the process section K2, or the number of revolutions of the screws K22 and K23, or the like, thus leading to a possibility that it becomes difficult to sufficiently control the physical properties of a resultant toner (that is, a toner finally obtained).

Further, the process section K2 has a first region K25 with a prescribed length in its longitudinal direction, and a second region K26 located on the side closer to the head section K3 than the first region K25. Namely, the material K5 is sent into the second region K26 after passing through the first region K25.

The internal temperature of the first region K25 is set higher than that of the second region K26. In other words, the material K5 being conveyed in the interior of the process section K2 is subjected to a higher temperature as it passes through the first region K25 than the temperature as it passes through the second region K26.

As described above, by kneading the material K5 at a relatively high temperature in the first region K25, the block polyester and the amorphous polyester are made sufficiently soluble with each other.

In this connection, when the temperature of the material K5 in the first region K25 (that is, the internal temperature of the first region K25) is defined as $T_1$ (° C.) and the melting point of the block polyester is defined as $T_m$ (B) (° C.), it is preferred that $T_1$ and $T_m$ (B) satisfy the relation $T_m(B) \leqq T_1$, and it is more preferred that they satisfy the relation $(T_m(B)+10° C.) \leqq T_1 \leqq (T_m(B)+60° C.)$. If the material temperature $T_1$ is lower than $T_m$ (B) (° C.), there is a case that it is difficult to make the block polyester and the amorphous polyester sufficiently soluble with each other.

Although the specific value of the material temperature $T_1$ within the first region K25 varies depending on the composition of the resin, or the like, the material temperature $T_1$ within the first region K25 is preferably in the range of 190 to 300° C., and more preferably in the range of 200 to 250° C.

Moreover, the material temperature $T_1$ may be uniform within the first region K25 or different at various sites within the first region K25. In a case where the material temperature $T_1$ is different at various sites, it is preferred that the maximum temperature of the material K5 within the first region K25 is higher than the lower limit value described in the above, and it is more preferred that the lowest and highest temperatures of the material K5 within the first region K25 lie in the above range.

Moreover, it is preferred that the residence time of the material K5 in the first region K25 (that is, the time required for the material K5 to pass through the first region K25) is 0.5 to 12 minutes, and more preferably 0.5 to 7 minutes. If the residence time of the material K5 in the first region K25 is less than the above lower limit value, there is a case that it is difficult to make the block polyester and the amorphous polyester sufficiently soluble with each other. On the other hand, if the residence time of the material K5 in the first region K25 exceeds the above upper limit value, production efficiency is lowered, and thermal modification of the material K5 is likely to occur depending on the temperature inside the process section K2, or the number of revolutions of the screws K22 and K23, or the like, thus giving rise to a possibility that it is difficult to sufficiently control the physical properties of a resultant toner.

Moreover, it is preferred that the length of the first region K25 is in the range of 10 to 200 cm, and more preferably in the range of 20 to 150 cm. If the length of the first region K25 is less than the above lower limit value, there is a case that it is difficult to make the block polyester and the amorphous polyester sufficiently soluble with each other. On the other hand, if the length of the first region K25 exceeds the above upper limit value, production efficiency is lowered, and thermal modification of the material K5 is likely to occur depending on the temperature inside the process section K2, or the number of revolutions of the screws K22 and K23, or the like, thus giving rise to a possibility that it is difficult to sufficiently control the physical properties of a resultant toner.

As described above, in the first region K25, the block polyester and the amorphous polyester are made sufficiently soluble with each other by carrying out kneading at a relatively high temperature. However, since the block polyester and the amorphous polyester are resins having substantially different molecular structures, even after the block polyester and the amorphous polyester are made sufficiently soluble with each other, there is a possibility that phase separation may occur between the block polyester and the amorphous polyester depending on conditions upon cooling of a kneaded material, or the like.

For this reason, in this embodiment, the second region K26 is provided in order to knead the material K5 at a temperature relatively lower than that of the first region K25, as shown in the drawing. By providing the second region K26, it is possible to effectively prevent poor dispersion of various components of the kneaded material K7 and phase separation from occurring. Moreover, even in a case where the material K5 contains a wax (in particular, a wax which has poor compatibility with the resin), by providing the second region K26, it is possible to make the wax finely dispersed in the kneaded material K7 so that the dispersed wax (in a particle form) can have an appropriate particle size (that is, bulk formation of the wax is prevented). As a result, lowering in the grindability of an obtained kneaded material K7 is effectively suppressed, and dispersibility of the dispersoid 31 in the dispersion liquid 3 (droplets 9) becomes especially excellent. Further, in a resultant toner, deterioration in transparency and durability and the occurrence of offset are also suppressed. Furthermore, since various components of the kneaded material K7 are homogeneously dispersed in the resultant toner, a variation in properties among individual particles of the toner is small, so that the toner can have excellent properties as a whole. Accordingly, the effect of each component can be exhibited sufficiently.

Moreover, by providing the first region K25 and the second region K26 as described above, crystallization of the block polyester can be made to proceed efficiently while satisfactorily preventing the occurrence of phase separation in the second region K26, so that a resultant toner can have high mechanical strength (that is high resistance to mechanical stress).

When the temperature of the material K5 in the second region K26 (that is the internal temperature of the second region K26) is defined as $T_2$ (° C.) and the softening point of the amorphous polyester is defined as $T_{1/2}$ (A) (° C.), it is preferred that $T_2$ and $T_{1/2}$ (A) satisfy the relation $(T_{1/2}(A)-20) \leqq T_2 \leqq (T_{1/2}(A)+20)$, and it is more preferred that they satisfy the relation $(T_{1/2}(A)-10) \leqq T_2 \leqq (T_{1/2}(A)+10)$. If the material temperature $T_2$ is less than the above lower limit value, phase separation or the like in the kneaded material K7 is likely to occur, and there is a case that the fluidity of the block polyester and the amorphous polyester is lowered so that the productivity of a toner is lowered. On the other hand, if the material temperature $T_2$ exceeds the above upper limit value, there is a case that the effect obtained by providing the second region K26 can not be sufficiently obtained.

Although the specific value of the material temperature $T_2$ within the second region K26 varies depending on the composition of the resin, the material temperature $T_2$ within the second region K26 is preferably in the range of 80 to 150° C., and more preferably 90 to 140° C.

Moreover, the material temperature $T_2$ may be uniform within the second region K26 or different at various sites within the second region K26. In a case where the material temperature $T_2$ is different at various sites, it is preferable that the minimum temperature of the material K5 within the second region K26 lies in the above range.

In the structure shown in the drawing, a temperature transition region K28 in which the material temperature changes from $T_1$ to $T_2$ is provided between the first region K25 and the second region K26.

Moreover, it is preferred that the residence time of the material K5 in the second region K26 is 0.5 to 12 minutes, and more preferably 1 to 7 minutes. If the residence time of the material K5 in the second region 26 is less than the above lower limit value, there is a case that the effect obtained by providing the second region K26 can not be sufficiently obtained. On the other hand, if the residence time of the material K5 in the second region K26 exceeds the above upper limit value, production efficiency is lowered, and thermal modification of the material K5 is likely to occur depending on the temperature inside the process section K2 or the number of revolutions of the screws K22 and K23, or the like, thus resulting in a case that it is difficult to satisfactorily control the physical properties of a resultant toner.

Moreover, it is preferred that the length of the second region K26 is in the range of 20 to 200 cm, and more preferably in the range of 40 to 150 cm. If the length of the second region K26 is less than the above lower limit value, there is a case that the effect obtained by providing the second region K26 can not be sufficiently obtained. On the other hand, if the length of the second region K26 exceeds the above upper limit value, production efficiency is lowered, and thermal modification of the material K5 is likely to occur depending on the temperature inside the process section K2, or the number of revolutions of the screws K22 and K23, or the like, thus resulting in a case that it is difficult to satisfactorily control the physical properties of a resultant toner.

Moreover, it is preferred that the material temperature $T_1$ within the first region K25 and the material temperature $T_2$ within the second region K26 satisfy the relation $(T_1-T_2) \leqq 80$ (° C.), and it is more preferred that they satisfy the relation $80 \leqq (T_1-T_2) \leqq 160$ (° C.). If $(T_1-T_2)$ is less than the above lower limit value, there is a case that it is difficult to sufficiently prevent or suppress phase separation in the cooling process which will be described later.

Although the number of revolutions of the screws K22 and K23 varies depending on the compounding ratio between the block polyester and the amorphous polyester, compositions and molecular weights of the block polyester and the amorphous polyester, and the like, 50 to 600 rpm is preferable. If the number of revolutions of the screws K22 and K23 is less than the above lower limit value, there is a case that it is difficult to make the block polyester and the amorphous polyester sufficiently soluble with each other in the first region K25. Further, there is a case that it is difficult to sufficiently prevent phase separation from occurring in the second region K26. On the other hand, if the number of revolutions of the screws K22 and K23 exceeds the above upper limit value, there is a case that polyester molecules are cut due to a shearing force, thus resulting in the deterioration of the characteristics of the resin.

Moreover, in the structure shown in the drawing, a third region K27 which is different from the first region K25 and the second region K26 is provided on the, side closer to the feeder K4 than the first region K25 (on the side opposite to the second region K26). In this regard, it is to be noted that the process section K2 may have a region other than the first region K25 and the second region K26 as needed.

When the temperature of the material K5 within the third region K27 is defined as $T_3$ (° C.), it is preferred that $T_3$ and the material temperature $T_2$ within the second region K26 satisfy the relation $(T_2-40) \leqq T_3 \leqq (T_2+40)$, and it is more preferred that they satisfy the relation $(T_2-20) \leqq T_3 \leqq (T_2+20)$. If the material temperature $T_3$ is less than the above lower limit value, there is a case that the resin is hard to be melted, thus resulting in a case that a kneading torque becomes too high. On the other hand, if the material temperature $T_3$ exceeds the above upper limit value, there is a case that the temperature at a material throw-in port elevates to thereby heat the feeder K4, so that the resin is melted and adhered to the feeder K4.

In the structure illustrated in the drawing, a temperature transition region K29 where the material temperature changes from $T_3$ to $T_1$ is provided between the third region K27 and the first region K25.

In the foregoing, the description has been made with regard to the structure in which the first region K25, the second region K26 and the third region K27 are provided. However, the present invention is not limited thereto, and another region may be provided in addition to these regions mentioned above. For example, such another region may be provided between the first region K25 and the second region K26, or may be provided on the side closer to the head section K3 than the second region K26.

<Extrusion Process>

The kneaded material K7 which has been kneaded in the process section K2 is extruded to the outside of the kneading machine K1 via the head section K3 by the rotation of the screws K22 and K23.

The head section K3 has an internal space K31 to which the kneaded material K7 is sent from the process section K2, and an extrusion port K32 through which the kneaded material K7 is extruded.

In this connection, it is preferred that the temperature (temperature at least in the vicinity of the extrusion port K32) $T_4$ (° C.) of the kneaded material K7 in the internal space K31 is higher than $T_2$ by about 10° C. When the temperature $T_4$ Of the kneaded material K7 is such a temperature, the kneaded material K7 will not solidify in the internal space 31, and the extrusion of the kneaded material from the extrusion port K32 is facilitated.

In the configuration illustrated, the internal space K31 has a sectional area gradually decreasing part K33 in which its sectional area gradually decreases toward the extrusion port K32.

By providing such a sectional area gradually decreasing part K33, the amount of the kneaded material K7 extruded from the extrusion port K32 is stabilized, and a cooling rate of the kneaded material K7 in the cooling process (which will be described later) is stabilized. As a result, in a toner manufactured by using this machine, a variation in properties is small among individual particles, so that the toner has excellent properties as a whole.

<Cooling Process>

The kneaded material K7 in a softened state extruded from the extrusion port K32 of the head section K3 is cooled by a cooling machine K6 and is solidified.

The cooling machine K6 has rolls K61, K62, K63 and K64, and belts K65 and K66.

The belt K65 is wound around the rolls K61 and K62, and similarly, the belt K66 is wound around the rolls K63 and K64.

The rolls K61, K62, K63 and K64 rotate in directions shown by the arrows e, f, g and h in the drawing about rotary shafts K611, K621, K631 and K641, respectively. With this arrangement, the kneaded material K7 extruded from the extrusion port K32 of the kneading machine K1 is introduced into the space between the belts K65 and K66. The kneaded material K7 is then cooled while being molded into a plate-like object with a nearly uniform thickness, and is ejected from an ejection part K67. The belts K65 and K66 are cooled by, for example, an air cooling or water cooling method. By using such a belt type cooling machine, it is possible to extend a contact time between the kneaded material extruded from the kneading machine and the cooling members (belts), thereby enabling the cooling efficiency for the kneaded material to be especially excellent.

Now, during the kneading process, since the material K5 is subjected to a shearing force, phase separation can be prevented. However, since the kneaded material K7 which went through the kneading process is free from a shearing force, there is a possibility that phase will occur again if such a kneaded material is being left standing for a long period of time. Accordingly, it is preferable to cool the thus obtained kneaded material K7 as quickly as possible. More specifically, it is preferred that the cooling rate (for example, the cooling rate when the kneaded material K7 is cooled down to about 60° C.) of the kneaded material K7 is faster than −3° C./s, and more preferably in the range of −5 to −100° C./s. Moreover, the time between the completion of the kneading process (at which a shearing force is eliminated) and the completion of the cooling process (time required to decrease the temperature of the kneaded material K7 to 60° C. or lower, for example) is preferably 20 seconds or less, and more preferably 3 to 12 seconds.

In the above embodiment, a description has been made in terms of an example using a continuous twin screw extruder as the kneading machine, but the kneading machine used for kneading the material is not limited to this type. For kneading the material, it is possible to use various kinds of kneading machines, for example, a kneader, a batch type triaxial roll, a continuous biaxial roll, a wheel mixer, a blade mixer, or the like.

Further, although a kneading machine with two screws is used in the embodiment shown in the drawing, the number of screws may be one or three or more. The kneading machine may have a disc part (kneading disc).

Furthermore, in the embodiment described above, one kneading machine is used for kneading the material, but kneading may be carried out by using two kneading machines. In this case, the process section of one kneading machine may be used as the first region K25, and the process section of the other kneading machine may be used as the second region K26.

Moreover, in the above embodiment, the belt type cooling machine is used, but a roll type (cooling roll type) cooling machine, for example, may be used. Furthermore, cooling of the kneaded material extruded from the extrusion port K32 of the kneading machine is not limited to the way using the cooling machine described above, and it may be carried out by air cooling, for example.

<Grinding Process>

Next, the kneaded material K7 which has been subjected to the cooling process is ground. By grinding the kneaded material K7, it is possible to make dispersibility of the dispersoid 31 in the dispersion liquid 3 (droplets 9) especially excellent. Therefore, in a finally obtained toner, a variation in composition and properties among individual particles can be made small. As a result, the properties of the toner as a whole becomes especially excellent.

The method of grinding is not particularly limited. For example, such grinding may be carried out by employing various kinds of grinding machines or crushing machines such as a ball mill, a vibration mill, a jet mill, a pin mill, or the like.

The grinding process may be carried out by dividing it into a plurality of stages (for example, two stages of coarse and fine grinding processes).

Further, following such a grinding process, processing such as classification may be carried out, as needed.

Such classification processing may be carried out by using a sieve, an air classifier, or the like.

Now, a description will be made with regard to a preferred embodiment of a device for use in manufacturing toner particles using the above-described dispersion liquid 3 (hereinafter, simply referred to as a "toner manufacturing device M1").

<Toner Manufacturing Device>

As shown in FIG. 4, the toner manufacturing device M1 comprises nozzles M2 for jetting the dispersion liquid 3 (droplets 9) described above, a dispersion liquid feeder M4 for supplying the dispersion liquid 3 into the nozzles M2, a solidifying section M3 for conveying the dispersion liquid 3 (droplets 9) in the form of droplets (fine particles) jetted from the nozzles M2, and a collecting section M5 for collecting manufactured toner particles 4.

The dispersion liquid feeder M4 is not particularly limited as long as it has the function of supplying the dispersion liquid 3 into the nozzles M2. For example, as shown in FIG. 4, the dispersion liquid feeder M4 may have a stirring means M41 for stirring the dispersion liquid 3. By providing such a stirring means, it is possible to supply the dispersion liquid 3, in which the dispersoid 31 is sufficiently homogeneously dispersed in the dispersion medium, into the nozzles M2, even in a case where the dispersoid 31 is hard to be dispersed in the dispersion medium.

The nozzle M2 has the function of jetting the dispersion liquid 3 in the form of fine droplets (fine particles), a detailed description of which will be made later.

Further, as shown in FIG. 4, the toner manufacturing device M1 comprises a gas flow supplying means M10. A gas supplied from the gas flow supplying means M10 is fed into the nozzles M2 through a duct M101, and the gas is utilized for jetting the dispersion liquid 3 (droplets 9) from the nozzles M2 (which will be described later in detail).

The gas flow supplying means M10 is provided with a valve M11. By providing the valve M11, it is possible to adjust a pressure of the gas to be utilized for jetting the dispersion liquid 3 (droplets 9).

The toner manufacturing device M1 having the structure shown in FIG. 4 has the plurality of nozzles M2. From each of the nozzles M2, fine droplets 9 are jetted into the solidifying section M3.

Although all of the nozzles M2 may jet the droplets 9 at substantially the same time, it is preferred that at least two nozzles adjacent to each other are controlled so as to jet the droplets 9 at different times. By doing so, it is possible to effectively prevent a collision among the droplets 9 jetted from the adjacent nozzles M2, otherwise agglomeration of the droplets 9 may occur before the droplets 9 are solidified.

The droplets (fine particles) 9 jetted from the nozzles M2 are solidified while being conveyed in the solidifying section M3, to thereby obtain toner particles 4.

In this connection, it is to be noted that the toner particle 4 is obtained through the elimination of the dispersion medium 32 from the jetted droplet 9. Specifically, when the dispersion medium 32 is eliminated from the jetted droplet 9, particles of the dispersoid 31 contained in the droplet 9 are agglomerated, and as a result, agglomerated particles of the dispersoid 31 are obtained as a toner particle 4. In a case where the dispersoid 31 contains a solvent as described above, the solvent may be eliminated, for example, in the solidifying section M3, or upon jetting of the dispersion liquid 3 from the nozzle M2 (which will be described later).

The solidifying section M3 is constructed from a housing M31. It is preferred that the temperature in the housing M31 is kept within a predetermined range during manufacturing of a toner. This makes a variation in properties among the individual toner particles 4 caused by the difference in manufacturing conditions small. As a result, reliability of the obtained toner as a whole is improved.

For the sake of keeping the temperature in the housing M31 within a predetermined range, the housing M31 may be provided with a heat source or a cooling source inside or outside, or the housing M31 may be coated with a jacket having a path for a heat medium or a cooling medium, for example.

Further, in the toner manufacturing device M1 having the structure shown in FIG. 4, a pressure in the housing M31 is adjusted by a pressure control means M12. By adjusting a pressure in the hosing M31, it is possible to efficiently eliminate the dispersion medium 32 contained in the jetted droplets 9, thereby improving productivity of a toner. In this connection, in the toner manufacturing device M1 having the structure shown in FIG. 4, the pressure control means M12 is connected to the housing M31 through a connection tube M121. Further, the connecting tube M121 has a diameter widening part M122 (that is a part in which the inner diameter is widened) and a filter M123 for preventing intake of the toner particles 4 or the like, in the vicinity of the end portion thereof. That is, the connecting tube M121 is connected to the housing M31 through the diameter widening part M122 and the filter M123.

Although the pressure in the housing M31 is not limited to any specific value, it is preferably 0.15 MPa or less, more preferably in the range of 0.005 to 0.15 MPa, and even more preferably in the range of 0.109 to 0.110 MPa.

In general, the particle size of the particle of the dispersoid 31 contained in the dispersion liquid 3 (droplets 9) is sufficiently small as compared with the obtained toner particle 4. Therefore, the toner particle 4 obtained as an agglomeration of the particles of the dispersoid 31 can have sufficiently high roundness.

In a case where the toner particle 4 is obtained through the elimination of the dispersion medium 32, the size of the obtained toner particle 4 becomes smaller as compared with the size of the droplet 9 jetted from the nozzle M2. For this reason, even in a case where the size of the droplet of the dispersion liquid jetted from the nozzle M2 (jetting port) is relatively large, the size of the obtained toner particle 4 can be made relatively small. Therefore, in the present invention, it is possible to easily obtain toner particles 4 having a particularly small average particle size.

Further, in the present invention, as will be described later in detail, the size of the droplet 9 jetted from the nozzle M2 can also be made sufficiently small, and a particle size distribution of the droplets 9 can be made sufficiently sharp. As a result, it is possible to obtain toner particles 4 having a small variation in particle size, that is, it is possible to obtain toner particles 4 having a sharp particle size distribution.

In the present invention, since the dispersion liquid is used as a liquid to be jetted, even in a case where the particle size of the obtained toner particles 4 is sufficiently small, the toner particles 4 can have sufficiently high roundness and a sharp particle size distribution. Therefore, the obtained toner is uniformly charged among individual particles thereof. Further, when such a toner is used for printing, a leveled and high-density thin layer of the toner is formed on a development roller. As a result, defects such as fog and the like hardly occur, thereby enabling to form a sharper image. Furthermore, since the toner particles 4 have uniform shape and particle size, the bulk density of the toner as a whole (an aggregate of toner particles 4) becomes large. This makes it possible to fill a larger amount of the toner in a cartridge as compared with a case where a conventional toner is filled in the same cartridge. Also, it is possible to make a cartridge smaller in size.

In the above description, the toner particle 4 is obtained by the agglomeration of the particles of the dispersoid 31 contained in the droplet 9 through the elimination of the dispersion medium 32 from the dispersion liquid 3 (droplet 9) in the solidifying section M3. However, a method for obtaining toner particles is not limited thereto. For example, in a case where the dispersoid 31 contains the precursor of the resin material (monomer, dimer, or oligomer for the resin material, for example), toner particles may be obtained by allowing to proceed a polymerization reaction in the solidifying section M3.

Further, a voltage application means M8 for applying a voltage is connected to the housing M31. By applying a voltage with polarity that is the same as that of the droplets 9 (toner particles 4) to the inner surface of the housing M31 using the voltage application means M8, the following effects can be obtained.

In general, toner particles are positively or negatively charged. Therefore, if there is a substance charged with polarity opposite to the polarity of the toner, a phenomenon in which the toner particles are electrostatically attracted and then attached to the substance occurs. On the other hand, if there is a substance charged with polarity that is the same as the polarity of the toner particles, the substance and the toner particles repel one another so that a phenomenon in which the toner particles are attached to the surface of the substance can be effectively prevented. For this reason, by applying a voltage with polarity that is the same as the polarity of the droplets 9 (toner particles 4) to the inner surface of the housing M31, it is possible to effectively prevent the droplets 9 (toner particles 4) from being attached to the inner surface of the housing M31. This makes it possible to effectively prevent the formation of deformed toner particles as well as to increase the efficiency of collecting the toner particles 4.

Further, the housing M31 has a diameter decreasing part M311 (that is a part in which the inner diameter is decreased in the downward direction in FIG. 4) in the vicinity of the collecting section M5. By providing such a diameter decreasing part M311, it becomes possible to efficiently collect the toner particles 4. As described above, the droplets 9 jetted from the nozzles M2 are solidified in the solidifying section M3. In this connection, it is to be noted that since the solidification is nearly completely finished in the vicinity of the collecting section M5, a problem such as agglomeration or the like hardly occurs even if the toner particles are made into contact with each other in the vicinity of the diameter decreasing part M311.

The toner particles 4 obtained by solidifying the droplets 9 are collected in the collecting section M5.

Next, a detailed description will be made with regard to the nozzle M2 for use in jetting the dispersion liquid 3 (droplets 9) in the form of particles.

In this embodiment, the dispersion liquid is jetted in the form of fine particles in a unique manner. Specifically, in this embodiment, the dispersion liquid 3 supplied onto an inclined surface 7 is spread into a laminar flow 8 by a gas flow flowing along the inclined surface 7 as shown in FIG. 5. The laminar flow 8 flowing along the inclined surface 7 becomes too thin to keep a layer form (film state) when being released from the inclined surface 7, so that the laminar flow 8 is divided into droplets 9 in the form of fine particles due to surface tension. In particular, in the present invention, since the laminar flow 8 is made from the dispersion liquid, the laminar flow is more easily divided into fine droplets as compared with a case where the laminar flow is made from a homogeneous liquid (a liquid or a solution substantially made of a pure substance, for example). Therefore, in this embodiment, it is possible to effectively jet the dispersion liquid in the form of fine particles. Further, it is also possible to prevent a trailing projection from being formed in the droplet.

In the present invention, as described above, the dispersion liquid 3 is spread into the laminar flow 8 by a gas flow and then jetted in the form of fine particles. Therefore, the present invention has a feature in that the dispersion liquid (droplets) can be jetted in the form of super fine particles having a circular shape. This makes it possible to effectively prevent clogging of a supply orifice 5 for supplying the dispersion liquid 3 as well as to facilitate the processing of the supply orifice 5.

Further, as shown in FIG. 5, the inclined surface 7 is provided with a sharp edge 7A at the tip end thereof. By making an atomizing gas and a spreading gas come into collision with each other at the edge 7A, it is possible to vibrate air (gas) heavily. Such air vibration has the function of dividing the dispersion liquid into finer particles.

Furthermore, since the edge 7A of the inclined surface 7 has an annular shape, the nozzle M2 can jet the dispersion liquid (droplets 9) in the form of fine particles in a hollow cone pattern. When the dispersion liquid is jetted in a hollow cone pattern, the dispersion medium is effectively eliminated from the dispersion liquid (droplets).

As shown in FIG. 5, the nozzle M2 for jetting a liquid in the form of fine particles is provided with the supply orifice 5 for jetting the dispersion liquid (droplets 9) in an annular pattern, the inclined surface 7 on which the dispersion liquid jetted from the supply orifice 5 flows, and a gas outlet 10 for jetting a pressurized gas toward the inclined surface 7.

The nozzle M2 shown in FIG. 5 is further provided with an inner ring (cylinder) 11, an intermediate ring (cylinder) 12, and an outer ring (cylinder) 13. The above-described supply orifice 5 is formed between the inner ring 11 and the intermediate ring 12. Further, an atomizing gas supply path 14 is formed at the center of the inner ring 11, and a spreading gas supply path 15 is formed between the intermediate ring 12 and the outer ring 13.

The external shape of, the inner ring 11 and the internal shape of the intermediate ring 12 are cylindrical. Between the outside of the inner ring 11 and the inside of the intermediate ring 12, there is provided a slit having a predetermined width as the supply orifice 5. The supply orifice 5 has an annular cross-sectional shape, and the width of the slit (supply orifice) is determined such that the supply orifice 5 is not clogged with the dispersion liquid. In the nozzle M2 of this embodiment, there is no necessity for the supply orifice 5 to supply the dispersion liquid in the form of a thin film (thin layer). This is because the dispersion liquid is spread on the inclined surface 7 into a thin film, and then jetted in the form of fine particles (droplets 9). Therefore, the width of the slit (supply orifice 5) is optimally designed in consideration of the quantity of flow of the dispersion liquid to be supplied, the length of the inclined surface 7, the velocity of flow of the atomizing gas to be sent toward the inclined surface 7, the internal diameter of the supply orifice 5, and the like. For example, the width of the slit (supply orifice) is preferably in the range of 0.2 to 1.5 mm, more preferably in the range of 0.4 to 1.0 mm, and optimally about 0.8 mm.

The diameter of the supply orifice 5 is optimally designed in consideration of the quantity of flow of the dispersion liquid to be jetted, the width of the slit, and the like. For example, in a case where the nozzle is designed so that the dispersion liquid (droplets 9) can be jetted at a flow rate of 1,000 g/min, the diameter of the supply orifice 5 is set to about 50 mmϕ. In a case where the quantity of flow of the dispersion liquid to be jetted is larger, the diameter of the supply orifice 5 is also made to be larger. On the other hand, in a case where the quantity of flow of the dispersion liquid to be jetted is smaller, the diameter of the supply orifice 5 is also made to be smaller.

Each of the outer surface of the inner ring 11 and the tip end surface of the intermediate ring 12 is tapered by cutting processing to provide the inclined surface 7. The inclined surface 7 of the inner ring 11 is formed flush with the inclined surface 7 of the intermediate ring 12 so that a gas flowing along the inclined surface 7 of the inner ring 11 does not become turbulent at the boundary between the inner ring 11 and the intermediate ring 12. The state where the inclined surface 7 of the inner ring 11 is flush with the inclined surface 7 of the intermediate 12 means a state where there is no difference in level between the inclined surface 7 of the inner ring 11 and the inclined surface 7 of the intermediate ring 12 so that a gas can straightly flow in the direction from the inner ring 11 to the intermediate ring 12. Such flush inclined surface 7 of the inner ring 11 and the intermediate ring 12 can be formed by performing taper processing onto the inner ring 11 and the intermediate ring 12 in a state they are being coupled. Further, the inclined surface 7 provides a smooth surface along the direction that the dispersion liquid flows so that the dispersion liquid flowing along the inclined surface 7 does not become turbulent. In the nozzle shown in the drawing, the inclined surface 7 is conical in shape and has been given a smooth finish as a whole.

In a case where both of the inner ring 11 and the intermediate ring 12 are provided with the inclined surface 7, the opening of the supply orifice 5 is provided in the inclined surface 7. The angle of inclination $\alpha$ of the inclined surface 7 of the inner ring 11 and the intermediate ring 12 is set such that the supply orifice 5 and the inclined surface 7 form an obtuse angle. For example, the angle a is set in the range of 100 to 170°, preferably in the range of 120 to 160°, more preferably in the range of 130 to 160°, and optimally about 150°. A larger angle of inclination $\alpha$ stabilizes the jetting of a liquid. However, the optimum value of the angle of inclination $\alpha$ varies depending on the width of the slit of the supply orifice. It is preferred that the angle of inclination $\alpha$ is designed such that the width of the slit of the supply orifice provided in the inclined surface 7 does not exceed 2 mm.

There is provided a central ring 16 at the front end of the inner ring 11. Between the central ring 16 and the inner ring 11, the gas outlet 10 is formed. The central ring 16 is arranged at a predetermined position with it being fixed to the inner ring 11 (not shown in the drawing). The outer surface of the central ring 16 is tapered along the inclined surface 7 of the inner ring 11. The gas outlet 10 is provided as a slit, from which a laminar flow of a pressurized gas is jetted so that the gas flows along the inclined surface 7.

The atomizing gas supply path 14 provided in the inner ring 11 is connected to a pressurized gas source F, and the atomizing gas is jetted from the gas outlet 10 so as to flow along the inclined surface 7. The gas source F supplies air to the gas outlet 10, and the pressure of the gas is, for example, 3 to 20 kg/cm$^2$, preferably in the range of 4 to 15 kg/cm$^2$, more preferably in the range of 4 to 10 kg/cm$^2$, and optimally about 6.5 kg/cm$^2$. When the pressure of the atomizing gas increases, the flow speed of the gas flowing along the inclined surface 7 also increases, thereby enabling the dispersion liquid to be more effectively spread into a thin layer and then divided into fine droplets 9 (fine particles). However, in such a case, a special compressor may be required and the amount of energy consumed is increased. Therefore, an optimum pressure of the gas is determined in consideration of a required particle size of the dispersion liquid and the amount of energy consumed.

Further, in the nozzle shown in FIG. 5, the spreading gas is jetted around the outer periphery of the inclined surface 7 in addition to the atomizing gas. In this connection, the spreading gas need not necessarily be jetted. This is because the dispersion liquid can be jetted in the form of fine particles by only the atomizing gas without the spreading gas being used. The nozzle which can jet both of the atomizing gas and the spreading gas has a feature in that the droplets 9 can be divided into finer particles with the help of a collision between the atomizing gas and the spreading gas at the edge 7A of the inclined surface 7. Further, the hollow cone angle of the nozzle can be adjusted through the use of the spreading gas. Furthermore, although there is a possibility that the dispersion liquid flows backwardly to the side where the spreading gas is supplied due to poor release of the dispersion liquid at the edge 7A, such a back flow of the dispersion liquid can be effectively prevented through the use of the spreading gas.

The spreading gas is jetted from a spreading gas outlet 17 provided between the intermediate ring 12 and the outer ring 13. The spreading gas may have a lower pressure as compared with the atomizing gas. For example, the pressure of the atomizing gas is set to about 6.5 kg/cm$^2$, whereas the pressure of the spreading gas is set to about 1 kg/cm$^2$. Unlike the atomizing gas, the spreading gas is not used for forcedly spreading the dispersion liquid into a thin layer, and thus the pressure of the spreading gas can be set in the range of 0.5 to 3 kg/cm$^2$.

In the nozzle which can jet both of the atomizing gas and the spreading gas, the tip end of the inclined surface 7 provides the sharp edge 7A. In the intermediate ring 12, the edge 7A is formed by providing the inclined surface 7 in the tip end surface of the intermediate ring and processing the outer surface of the tip end of the ring 12 into a cylindrical shape. In the intermediate ring 12 having such a structure, the sharp edge 7A having an angle of (180—angle of inclination $\alpha$) can be formed at the tip end of the inclined surface 7. In this connection, it is to be noted that the angle of the edge 7A can be adjusted by processing the outer surface of the intermediate ring 12 so that it is tapered.

The nozzle shown in FIG. 5 can jet the dispersion liquid in the form of fine particles in a state as will be described below, for example.

<1> The pressurized atomizing gas is supplied to the path 14 provided at the center of the inner ring 11, and the spreading gas is supplied to the spreading gas outlet 17 provided between the intermediate ring 12 and the outer ring 13. In such a state, the dispersion liquid is sent onto the inclined surface 7 from the supply orifice 5.

<2> The dispersion liquid on the inclined surface 7 is spread into the laminar flow 8 by the atomizing gas flowing along the inclined surface 7. For example, in a case where the dispersion liquid is supplied from the supply orifice 5 under the condition that the atomizing gas flows along the inclined surface 7 at Mach 1.5, assuming that the velocity of the laminar flow 8 at the front end thereof is 1/20 of the velocity of flow of the atomizing gas, the velocity of the laminar flow 8 at the front end thereof becomes 25.5 m/s. Further, assuming that the diameter of the edge 7A provided at the tip end of the inclined surface 7 is 50 mm, when the dispersion liquid is supplied at 1 liter/min, the thickness of the laminar flow 8 becomes 4 μm.

<3> The laminar flow 8 having a thickness of 4 μm becomes too thin to keep a film state when passing through the edge 7A of the inclined surface 7, so that the laminar flow 8 is divided into droplets 9 in the form of fine particles due to surface tension.

<4> The droplet 9 in the form of a fine particle is further divided into finer particles due to friction and vibration caused by a collision between the atomizing gas and the spreading gas at the edge 7A.

<5> The droplets 9 in the form of fine particles are radially jetted by the atomizing gas and the spreading gas. This jetting pattern is called as hollow cone. Although the hollow cone angle varies depending on the angle of the inclined surface 7, it may also be adjusted by changing the pressures of the atomizing gas and the spreading gas upon jetting.

From the droplets 9 jetted in a hollow cone pattern, the dispersion medium is eliminated, thereby obtaining toner particles 9.

In FIG. 6, another embodiment of the nozzle is shown by which fine particles (droplets 9) of a dispersion liquid containing a liquid A and a liquid B can be obtained. Unlike the intermediate ring 12 of the nozzle shown in FIG. 5, the intermediate ring of the nozzle shown in FIG. 6 has a double-cylinder structure in which an inner intermediate ring (cylinder) 12A and an outer intermediate ring (cylinder) 12B are provided. The supply orifice 5 for the liquid B is provided between the inner intermediate ring 12A and the outer intermediate ring 12B. Each of the inner surface and the outer surface of the annular inner intermediate ring 12A is tapered to provide the inclined surface 7, and the tip ends of the inclined surfaces 7 provide the sharp edge 7A. The tip end surface of the outer intermediate ring 12B is also tapered to provide the inclined surface 7. The inclined surface 7 of the outer intermediate ring 12B is flush with the inclined surface 7 provided in the outer surface of the inner intermediate ring 12A.

As described above, the nozzle shown in FIG. 6 has the inclined surface 7 in both of the inner surface and the outer surface of the inner intermediate ring 12A. The supply orifice 5 for the liquid A is provided in the inclined surface 7 of the inner surface of the inner intermediate ring 12A and the supply orifice 5 for the liquid B is provided in the inclined surface 7 of the outer surface of the inner intermediate ring 12A. In this nozzle, a high-pressure atomizing gas is jetted from both of the gas outlet 10 provided in the inner ring 11 and the spreading gas outlet 17 provided between the outer intermediate ring 12B and the outer ring 13 so that each of the liquid A and the liquid B can be spread into a thin layer on the inclined surface 7 by the atomizing gas.

By using the nozzle M2 having such a structure, it is possible to obtain a toner highly homogenized (dispersed) even in a case where used components of the toner are poor in dispersibility or compatibility. Further, by using the nozzle M2 having such a structure, it is also possible to relatively easily obtain a toner having a multilayer (multiphase) structure.

Further, the nozzle shown in FIG. 6 is provided with the inclined surface 7 in both of the inner surface and the outer surface of the inner intermediate ring 12A to supply two different liquids (dispersion liquids) onto the inclined surface 7. The nozzle shown in FIG. 7 is provided with the plurality of supply orifices 5 in the inclined surface 7. By using such a nozzle, it is possible to supply some kinds of different liquids through the plurality of the supply orifices 5 and simultaneously jet them. As a result, multifunctional hybrid particles having new characteristics can be manufactured depending on the combination of the liquids (dispersion liquid) to be supplied through the supply orifices 5.

Further, in FIGS. 8 and 9, still another embodiment of the nozzle is shown by which finer particles of the dispersion liquid can be jetted. Like the nozzle shown in FIG. 6, the nozzle shown in FIGS. 8 and 9 has the inner ring 12 having a double-cylinder structure, in which the inner intermediate ring (cylinder) 12A and the outer intermediate ring (cylinder) 12B are provided. The supply orifice 5 for the liquid B is provided between the inner intermediate ring 12A and the outer intermediate ring 12B. Each of the inner surface and the outer surface of the annular inner intermediate ring 12A is tapered to provide the inclined surface 7, and the tip ends of the inclined surfaces 7 provide the sharp edge 7A. The tip end surface of the outer intermediate ring 12B is also tapered to provide the inclined surface 7.

In FIG. 10, an enlarged cross-sectional view of the inclined surface 7 of the nozzle shown in FIGS. 8 and 9 is shown. The nozzle shown in FIG. 10 is designed such that the inclined surface 7 provided in the inner surface of the inner intermediate ring 12A in the vicinity of the supply orifice 5 is made to be lower than a line extended from the inclined surface 7 of the inner ring 11 by giving a difference in level to some extent. Likewise, the level of the inclined surface 7 provided in the outer surface of the inner intermediate ring 12A in the vicinity of the supply orifice 5 is made to be lower than the level of the line extended from the inclined surface 7 of the outer intermediate ring 12B. The nozzle having such a inclined surface 7 has a feature in that a liquid (dispersion liquid) can be smoothly discharged from the supply orifice 5 by a gas flow flowing along the inclined surface 7 as shown by the arrows in FIG. 10. This is because the inclined surface 7 provided in the inner surface of the inner intermediate ring 12A in the vicinity of the supply orifice 5 does not protrude beyond the inclined surface 7 of the inner ring 11. If the inclined surface 7 provided in the inner intermediate ring 12A in the vicinity of the supply orifice 5 protrudes beyond the line extended from the inclined surface 7 of the inner ring 11, it is difficult to smoothly discharge the liquid, because the gas flow comes into collision with the inner surface of the inner intermediate ring 12A. The same goes for the case of the inclined surface 7 provided in the outer surface of the inner intermediate ring 12A.

Further, in the nozzle shown in FIG. 10, the inclined surface 7 of the inner intermediate ring 12A is curved so that the tip part thereof protrudes beyond the line extended from the adjacent inclined surface 7. In such an inclined surface 7 of the inner intermediate ring 12A, a gas flow flowing along the inclined surface 7 in the direction shown by the arrow in the drawing is more strongly pressed against the tip part of the inclined surface 7, thereby enabling a laminar flow of a liquid flowing on the inclined surface 7 to be further spread. As a result, a thinner laminar flow can be obtained. Therefore, such a nozzle can jet a liquid in the form of extremely fine particles (fine particles having a particle size of 1 to 5 μm, for example).

The nozzle shown in this drawing can jet a liquid (dispersion liquid) in a hollow cone pattern by setting the tip angles of the inner intermediate ring 12A, the outer intermediate ring 12B and the inner ring 11 as shown in FIG. 9, respectively.

In each of the nozzles shown in FIGS. 5, 6 and 8, the spreading gas outlet 17, the central ring 16 constituting the gas outlet 10, and the tip part of the outer ring 13 are made of a breathable member 18. Since the breathable member 18 can pass through air, a pressurized gas supplied to the gas outlet 10 passes through the breathable member 18 and is jetted from the surface of the breathable member 18. For example, such a breathable member 18 is made of sintered metal of stainless steel having an average particle size of about 1 μm. As described above, since a part of the gas supplied through the gas outlet 10 is jetted from the surface of the breathable member 18, the breathable member 18 has the effect of preventing the deposition of a mist on the surface of the central ring 16 and the surface of the tip part of the outer ring 13.

Further, yet another embodiment of the nozzle is shown in FIG. 11, which can jet fine particles of the dispersion liquid in both of a hollow cone pattern and a full cone pattern. In FIG. 12, an enlarged view of an important part of the tip part of the nozzle shown in FIG. 11 is shown. Like the nozzle shown in FIG. 6, the nozzle shown in FIG. 11 has the intermediate ring 12 having a double-cylinder structure, in which the inner intermediate ring 12A and the outer intermediate ring 12B are provided. The supply orifice 5 is provided between the inner intermediate ring 12A and the outer intermediate ring 12B. Each of the inner surface and the outer surface of the annular inner intermediate ring 12A is tapered to provide the inclined surface 7, and the tip ends of the inclined surfaces 7 provide the sharp edge 7A. The tip end surface of the outer intermediate ring 12B provides a straight inclined surface 7.

FIG. 13 is an enlarged view of the inclined surface 7 of the inner intermediate ring 12A. Like the nozzle shown in FIG. 10, the nozzle shown in FIG. 13 is designed such that the inclined surface 7 provided in the inner surface of the inner intermediate ring 12A in the vicinity of the supply orifice 5 is made to be lower than a line extended from the inclined surface 7 of the inner ring 11 by giving a difference in level to some extent. Likewise, the level of the inclined surface 7 provided in the outer surface of the inner intermediate ring 12A in the vicinity of the supply orifice 5 is made to be lower than the level of the line extended from the inclined surface 7 of the outer intermediate ring 12B. By using the nozzle having such an inclined surface 7, a liquid (dispersion liquid) can be smoothly discharged from the supply orifice 5 by a gas flow flowing along the inclined surface 7 as indicated by the arrow shown in FIG. 13.

Further, in the nozzle shown in FIG. 13, the angle of inclination of each of the inclined surfaces 7 provided in the inner and outer surfaces of the inner intermediate ring 12A is changed at a certain point so that the tip part of the inclined surface 7 can protrude beyond the line extended from the adjacent inclined surface 7. In such an inclined surface 7 of the inner intermediate ring 12A, a gas flow flowing along the inclined surface 7 in the direction shown by the arrow in the drawing is more strongly pressed against the tip part of the inclined surface 7, thereby enabling a laminar flow of a liquid flowing on the inclined surface 7 to be further spread. As a result, a thinner laminar flow is obtained. Therefore, such a nozzle has a feature in that it can jet a liquid in the form of extremely fine particles.

Furthermore, the nozzle shown in this drawing can jet a liquid in either a hollow cone pattern or a full cone pattern by setting the tip angles of the outer ring 13, the outer intermediate ring 12B, the inner intermediate ring 12A, and the inner ring 11 as shown in FIG. 13. In a case where a liquid is jetted in a hollow cone pattern, the pressure of the atomizing gas jetted from the gas outlet 10 provided between the central ring 16 and the inner ring 11 should be made higher than the pressure of the atomizing gas jetted from the gas outlet 10 provided between the outer intermediate ring 12B and the outer ring 13. On the other hand, in a case where a liquid is jetted in a full cone pattern, the pressure of the atomizing gas jetted from the gas outlet 10 provided between the outer intermediate ring 12B and the outer ring 13 should be made higher than the pressure of the atomizing gas jetted from the gas outlet 10 provided between the central ring 16 and the inner ring 11.

Like the nozzle shown in FIG. 8, in the nozzle shown in FIG. 11, the central ring 16 constituting the gas outlet 10 and the tip part of the outer ring 13 are made of the breathable material 18, thereby preventing the deposition of a mist on the surface of the central ring 16 and the surface of the outer ring 13.

Further, the nozzle shown in FIG. 14 has a unique structure for preventing the deposition of a mist without using the breathable member. This nozzle is provided with a gas releasing concave part 19 in the tip end of the central ring 16 (on the inner side of the supply orifice 5 and in the front end of the nozzle). The gas releasing concave part 19 is connected to a path 1 provided between the inner ring 11 and the central ring 16 through a through hole 20 provided in the central ring 16. As shown in FIG. 15, the through hole 20 is provided in a direction that a jetted gas is made to rotate in the gas releasing concave part 19, that is, in a slanting direction from the direction of the radius to the direction of the tangent. The surface of the gas releasing concave part 19 provides a smooth surface so that a gas flow can flow as a laminar flow without becoming turbulent. Further, an area around the periphery of the gas releasing concave part 19 is formed in a streamline shape like the wing of an airplane, that is, it is smoothly curved toward the gas outlet 10.

In the nozzle having such a structure, when a pressurized gas is jetted to the gas releasing concave part 19 through the through hole 20 in the direction of the tangent, the gas comes into collision with the tapered inner surface of the gas releasing concave part 19 and then is diffused in the form of a spiral flow. In this regard, it is to be noted that the percentage of the gas flow flowing toward the exit of the gas releasing concave part 19 (that is the upper side in the drawing) varies depending on the taper angle (θ) of the gas releasing concave part 19. In a case where the taper angle is set to 15° as shown in FIG. 14, the percentage of the spiral flow flowing toward the exit of the gas releasing concave part 19 is 70%. The remaining 30% of the gas becomes a spiral flow flowing toward the bottom of the gas releasing concave part 19, and when the spiral flow reaches the bottom, the velocity of the spiral flow becomes smaller. Then, the spiral flow flows toward the exit of the gas releasing concave part 19. Finally, it is mixed with the above-described 70% spiral flow and then ejected from the gas releasing concave part 19.

The spiral flow of the gas flowing along the inner surface of the gas releasing concave part 19 climbs the tapered surface and the wing-like portion having a streamline shape of the gas releasing concave part 19. After reaching the peak of the wing-like portion, the spiral flow flows along the surface of the wing-like portion and is then drawn into the atomizing gas jetted from the path 1 provided between the inner ring 11 and the central ring 16. Since the wing-like portion having a streamline shape is smoothly curved toward the gas outlet 10, the gas flows along the surface of the wing-like portion so that a flowing gas layer is formed in front of the central ring 16.

Since the front surface of the central ring 16 is entirely covered with the flowing gas layer, a mist jetted from the supply orifice 5 will not be deposited on the central ring 16. It is preferred that the number of the through hole 20 is about six so that the gas can be uniformly jetted from the gas releasing concave part 19. However, the number of the through hole 20 may be larger than six. Further, when the through hole is formed in a slit shape so as to widen the width thereof, it is possible to uniformly jet the gas from the gas releasing concave part 19 even if the number of the through hole is less than six.

In the nozzle having such a structure, since the front surface of the nozzle is covered with the gas layer, a jetted mist will not be deposited on the surface of the nozzle but is blown off by the streamlined gas flow (flowing gas layer). Further, by using the nozzle having such a structure, it is also possible to obtain the same effect as that obtained by the method in which the deposition of a mist is prevented by aeration through the breathable member 18, with a smaller amount of gas.

Further, yet another embodiment of the nozzle is shown in FIG. 16, which can uniformly jet a gas and a liquid from the gas outlet 10 and the supply orifice 5, respectively. The nozzle is provided with a helical rib 22 in each of the path 1 for gas and a path 21 for liquid. For the purpose of centering when assembling the rings (that is, aligning the centers of all the rings accurately), the rib is provided in each of the path 1 and the path 21 for liquid (that is, in a space created between the rings). By making contact the tips of the ribs with each other, the rings can be centered and then assembled accurately.

In the nozzle shown in FIG. 16, the paths 1 are in communication with the gas outlets 10 provided on both sides of the edge 7A. Each of the paths 1 is provided with the helical rib 22 for spirally spinning a gas flowing in the axial direction. A gas flowing in one path 1 and a gas flowing in the other path 1 spin in opposite directions to each other and then they are jetted from the gas outlets 10 on both sides of the edge 7A toward the edge 7A, respectively. In the nozzle having such a structure, since the atomizing gas jetted on one side of the edge 7A and the atomizing gas jetted on the other side of the edge 7A spin in opposite directions to each other, it is possible to more efficiently form a mist at the edge 7A due to a twist effect by both of the gases, thereby obtaining a finer mist.

In this regard, it is to be noted that there is no necessity to always spin the atomizing gas jetted on one side of the edge 7A and the atomizing gas jetted on the other side of the edge 7A in opposite directions to each other. They may be spun in the same direction. Further, in a case where the nozzle has the plurality of gas outlets, there is no necessity to spin all the gases jetted from the gas outlets and thus only a specific path may be provided with the helical rib.

Further, in the nozzle shown in FIG. 16, the path 21 for liquid is also provided with the helical rib 22. Since the velocity of flow of a liquid is lower than that of gas, the angle of inclination a of the helical rib 22 is set to a relatively large value, about 60°. The angle of inclination α may be set to 30 to 70°, for example, and it is preferably set to 45 to 65°. Although the spin of a liquid can be made strong by increasing the angle of inclination α of the helical rib 22 provided in the path 21 for liquid as is the same with the helical rib 22 provided in the path 1, the flow resistance of the liquid is also increased. For this reason, the angle of inclination α of the helical rib 22 optimally designed in consideration of the flow resistance and spin of a liquid.

By using the nozzle M2 as described above, the following effects can be obtained.

It is possible to jet the dispersion liquid in the form of extremely fine particles as well as to continuously jet the dispersion liquid for a long period of time while preventing clogging effectively. Further, since the dispersion liquid is forced to spread into a laminar flow to jet it as droplets in the form of fine particles, it is possible to jet droplets in the form of finer particles by increasing the velocity of flow of the gas flowing along the smooth surface.

Even if the amount of the dispersion liquid to be jetted per unit time is increased, it is also possible to jet it in the form of fine droplets.

Further, in the present invention, the initial velocity of the dispersion liquid 3 (droplets 9) at the time when it is jetted to the solidifying section M3 from the nozzle M2 is preferably in the range of 0.1 to 10 m/s, and more preferably in the range of 2 to 8 m/s. If the initial velocity of the dispersion liquid 3 (droplets 9) is less than the above lower limit value, productivity of a toner is lowered. On the other hand, if the initial velocity of the dispersion liquid 3 (droplets 9) exceeds the above upper limit value, the sphericity of the obtained toner particle 4 tends to lower.

Although the viscosity of the dispersion liquid 3 jetted from the nozzle M2 is not limited to any specific value, it is preferably in the range of 5 to 3,000 cps, and more preferably in the range of 10 to 1,000 cps. If the viscosity of the dispersion liquid 3 is less than the above lower limit value, it is difficult to sufficiently control the size of jetted particles (droplets 9), thus resulting in a case where a wide variation in size may occur among the obtained toner particles 4. On the other hand, if the viscosity of the dispersion liquid 3 exceeds the above upper limit value, a formed droplet has a large diameter. Further, in a case where the viscosity of the dispersion liquid 3 is too high, it is difficult to operate the nozzle continuously due to a heavy deposition of the dispersion liquid 3 on the surface of the nozzle as well as to supply the dispersion liquid 3 to the nozzle.

Further, the dispersion liquid 3 jetted from the nozzle M2 may be heated in advance. By heating the dispersion liquid 3, even if the dispersoid 31 is in a solid state (or a state where the viscosity of the dispersoid 31 is relatively high), at room temperature, it is possible to make it in a melting state (or a state where the viscosity of the dispersoid is relatively low) upon jetting. As a result, it is possible to allow the agglomeration of the dispersoid 31 contained in the droplets 9 to smoothly proceed in the solidifying section M3 (which will be described later), thereby enabling the obtain toner particles 4 to have especially high roundness.

Further, the amount of one drop of the dispersion liquid 3 to be jetted (that is a volume of 91 droplets) slightly varies depending on the ratio of the dispersoid 31 contained in the fluid solution 3, or the like, but it is preferably in the range of 0.05 to 500 pl, and more preferably in the range of 0.5 to 5 pl. By setting the amount of one drop of the dispersion liquid 3 to be jetted to the above range, it is possible to obtain toner particles 4 having a preferred particle size.

In the meantime, in general, the size of the droplet 9 jetted from the nozzle M2 is sufficiently large as compared with the particle of the dispersoid 31 contained in the dispersion liquid 3. Specifically, in the droplet 9, a plurality of particles of the dispersoid 31 are dispersed. Therefore, even if a variation in particle size among the particles of the dispersoid 31 is relatively large, the ratio of the dispersoid 31 contained in one droplet 9 is substantially uniform among the individual droplets 9. Therefore, by making the amount of one drop of the dispersion liquid 3 substantially uniform, it is possible to obtain toner particles 4 having a small variation in particle size. There is a tendency that such a variation becomes small as the value Dm/Dd becomes small. For example, when the average particle size of the particle of the dispersion liquid 3 (droplet 9) to be jetted is defined as Dd (μm) and the average particle size of the particle of the dispersoid 31 in the dispersion liquid 3 is defined as Dm (μm), it is preferred that Dd and Dm satisfy the relation $Dm/Dd<0.5$, and it is more preferred that they satisfy the relation $Dm/Dd<0.2$.

Further, when the average particle size of the particle of the dispersion liquid 3 (droplet 9) to be jetted is defined as Dd (μm) and the average particle size of a manufactured toner particle is defined as Dt (μm), it is preferred that Dd and Dt satisfy the relation $0.05 \leqq Dt/Dd \leqq 1.0$, and it is more preferred that they satisfy the relation $0.1 \leqq Dt/Dd \leqq 0.8$. When such a relation is satisfied, it is possible to relatively easily obtain sufficiently fine toner particles 4 having high roundness and a sharp particle size distribution.

A description has been made with regard to the method for jetting the dispersion liquid in the form of droplets (fine particles) using the nozzle shown in FIGS. 5 to 16 (that is a nozzle for jetting the dispersion liquid in the form of fine particles by pressing the dispersion liquid against the smooth surface using a gas flow to spread it into a laminar flow and then releasing the laminar flow from the smooth surface), but a method for jetting the dispersion liquid in the form of droplets (fine particles) is not limited thereto. For example, a spray dry method, the so-called inkjet method or bubble jet method, or the like can be employed.

The spray dry method is a method for obtaining droplets by spraying a liquid (dispersion liquid) using a high-pressure gas.

Example of a method which applies the so-called ink jet method includes a method disclosed in Japanese Patent Application No. 2002-169349. Specifically, the present invention can apply "a method in which the dispersion liquid is intermittently jetted from the head section using piezoelectric pulses and conveyed in the solidifying section by airflow to thereby obtain particles of the dispersion liquid" for obtaining a dispersion liquid in the form of droplets.

Further, example of a method which applies the so-called bubble jet method includes a method disclosed in Japanese Patent Application No. 2002-169348. Specifically, the present invention can apply "a method in which the dispersion liquid is intermittently jetted from the head section by the change in volume of a gas and conveyed in the solidifying section by airflow to thereby obtain particles of the dispersion liquid" for obtaining a dispersion liquid in the form of droplets.

In particular, in the present invention, in a case where the nozzle as described above is used, advantages as will be described below can be obtained as compared with a case where the common spray dry method is used.

Specifically, when the nozzle as described above is used, it is possible to more easily and accurately control conditions for jetting the dispersion liquid as compared with the spray dry method commonly used. As a result, toner particles having required size and shape can be efficiently manufactured, for example. In particular, by using the method described above, a variation in size among particles of the dispersion liquid can be made extremely small (particle size distribution can be made small), thereby enabling a variation in moving speed among the particles to be small. Therefore, it is possible to effectively prevent a collision between jetted particles of the dispersion liquid and the agglomeration of the particles before they are solidified. This makes it hard for deformed particles to be formed. As a result, variations in shape and size among finally obtained toner particles become extremely small, and further, variations in charging properties, fixing property and the like among the finally obtained toner particles also become small. Accordingly, the obtained toner can have extremely high reliability as a whole. Furthermore, by using the method as described above, even in a case where the size of the manufactured toner particles is relatively small, the toner particles can have a sharp particle size distribution.

Further, the toner manufacturing device M1 may be provided with a gas injecting means (not shown) between the nozzle (jetting port) M2 and the nozzle (jetting port) M2. This makes it possible to convey and solidify the dispersion liquid 3 while keeping appropriate intervals among the droplets 9 intermittently jetted from the nozzle M2. As a result, a collision between the jetted droplets 9 and the agglomeration of the jetted droplets 9 can be effectively prevented.

Further, by providing the gas injecting means, it is possible to form a gas flow flowing in substantially one direction (that is a downward direction in the drawing) in the solidifying section M3. Such a gas flow makes it possible to efficiently convey the droplets 9 (toner particles 4) in the solidifying section M3.

Further, by providing the gas injecting means, it is possible to form a gas flow curtain among particles jetted from the nozzle M2, thereby more effectively preventing a collision between particles jetted from the adjacent nozzles and the agglomeration of such particles, for example.

In a case where the toner manufacturing device has such a gas injecting means, it is preferred that the gas injecting means is provided with a heat exchanger (not shown) having a function capable of setting a temperature of a gas to be jetted to a preferred value. This makes it possible to efficiently solidify the droplets 9 jetted into the solidifying section M3.

Further, when the toner manufacturing device has such a gas injecting means, it is possible to easily control the solidifying speed of the droplets 9 jetted from the nozzle M2 by adjusting the amount of a gas flow to be supplied.

The toner obtained in such a manner as described above may be subjected to various processing such as classification processing, external additive addition processing, and the like, as required.

Such classification processing may be carried out by using a sieve, an air classifier, or the like.

Further, examples of the external additive used for the external additive addition processing include fine particles made of inorganic materials such as metal oxides (e.g., titanium oxide, silica (positively-chargeable silica, negatively-chargeable silica, and the like), aluminum oxide, strontium titanate, cerium oxide, magnesium oxide, chromium oxide, zinc oxide, alumina, and magnetite), nitrides (e.g., silicon nitride), carbides (e.g., silicon carbide), calcium sulfate, calcium carbonate, and metallic salts; and fine particles made of organic materials such as acrylic resin, fluorocarbon resin, polystyrene resin, polyester resin, and aliphatic metal salts (e.g., magnesium stearate); and the like.

Among these external additives mentioned above, titanium oxides can be preferably used as external additives. Examples of titanium oxides include rutile type titanium oxide, anatase type titanium oxide, rutile-anatase type titanium oxide, and the like.

The rutile-anatase type titanium oxide contains titanium oxide (titanium dioxide) having a rutile type crystal structure, and titanium oxide (titanium dioxide) having an anatase type crystal structure within the same grain. In other words, the rutile-anatase type titanium oxide is a mixed type titanium oxide (titanium dioxide) of rutile type titanium oxide and anatase type titanium oxide.

The rutile type titanium oxide normally has a property that it tends to form fusiform crystals. The anatase type titanium oxide tends to precipitate minute crystals, and has an excellent affinity with a silane coupling agent or the like for use in a hydrophobic treatment or the like.

Since the rutile-anatase type titanium oxide is a mixed type titanium oxide of the rutile type crystals and the anatase type crystals, it has both advantages of the rutile type titanium oxide and the anatase type titanium oxide. In other words, in the rutile-anatase type titanium oxide, since minute anatase type crystals are mixed between rutile type crystals (inside the rutile type crystals), the shape of the rutile-anatase type titanium oxide is nearly fusiform as a whole. Therefore, the rutile-anatase type titanium oxide is hard to be embedded in base toner particles. Further, since the affinity with a silane coupling agent or the like of the rutile-anatase type titanium oxide as a whole becomes excellent, it is easy to form a uniform and stable hydrophobic coating (silane coupling coating) on the surface of the rutile-anatase type titanium oxide powder. Accordingly, when an obtained toner contains the rutile-anatase type titanium oxide, the toner can have a uniform charge distribution (that is, charge distribution is sharp on the toner particles) and stable charging properties, and therefore environmental characteristics (especially, moisture resistance), fluidity, caking resistance, and the like of the toner become excellent.

In particular, when used together with the polyester-based resin, the rutile-anatase type titanium oxide exhibits the following synergetic effects.

Namely, as described above, in the present invention, since the polyester-based resin includes the block polyester having crystalline blocks with high crystallinity, the toner particles have crystals having a certain size mainly formed of the crystalline blocks. Therefore, the rutile-anatase type titanium oxide is hard to be embedded in the base particles of the toner. That is, when the toner particles contain a high hardness component such as crystals, the rutile-anatase type titanium oxide is surely carried (adhered) in the vicinity of the surface of the toner base particles. Because of this, the function (in particular, the effect of imparting excellent fluidity and chargeability) of the rutile-anatase type titanium oxide can be exhibited sufficiently. In this way, by using the rutile-anatase type titanium oxide and the polyester-based resin in combination, the function of the rutile-anatase type titanium oxide can be sufficiently exhibited, so that the amount of the external additive to be added can be made small. As a result, disadvantages (for example, deterioration in the fixing property of the toner onto a transfer material such as paper, or the like) caused by the addition of an excessive amount of the external additive can be sufficiently prevented from occurring.

The abundance ratio between the rutile type titanium oxide and the anatase type titanium oxide in the rutile-anatase type titanium oxide is not particularly limited, but it is preferably in the range of 5:95 to 95:5 in weight ratio, and more preferably 50:50 to 90:10. By using such rutile-anatase type titanium oxide, the effect obtained by the use of the rutile-anatase type titanium oxide can be made more conspicuous.

Moreover, it is preferred that the rutile-anatase type titanium oxide is capable of absorbing light in the wavelength region of 300 to 350 nm. This makes the light fastness (in particular, light fastness after fixation onto the recording medium) of a resultant toner especially excellent.

Although the shape of the rutile-anatase type titanium oxide that can be used in the present invention is not particularly limited, it is normally nearly fusiform.

In a case where the shape of the rutile-anatase type titanium oxide is nearly fusiform, it is preferred that its average major axial diameter is in the range of 10 to 100 nm, and more preferably in the range of 20 to 50 nm. By setting the average major axial diameter to such a range, the rutile-anatase type titanium oxide can sufficiently exhibit the above-mentioned function, and becomes hard to be embedded in and liberated from the base particles of the toner. As a result, stability of a resultant toner against mechanical stress is further improved.

The content of the rutile-anatase type titanium oxide in the toner of the present invention is not particularly limited, but it is preferably in the range of 0.1 to 2.0 wt %, and more preferably 0.5 to 1.0 wt %. If the content of the rutile-anatase type titanium oxide is less than the above lower limit value, there is a possibility that the effect obtained by the use of this type of titanium oxide can not be sufficiently exhibited. On the other hand, if the content of the rutile-anatase type titanium oxide exceeds the above upper limit value, the fixing property of a resultant toner tends to lower.

Although the rutile-anatase type titanium oxide may be prepared by any method, it may be obtained by firing the anatase type titanium oxide, for example. By using such a method, it is possible to relatively easily and surely control the abundance ratio between the rutile type titanium oxide and the anatase type titanium oxide in the rutile-anatase type titanium oxide. In a case where the rutile-anatase type titanium oxide is obtained by such a method, it is preferred that the firing temperature is in the range of 700 to 1,000° C. By setting the firing temperature to the above range, it is possible to more easily and surely control the abundance ratio between the rutile type titanium oxide and the anatase type titanium oxide in the rutile-anatase type titanium oxide.

Further, it is preferred that the rutile-anatase type titanium oxide is a product which has been subjected to a hydrophobic treatment. By subjecting the rutile-anatase type titanium oxide to a hydrophobic treatment, it is possible to obtain an effect that charging is not largely affected by humidity. Examples of such a hydrophobic treatment include a surface treatment to the powder (particles) of rutile-anatase type titanium oxide by the use of HMDS, a silane coupling agent (for example, it may be one having a functional group such as an amino group), a titanate coupling agent, a fluorine-containing silane coupling agent, a silicone oil, or the like.

Moreover, as for silica which can be used as the external additive, positively-chargeable silica, negatively-chargeable silica, or the like can be mentioned. The positively-chargeable silica may be obtained, for example, by subjecting negatively-chargeable silica to a surface treatment using a silane coupling agent having a functional group such as an amino group.

When negatively-chargeable silica is used as the external additive, it is possible to increase the amount of charge (absolute value) of obtained toner particles. As a result, a stable negatively-chargeable toner can be obtained, thus leading to the effect that toner control in the image forming apparatus can be facilitated.

Further, when negatively-chargeable silica is used together with the rutile-anatase type titanium oxide, an especially excellent effect can be obtained. Namely, by using negatively-chargeable silica and the rutile-anatase type titanium oxide in combination, it is possible for a resultant toner to have more improved fluidity and environmental characteristics (especially, moisture resistance) and to exhibit more stable frictional chargeability. Further, it is also possible to more effectively prevent the occurrence of the so-called fog. Moreover, by using negatively-chargeable silica and the rutile-anatase type titanium oxide in combination, it is possible for a resultant toner to have a large amount of charge (absolute value), and a sharp charge distribution.

In this connection, when the average major axial diameter of the nearly fusiform rutile-anatase type titanium oxide is defined as $D_1$ (nm) and the average grain size of negatively-chargeable silica is defined as $D_2$ (nm), it is preferred that $D_1$ and $D_2$ satisfy the relation $0.2 \leqq D_1/D_2 \leqq 15$, and it is more preferred that they satisfy the relation $0.4 \leqq D_1/D_2 \leqq 5$. When they satisfy such a relation, the effect obtained by using negatively-chargeable silica and the rutile-anatase type titanium oxide in combination becomes more conspicuous. In this regard, it is to be noted that what is meant by the "average grain size" in this specification is the average grain size in terms of weight.

Moreover, in a case where positively-chargeable silica is used as the external additive, it is possible, for example, to let the positively-chargeable silica function as a micro carrier, and further enhance the chargeability of an obtained toner particle itself. In particular, by using positively-chargeable silica and the rutile-anatase type titanium oxide in combination, it is possible for an obtained toner to have a large amount of charge (absolute value) and a sharp charge distribution.

In a case where positively-chargeable silica is used as the external additive, the average grain size thereof is preferably in the range of 30 to 100 nm, and more preferably in the range of 40 to 50 nm. By setting the average grain size of the positively-chargeable silica to the above range, the above-described effects become more conspicuous.

Moreover, as for the external additive, fine particles made of such materials described above, to which a surface treatment has been subjected using HMDS, a silane coupling agent (for example, it may have a functional group such as an amino group), a titanate coupling agent, a fluorine-containing silane coupling agent, a silicone oil, or the like can also be used.

Such an external additive can be added to the toner by mixing with the base particles of the toner using, for example, a Henschel mixer or the like. Alternatively, the external additive may be added to the toner by jetting and/or convecting the external additive in the solidifying section M3 of the toner manufacturing device M1 to adhere it to the droplets 9 or the base particles of the toner.

Further, it is preferred that toner powder obtained in such a manner has a coating ratio with the external additive of 100 to 300%, and more preferably 120 to 220%. Here, the coating ratio with the external additive means a percentage of an area coated with the external additive out of the surface area of the toner particle, which is a computational coating ratio when a sphere corresponding to the average particle size of the toner is covered with spheres corresponding to the average grain size of the external additive in hexagonal closest packing. If the coating ratio with the external additive is less than the above lower limit value, there is a possibility that the effect of the external additive described above may not be exhibited sufficiently. On the other hand, if the coating ratio with the external additive exceeds the above upper limit value, the fixing property of a resultant toner tends to lower.

Moreover, the external additive in the toner may be in the state where the entirety of it is adhered to the toner particles (base particles), or a part thereof is liberated from the surface of the toner particles. That is, the toner may include the external additive liberated from the toner particles.

In such a case, that is, in a case where the external additive liberated from the base particles (hereinafter, also referred to as "free external additive") are included in the toner, such a free external additive may be made to function as, for example, a micro carrier charged with the polarity opposite to that of the toner particle. When such a free external additive functioning as micro carriers is included in the toner, it is possible to effectively prevent or suppress the generation of toner particles having opposite chargeability upon developing (that is, toner particles charged with the polarity opposite to the original polarity with which the toner particles are to be charged upon charging). As a result, it is possible to obtain a toner having a characteristic that a disadvantage such as fog or the like is hard to occur.

The amount of the external additive liberated from the toner particles may be measured, for example, by applying the method disclosed in a paper by T. Suzuki and H, Takahara in the Collection of Papers "Japan Hardcopy' 97," "New Evaluation Method of External Addition—Toner Analysis by a Particle Analyzer—" at the 95th Annual Meeting of the Electrophotography Society, Jul. 9–11, 1997. In the following, a description will be made with regard to an example of the measurement method for the amount of a free external additive by the particle analyzer (PT 1000) using (rutile-anatase type) titanium oxide as an external additive.

In this measurement method, particles of a toner T, formed by adhering the external additive composed of titanium oxide ($TiO_2$) on the surface of base particles formed of a resin (C), are excited by being introduced into a plasma, to obtain an emission spectrum accompanying the excitation, and then element analysis is carried out based on the spectrum.

First, when toner particles in which the external additive ($TiO_2$) is adhered to the base particles of the toner are introduced into the plasma, both of the base particle (C) and the external additive ($TiO_2$) emit light. In this case, since the base particle (C) and the external additive ($TiO_2$) are introduced simultaneously into the plasma, they emit light simultaneously. When the emission of light takes place at the same time as in this case, it is called they are synchronous. In other words, when the base particle (C) and the external additive ($TiO_2$) are in the synchronous state, it represents the state in which the external additive ($TiO_2$) is adhered to the base particle (C).

Moreover, when the base particle (C) to which no external additive ($TiO_2$) is adhered or the external additive ($TiO_2$) liberated from the base particles (C) are introduced into the plasma, both of them emit light, but they emit light at different times because the base particle (C) and the external additive ($TiO_2$) enter the plasma at different times (for example, if the base particle enters the plasma prior to the external additive, the base particle emits light first, followed by the emission of light by the external additive).

When the base particle (C) and the external additive ($TiO_2$) emit light at different times, such a state is called not synchronous (that is, asynchronous). In other words, the state in which the base particle and the external additive are in an asynchronous state, represents that the external additive is not adhered to the base particle.

Moreover, the height of the emitted signal in the emission spectrum obtained as in the above represents the intensity of emission, which is proportional to the atomicity of the constituent element (C or $TiO_2$) contained in the particle, and is not determined by the size or the shape of the particle. In order to represent the emission intensity in terms of the size of the particle, when emission of the base particle or the external additive is obtained, a truly spherical particle composed only of the base particle (C) or the external additive ($TiO_2$) is assumed, in which the truly spherical particle is defined as an equivalent particle, and its grain size is defined as an equivalent grain size. Since the external additive has a very small size, and it is not possible to detect each particle individually, the detected emission signals of the external additive are added together to be converted into one equivalent particle for the convenience of the analysis.

When the equivalent grain size of the equivalent particles obtained from each emission spectrum for the base particles and the external additive obtained as in the above is plotted for each particle of the toner, it is possible to obtain an equivalent grain size distribution diagram of the toner particles as shown in FIG. 17.

In FIG. 17, the abscissa represents the equivalent grain size of the base particle (C), and the ordinate represents the equivalent grain size of the external additive ($TiO_2$). The equivalent particle on the abscissa represents an asynchronous base particle (C) to which no external additive ($TiO_2$) is adhered, and the equivalent particle on the ordinate represents an asynchronous external additive ($TiO_2$) liberated from the base particle (C). Moreover, the equivalent particles which are not on the abscissa and the ordinate represent a synchronous toner in which the external additive ($TiO_2$) is adhered to the base particle (C). In this way, the adherence condition of the external additive ($TiO_2$) to the base particle (C) can be analyzed.

In this regard, it is preferred that the amount of the rutile-anatase type titanium oxide liberated from the toner particles that can be measured in this way (that is, a rate of the free external additive among the rutile-anatase type titanium oxide contained in the toner) is preferably in the range of 0.1 to 5.0 wt %, and more preferably 0.5 to 3.0 wt %. If the rate of the free external additive is too small, there is a case that the function as the micro carriers described in the above may not be sufficiently exhibited. On the other hand, if the rate of the free external additive exceeds the above upper limit value, the free external additive adheres to toner contact members, thus resulting in the case that filming is likely to occur.

The toner of the present invention manufactured in such a manner as described above has a uniform shape and a sharp particle size distribution (width of the particle size distribution is narrow). In particular, in the present invention, it is possible to obtain toner particles having relatively high roundness.

Specifically, it is preferred that the average roundness R represented by the following equation (1) of the toner (toner powder) of the present invention is 0.91 to 0.98, and more preferably 0.93 to 0.98. If the average roundness R is less than 0.91, it becomes difficult to make a difference in the charging properties among individual toner particles small, thus resulting in a tendency that the developing property onto a photoreceptor is lowered. Moreover, if the average roundness R is too small, adherence (filming) of the toner to a photoreceptor tends to occur, thus leading to the case that the transfer efficiency of the toner is lowered. On the other hand, if the average roundness R exceeds 0.98, there is such a problem as the increase in the average particle size of the toner due to acceleration in granulation (joining of the particles) while the transfer efficiency and the mechanical strength of the toner are improved. Moreover, if the average roundness R exceeds 0.98, it becomes difficult to remove the toner attached to a photoreceptor or the like by cleaning.

The average roundness R is defined by $$R=L_0/L_1 \quad (1)$$

where $L_1$ (μm) is a circumferential length of a projected image of a toner particle which is an object to be measured, and $L_0$ (μm) is a circumferential length of a true circle (perfect geometrical circle) having an area equal to the area of the projected image of the toner particle which is an object to be measured.

Further, in the toner of the present invention, the standard deviation of the average roundness among individual particles is preferably 0.02 or less, more preferably 0.015 or less, and even more preferably 0.01 or less. When the standard deviation of the average roundness among the individual particles of the toner is 0.02 or less, variations in charging properties, fixing property, and the like become especially small, thereby improving the reliability of the toner as a whole.

Further, the average particle size of the toner is preferably in the range of 1 to 20 μm, and more preferably in the range of 3 to 10 μm. If the average particle size of the toner is less than the above lower limit value, the toner is hard to be uniformly charged, and the adherence of the toner to the surface of an electrostatic latent image carrier (photoreceptor, for example) becomes large, thus leading to a case where the amount of the toner remaining on the electrostatic latent image carrier after transferring is increased. On the other hand, if the average particle size of the toner exceeds the above upper limit value, the reproducibility in development of the edge portion of an image, especially an image of characters or a light pattern, formed by the toner is lowered.

Furthermore, in the toner of the present invention, the standard deviation of the particle size among individual particles is preferably 1.5 μm or less, more preferably 1.3 μm or less, and even more preferably 1.0 μm or less. When the standard deviation of the particle size among the individual particles of the toner is 1.5 μm or less, variations in charging properties, fixing property, and the like become especially small, thereby improving the reliability of the toner as a whole.

Moreover, it is preferred that the content of the polyester-based resin in the toner is in the range of 50 to 98 wt %, and more preferably in the range of 85 to 97 wt %. If the content of the polyester-based resin is less than the above lower limit value, there is a possibility that the effect of the present invention can not be sufficiently obtained. On the other hand, if the content of the polyester-based resin exceeds the above upper limit value, the content of the coloring agent or the like is relatively reduced, thus resulting in a case that it is difficult for a resultant toner to exhibit characteristics such as color rendering and the like.

Moreover, it is preferred that the composition (the constituent monomers, abundance ratio of the crystalline block, or the like), the weight average molecular weight Mw, the glass transition point, the softening point, and the melting point of the block polyester, and the composition (the constituent monomers or the like), the weight average molecular weight Mw, the glass transition point, and the softening point of the amorphous polyester included in the toner, are the same as the conditions or ranges of those as to the constituent materials of the dispersoid described above, but they may be changed during the manufacturing process.

Moreover, when a wax is included in the toner, its content is not particularly limited, but it is preferably 5 wt % or less, more preferably 3 wt % or less, and even more preferably in the range of 0.5 to 3 wt %. If the content of the wax is too high, liberated wax is generated and lumps of the wax are formed, and thereby conspicuous exudation of the wax to the surface of the toner or the like occurs, thus resulting in the case that it is difficult to sufficiently improve the transfer efficiency of the toner.

The acid value as a property of the toner is one of the factors that affect the environmental characteristics (moisture resistance, in particular) of the toner. In this connection, it is preferred that the acid value of the toner is 8 KOHmg/g or less, and more preferably 1 KOHmg/g or less. When the acid value of the toner is 8 KOHmg/g or less, the environmental characteristics (especially, moisture resistance) of the toner become especially excellent.

Further, in a case where the toner of the present invention is used in a fixing device having a fixing nip part as will be described later, it is preferred that the amount of change in the relaxation modulus G(t) during Δt (s) which is a time required for the toner particles to pass through the nip part is 500 (Pa) or less, and more preferably 100 (Pa) or less. When such a condition is satisfied, it is possible to obtain a toner having a characteristic that a disadvantage such as offset or the like is hard to occur.

Further, in a case where the toner of the present invention is used in a fixing device having a fixing nip part, it is preferred that the relation $G(0.01)/G(\Delta t) \leqq 10$ is satisfied, and it is more preferred that the relation $1 \leqq G(0.01)/G(\Delta t) \leqq 8$ is satisfied, and it is still more preferred that the relation $1 \leqq G(0.01)/G(\Delta t) \leqq 6$ is satisfied, where Δt (s) is a time required for the toner particles to pass through the fixing nip part, G(0.01) is the initial relaxation modulus of the toner at 0.01 s, and G(Δt) is the relaxation modulus of the toner at Δt (s). When such a relation is satisfied, reluctant separation of the toner and offset due to lowering in the elastic modulus of the toner particles are hard to occur. In contrast, if G(0.01)/G(Δt) exceeds 10, reluctant separation of the toner and offset become likely to occur. In this regard, it is to be noted that the relaxation modulus of the toner can be regulated, for example, by the composition of constituent materials of the toner (for example, the molecular weight, monomer component, and randomness of each of the block polyester and the amorphous polyester, the composition of each of the wax and the external additive, the content of each constituent component, or the like), and/or by conditions of manufacturing the toner (for example, velocity of the dispersion liquid when jetted, temperature and viscosity of the dispersion liquid to be jetted, atmospheric temperature, atmospheric pressure and conveying speed of the dispersion liquid in the solidifying section, material temperature and kneading time in the kneading process, and cooling rate of the kneaded material in the cooling process).

In the toner of the present invention, crystals mainly composed of the crystalline blocks of the block polyester normally exist.

In this connection, it is preferred that such a crystal has an average length (average length in the longitudinal direction) of 10 to 1,000 nm, and more preferably 50 to 700 nm. When the length of the crystal lies in such a range, stability of the toner shape becomes especially excellent, and especially excellent stability to mechanical stress is exhibited. In particular, since the external additive is held more firmly (capable of effectively preventing embedding of the external additive in the base particles) in the vicinity of the surface of the toner particles, stability of the toner particles in the developing device or the like becomes especially excellent, and filming or the like is difficult to occur. In this regard, it is to be noted that the size of the crystals can be adjusted suitably, for example, by modifying the randomness or the molecular weight of the block polyester through control of the manufacturing conditions or the like of the block polyester used as the material component, or modifying the compounding ratio between the block polyester and the amorphous polyester, or modifying the conditions of the kneading process and the cooling process described in the above.

In particular, in a case where the toner includes the rutile-anatase type titanium oxide, when the average major axial diameter of the nearly fusiform rutile-anatase type titanium oxide is defined as $D_1$ (nm) and the average length of the crystals is defined as $L_c$ (nm), it is preferred that $D_1$ and $L_c$ satisfy the relation $0.01 \leqq D_1/L_c \leqq 2$, and it is more preferred that they satisfy the relation $0.02 \leqq D_1/L_c \leqq 1$. When such a relation is satisfied, the rutile-anatase type titanium oxide is hard to be embedded in the base particles while sufficiently exhibiting the effect described above. As a result, a resultant toner can sufficiently hold the function described above and exhibit especially excellent stability to mechanical stress.

The average length of the crystals can be measured using a transmission electron microscope (TEM), a small angle X-ray scattering measurement, or the like.

Moreover, it is preferred that the toner of the present invention is composed of block polyester and amorphous polyester which are made soluble with each other as sufficiently as possible. This makes it possible to provide a toner in which a variation in properties among the toner particles is small and properties of the toner as a whole are more stabilized, thereby enabling the effect of the present invention to make more conspicuous.

Moreover, it is preferred that the present invention is applied to a toner of nonmagnetic single component system. Generally, a toner of a nonmagnetic single component system is applied to an image forming apparatus having a regulating blade as will be described later. Accordingly, when the toner of the present invention which has high resistance to mechanical stress is used as a nonmagnetic single component toner, it is possible to exhibit the effect described above more conspicuously.

Moreover, although the fixing device to which the toner of the present invention is applicable is not particularly limited, such a fixing device is preferably a contact type fixing device as will be described later. In a case where the toner of the present invention is used in a contact type fixing device, both advantages of high releasability from the fixing roller due to the crystals of the block polyester, and enhanced effect of the fixing property (fixing strength) due to the low viscosity amorphous polyester can be sufficiently exhibited, thereby ensuring a wide temperature range in which a good fixing property is achieved.

Next, the fixing device and the image forming apparatus according to the present invention will be described.

Figure 18:
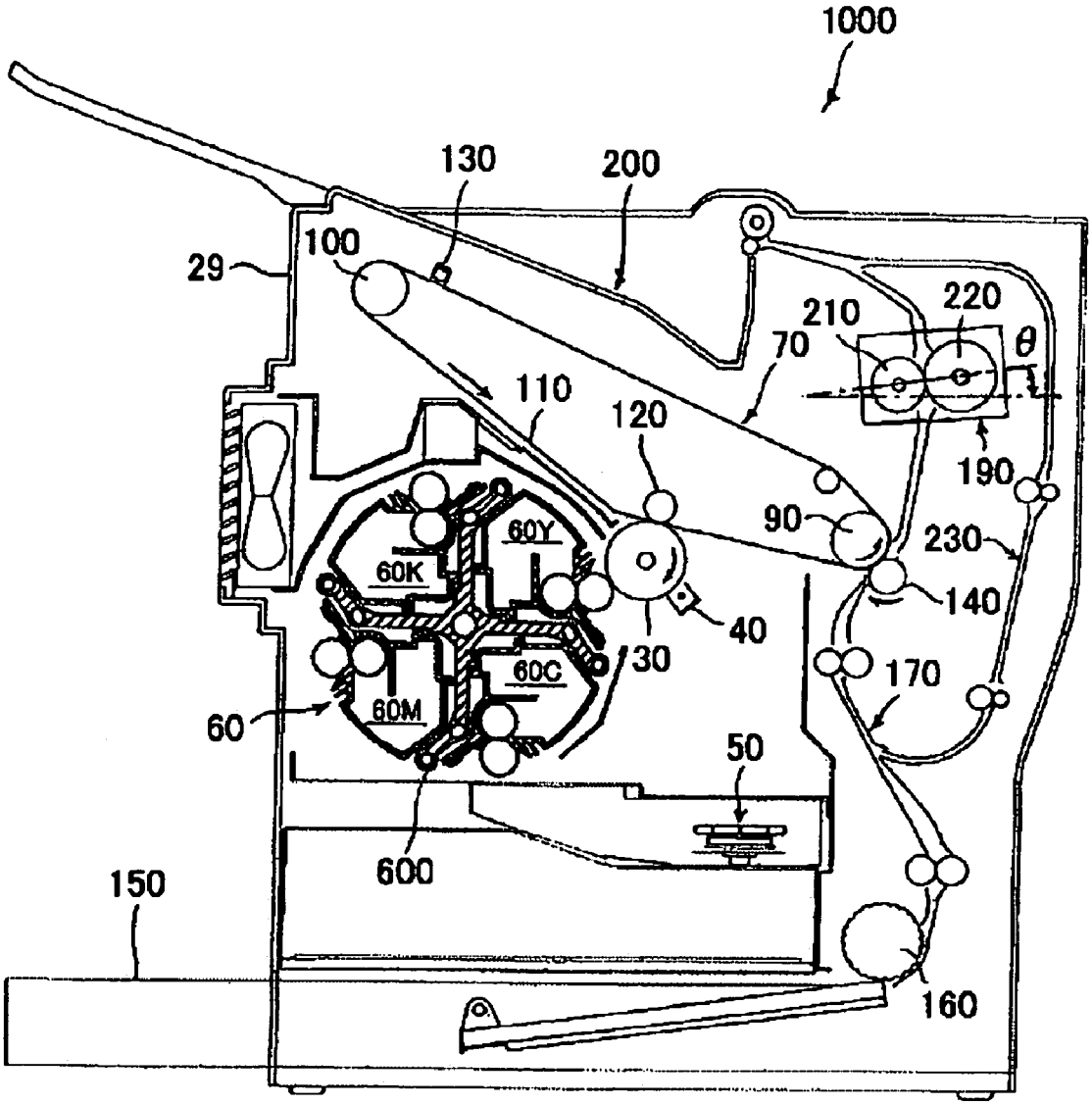
FIG. 18 is a sectional view which schematically shows an overall structure of a preferred embodiment of the image forming apparatus according to the present invention.
Figure 19:
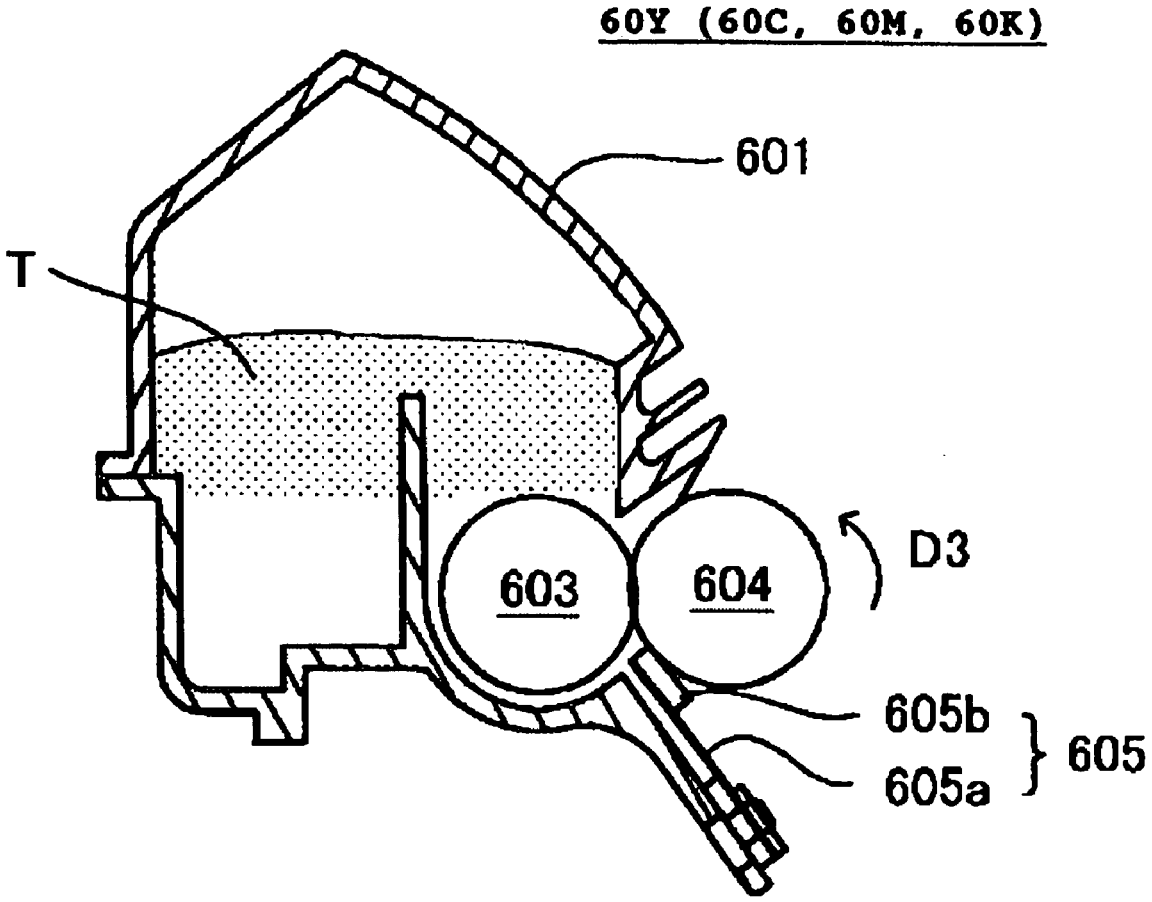
FIG. 19 is a sectional view of a developing device arranged in the image forming apparatus shown in FIG. 18.
Figure 20:
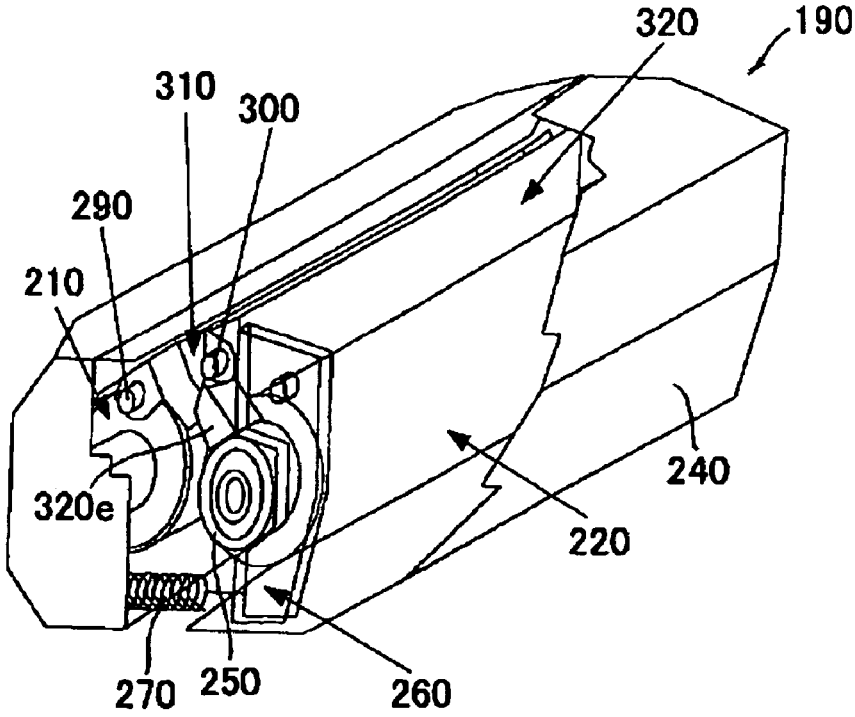
FIG. 20 is a perspective view, with a partial cut-out section, showing a detailed structure of the fixing device of the present invention used in the image forming apparatus shown in FIG. 18.
Figure 21:
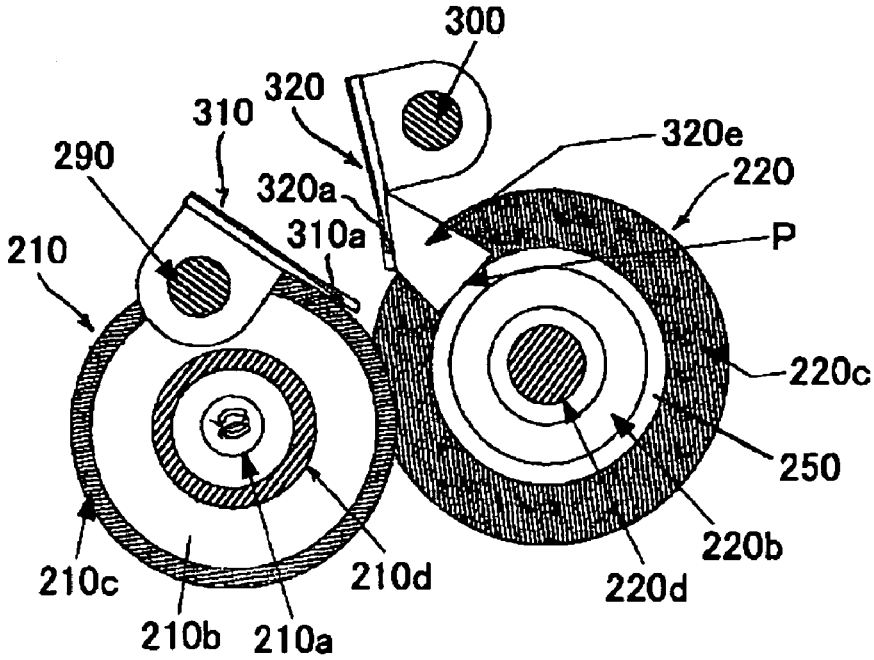
FIG. 21 is a cross-sectional view of an important part of the fixing device shown in FIG. 20.
Figure 22:
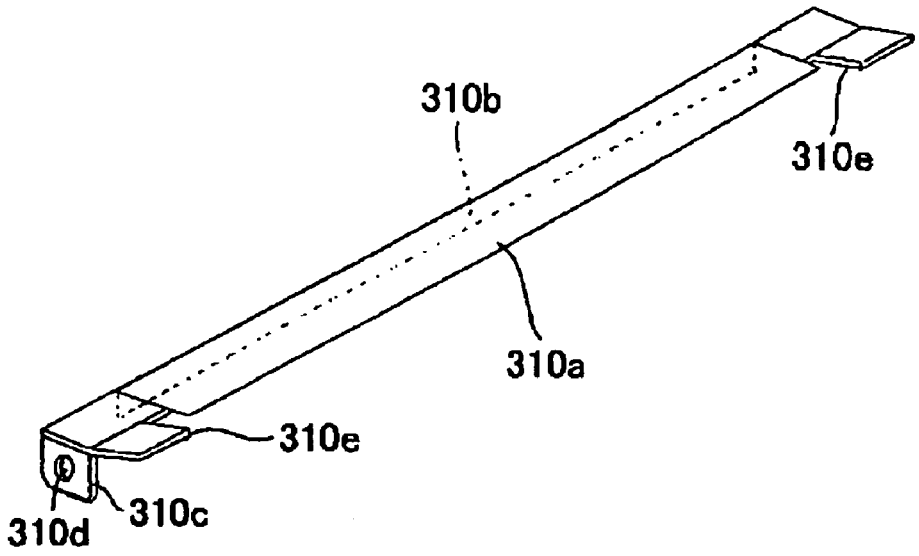
FIG. 22 is a perspective view of a release member of the fixing device shown in FIG. 20.
Figure 23:
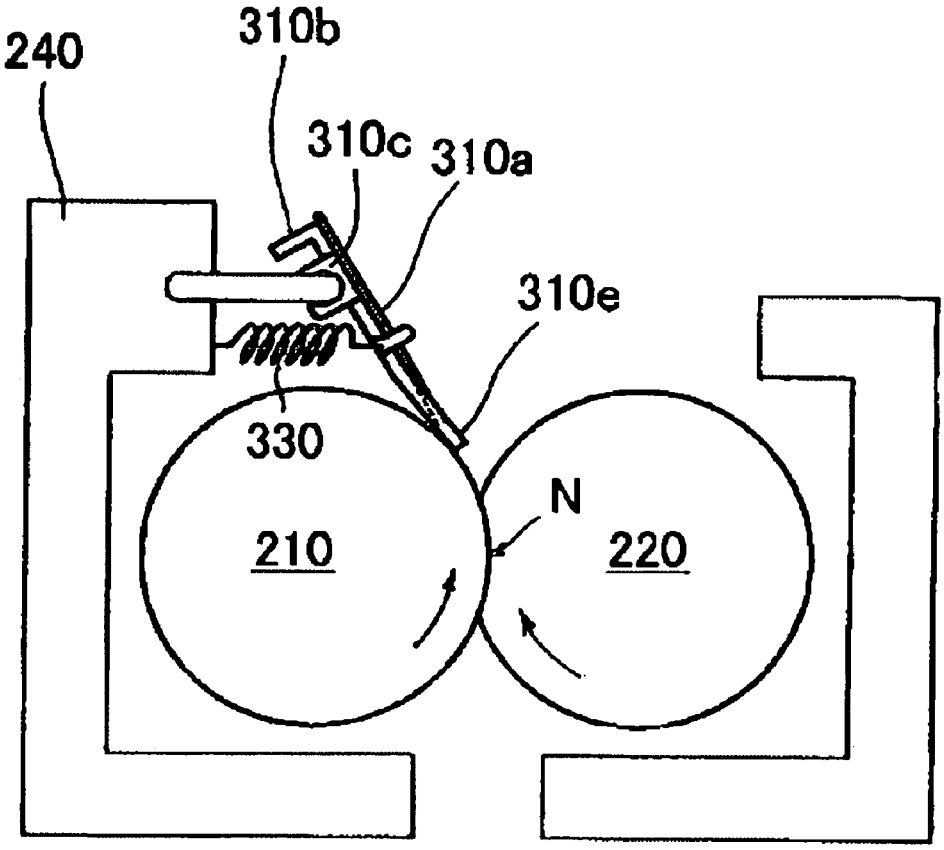
FIG. 23 is a side view which shows a state that the releasing member is mounted to the fixing device shown in FIG. 20.
Figure 24:
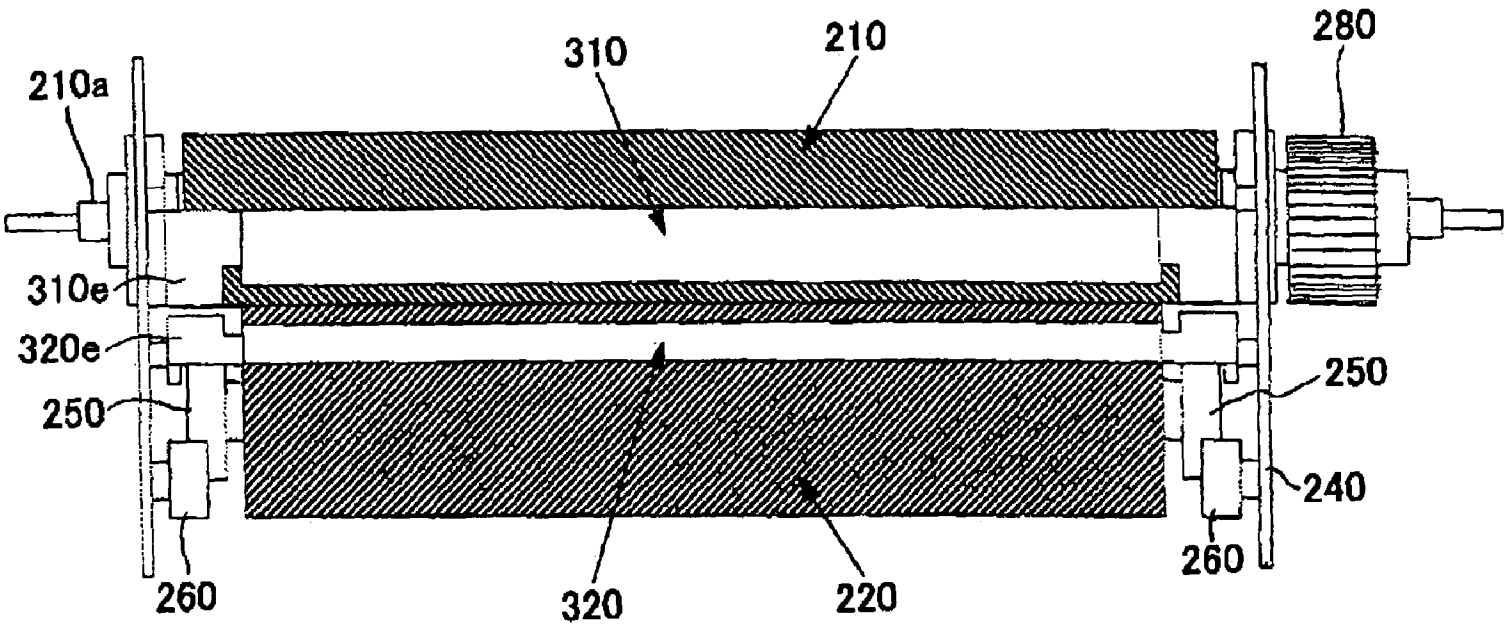
FIG. 24 is a front view as seen from the top of the fixing device shown in FIG. 20.
Figure 25:
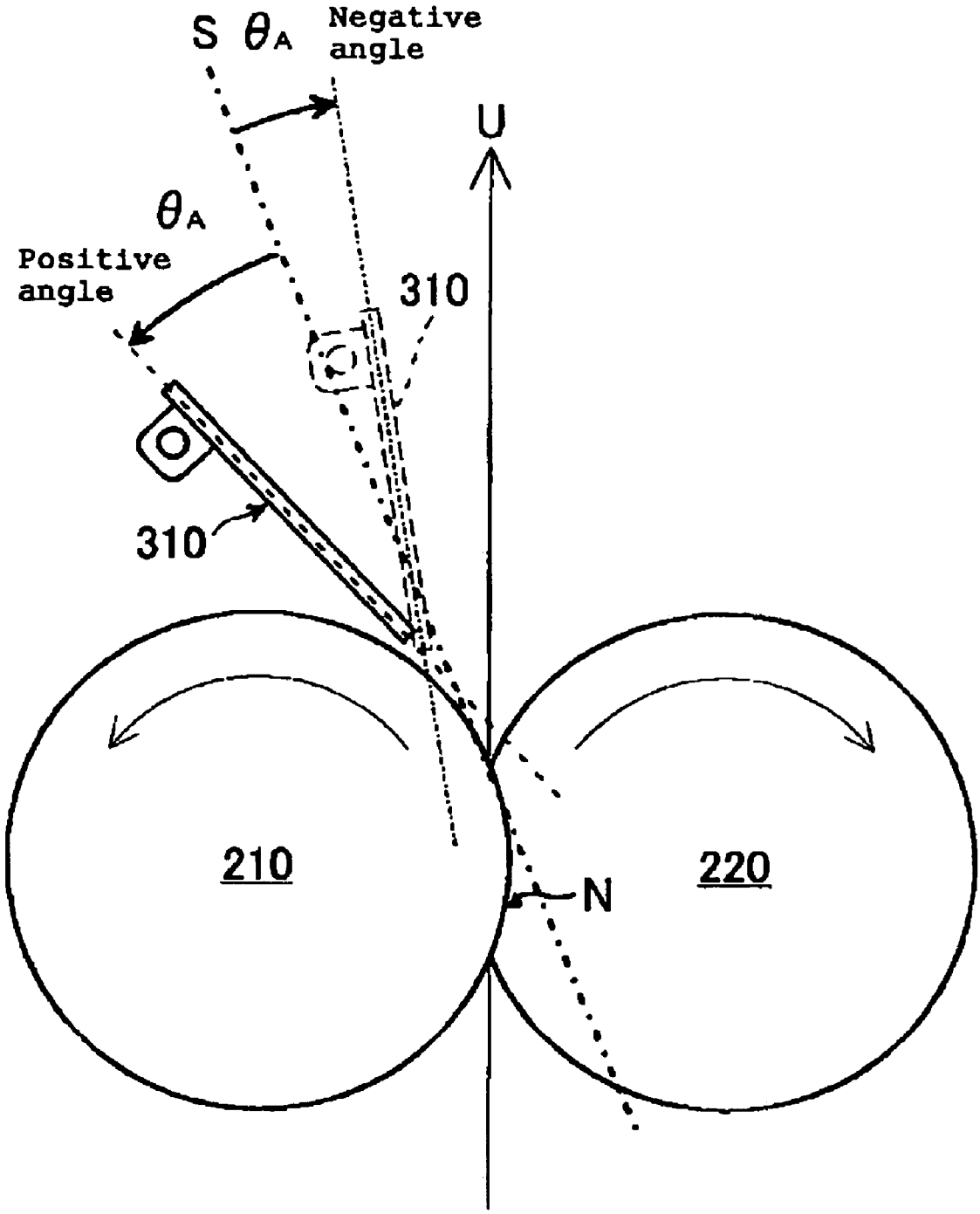
FIG. 25 is a schematic view for explaining the arrangement angle of the release member with respect to the tangent at the exit of a nip part.
Figure 26:
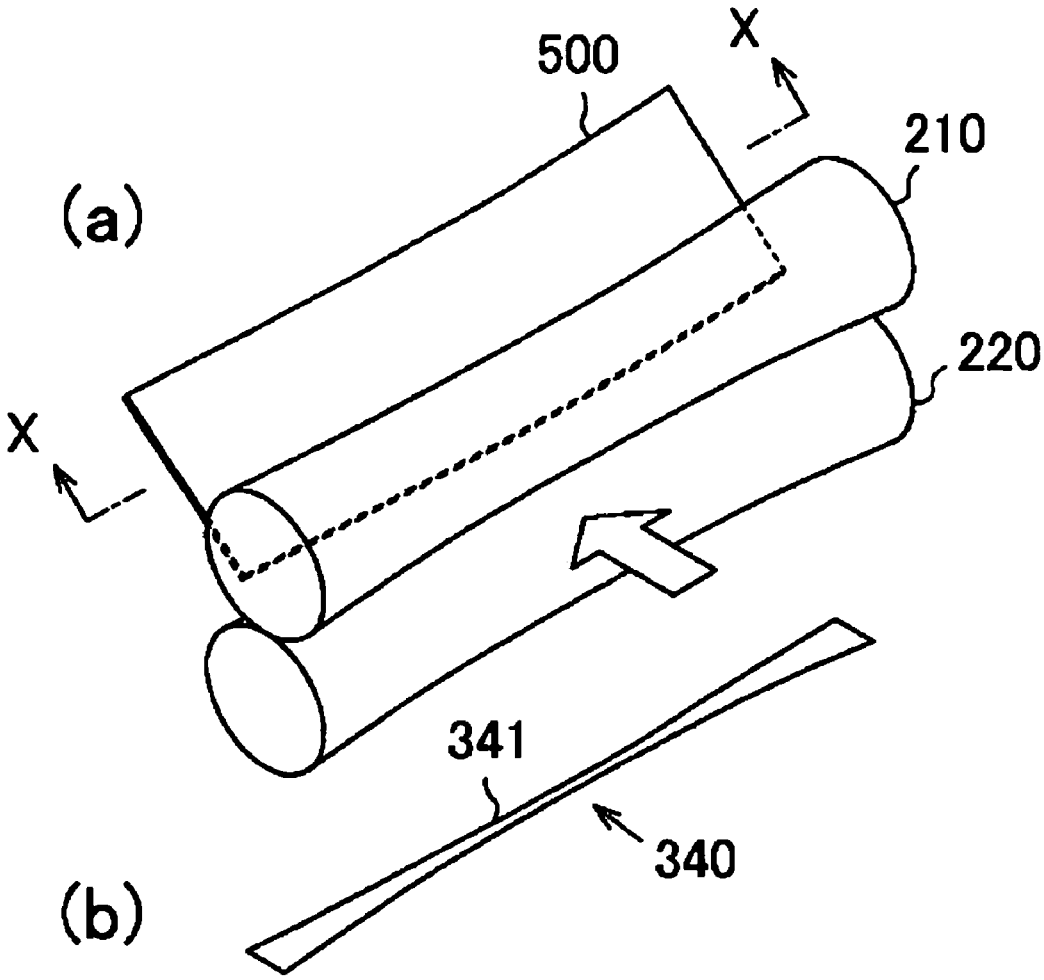
FIG. 26 is an illustration which schematically shows the shapes of a fixing roller and a pressure roller (FIG. 26(*a*)) and the shape of the nip part (FIG. 26(*b*))
Figure 27:
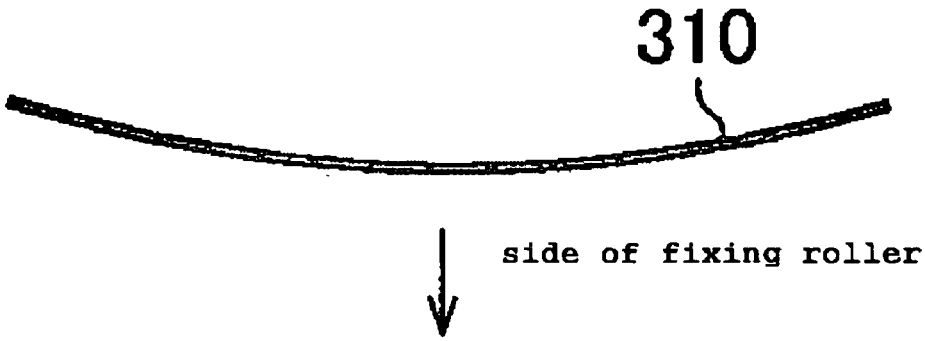
FIG. 27 is a sectional view taken along the line X—X in FIG. 26(*a*)
Figure 28:
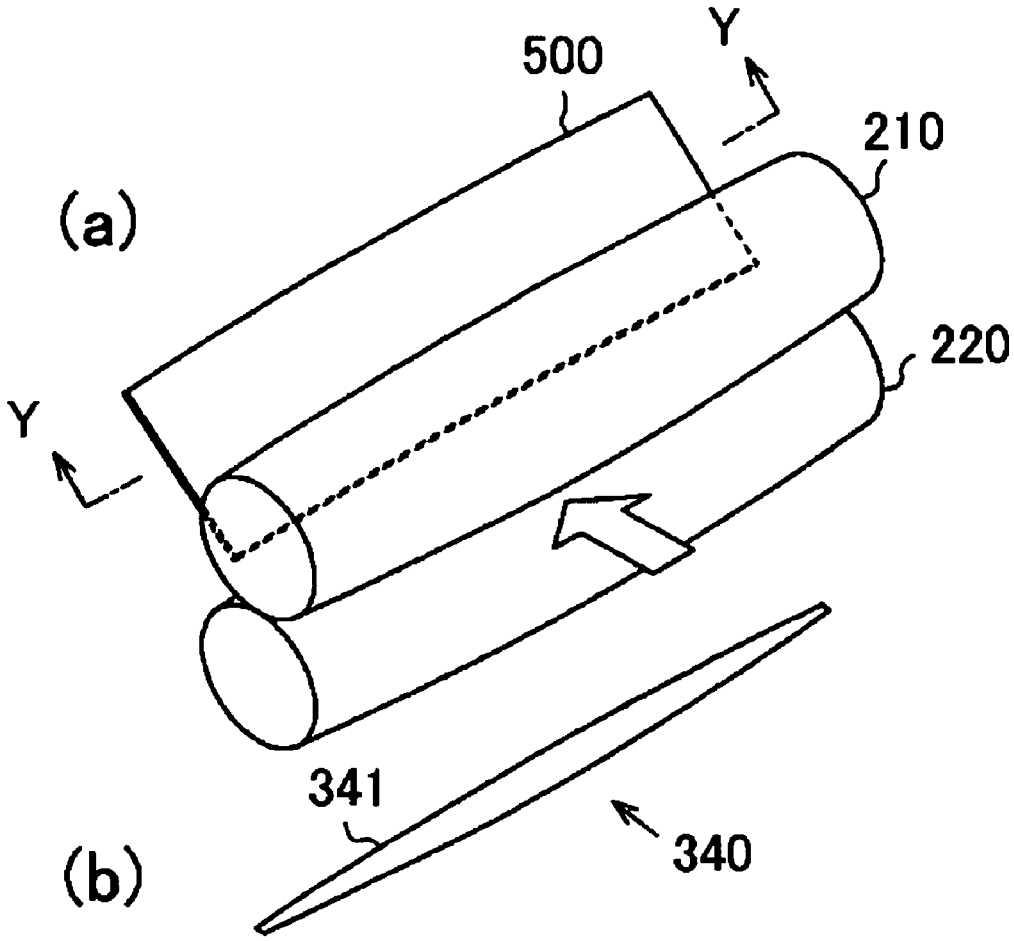
FIG. 28 is an illustration which schematically shows the shapes of a fixing roller and a pressure roller (FIG. 28(*a*)) and the shape of a nip part (FIG. 28(*b*))
Figure 29:
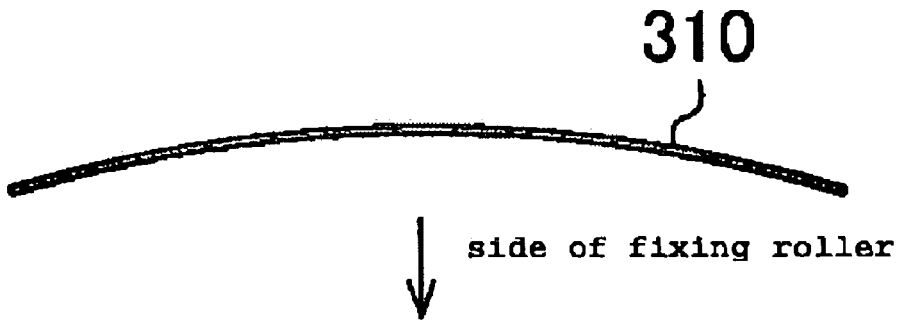
FIG. 29 is a sectional view taken along the line Y—Y in FIG. 28(*a*)
Figure 30:
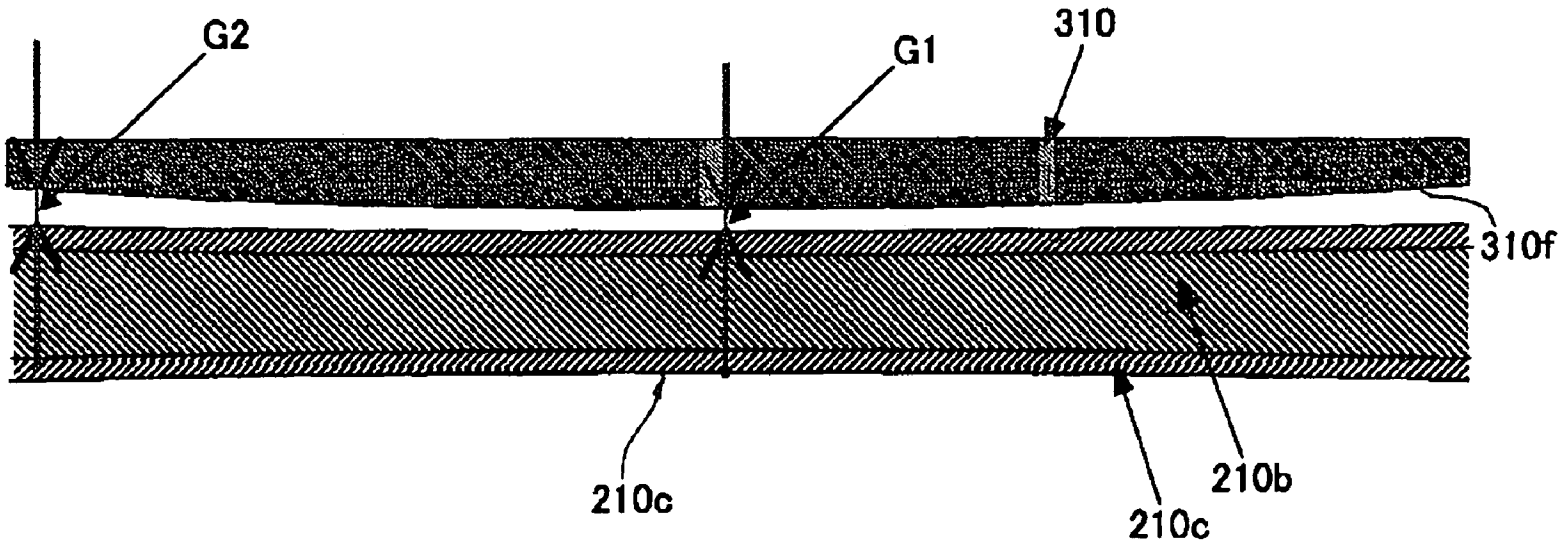
FIG. 30 is a sectional view for explaining the gap between the fixing roller and the release member.

FIG. 18 is a sectional view which schematically shows an overall structure of a preferred embodiment of the image forming apparatus according to the present invention, FIG. 19 is a sectional view of a developing device arranged in the image forming apparatus shown in FIG. 18, FIG. 20 is a perspective view, with a partial cut-out section, showing a detailed structure of the fixing device of the present invention used in the image forming apparatus shown in FIG. 18, FIG. 21 is a cross-sectional view of an important part of the fixing device shown in FIG. 20, FIG. 22 is a perspective view of a release member of the fixing device shown in FIG. 20, FIG. 23 is a side view which shows a state that the releasing member is mounted to the fixing device shown in FIG. 20, FIG. 24 is a front view as seen from the top of the fixing device shown in FIG. 20, FIG. 25 is a schematic view for explaining the arrangement angle of the release member with respect to the tangent at the exit of a nip part, FIG. 26 is an illustration which schematically shows the shapes of a fixing roller and a pressure roller (FIG. 26(*a*)) and the shape of the nip part (FIG. 26(*b*)), FIG. 27 is a sectional view taken along the line X—X in FIG. 26(*a*), FIG. 28 is an illustration which schematically shows the shapes of a fixing roller and a pressure roller (FIG. 28(*a*)) and the shape of a nip part (FIG. 28(*b*)), FIG. 29 is a sectional view taken along the line Y—Y in FIG. 28(*a*), and FIG. 30 is a sectional view for explaining the gap between the fixing roller and the release member.

In a main body 29 of the image forming apparatus 1000, an image carrier 30 composed from a photoreceptor drum is arranged, and it is driven to be rotated in the direction indicated by the arrow by a drive means not shown. In the circumference of the image carrier 30, along its rotating direction, there are disposed a charging device (charger) 40 for uniformly electrifying the image carrier (photoreceptor) 30, an exposure device 50 for forming an electrostatic latent image on the image carrier 30, a rotary developing device 60 for developing the electrostatic latent image, and an intermediate transfer device 70 for primary transfer of a monochromatic toner image formed on the image carrier 30.

In the rotary developing device 60, a development unit 60Y for yellow, a development unit 60M for magenta, a development unit 60C for cyan, and a development unit 60K for black are mounted on a support frame 600, and the support frame 600 is driven to be rotated by a driving motor not shown. The plurality of development units 60Y, 60C, 60M and 60K are set to be rotated and moved such that a development roller 604 of one of the development units oppose selectively to the image carrier 30 for each rotation of the image carrier 30 (hereinafater, this position will be referred to as "development position"). In each of the development units 60Y, 60C, 60M and 60K, a toner housing part for housing each toner is provided.

The development units 60Y, 60C, 60M and 60K have the identical structure. Accordingly, hereinbelow, a description will be given only for the development unit 60Y. The structures and the functions of the remaining development units 60C, 60M and 60K are the identical to those of the development unit 60Y.

As shown in FIG. 19, the development unit 60Y has a housing 601 which contains a toner T therein. In the housing 601, there are provided a feed roller 603 and a development roller 604 which are rotatably supported by the housing 601 through their axes. When the development unit 60Y is positioned at the development position mentioned above, the development roller 604 that functions as a "toner carrier" is oppositely positioned with respect to the image carrier (photoreceptor) 30 with abutting on it or with a prescribed gap therebetween. The rollers 603 and 604 are rotated in the prescribed directions by being engaged with a rotation drive section (not shown) provided in the main body 29. The development roller 604 is formed into a cylindrical shape and made of a metal such as copper, stainless steel, aluminum, or an alloy thereof so that a development bias can be applied thereto.

Moreover, in the development unit 60Y, a regulating blade 605 for regulating the thickness of a toner layer formed on the surface of the development roller 604 to a prescribed thickness is arranged. The regulating blade 605 is constructed from a plate-like member 605*a* made of stainless steel or phosphor bronze, and an elastic member 605*b* made of rubber or resin material attached to the tip of the plate-like member 605*a*. The base end part of the plate-like member 605*a* is fixed to the housing 601 so that the elastic member 605*b* attached to the tip part of the plate-like member 605*a* is positioned on the further. upstream side than the base end part of the plate-like member 605*a* in the rotational direction D3 of the development roller 604.

The intermediate transfer device 70 comprises a drive roller 90, a driven roller 100, an intermediate transfer belt 110 driven in the direction indicated by the arrow by the both rollers, a primary transfer roller 120 arranged opposite to the image carrier 30 on the back side of the intermediate transfer belt 110, a transfer belt cleaner 130 which removes a residual toner on the intermediate transfer belt 110, and a secondary transfer roller 140 arranged opposite to the drive roller 90 for transferring a four-color (full-color) image formed on the intermediate transfer belt 110 onto a recording medium (paper or the like).

A paper feed cassette 150 is disposed on the bottom of the main body 29 so that the recording medium in the paper feed cassette 150 is conveyed to a paper discharge tray 200 via a pickup roller 160, a recording medium convey path 170, the secondary transfer roller 140, and a fixing device 190. In this figure, a reference numeral 230 represents a convey path for double-side printing.

Hereinbelow, the operation of the image forming apparatus 1000 having the above structure will be described. When an image formation signal is inputted from a computer (not shown), the image carrier 30, the development roller 604 of the developing device 60, and the intermediate transfer belt 110 are driven to be rotated. Then, the outer circumferential surface of the image carrier 30 is first charged uniformly by the charger 40, and then a selective exposure corresponding to the image information of a first color (yellow, for example) is carried out by the exposure device 50 on the outer circumferential surface of the image carrier 30 which is being uniformly charged, thereby forming an electrostatic latent image for yellow.

In the development unit 60Y, the two rollers 603 and 604 are rotated with being in contact with each other, so that an yellow toner is attached under pressure on the surface of the development roller 604, thereby forming a toner layer having a prescribed thickness on the surface of the development roller 604. Then, the elastic member 605*b* of the regulating blade 605 elastically abuts on the surface of the development roller 604 to regulate the toner layer on the surface of the development roller 604 to the prescribed thickness.

The development unit 60Y for yellow is turned to make the development roller 604 abut on the position of the latent image formed on the image carrier 30, to form a toner image of the electrostatic latent image for yellow on the image carrier 30. Then, the toner image formed on the image carrier 30 is transferred to the intermediate transfer belt 110 by the primary transfer roller 120. During this time, the secondary transfer roller 140 is being kept apart from the intermediate transfer belt 110.

The above process of the latent image formation, development and transfer, which are performed during one rotation of the image carrier 30 and the intermediate transfer belt 110, is repeated for a second, third and fourth color of the image formation signal, and toner images of the four colors corresponding to the content of the image formation signal are transferred on the intermediate transfer belt 110 in an overlapped manner. With the timing at which the full-color image reaches the secondary transfer roller 140, a recording medium is fed to the secondary transfer roller 140 from the conveying path 170. At this time, the secondary transfer roller 140 is pressed against the intermediate transfer belt 110 and a secondary transfer voltage is applied thereto, so that the full-color toner image formed on the intermediate transfer belt 110 is transferred onto the recording medium. Then, the toner image that has been transferred onto the recording medium is heated under pressure to be fixed by the fixing device 190. The toner remaining on the intermediate transfer belt 110 is removed by the transfer belt cleaner 130.

In the case of double-side printing, the recording medium which has come out of the fixing device 190 is switched back so as to have its trailing end become a leading end, and then it is fed to the secondary transfer roller 140 via the conveying path 230 for double-side printing. Then, a full-color toner image on the intermediate transfer belt 110 is transferred onto the recording medium, and then it is heated under pressure by the fixing device 190 to fix the image.

In the structure shown in FIG. 18, the fixing device 190 according to the present invention is constructed from a fixing roller 210 having a heat source and a pressure roller 220 which is made to be in contact under pressure with the fixing roller 210. Further, the fixing roller 210 and the pressure roller 220 are arranged so that the line connecting the rotation axis of the fixing roller 210 and the rotation axis of the pressure roller 220 form an angle θ with respect to the horizon. In this connection, it is to be noted that the angle θ satisfies the relation $0° \leqq \theta \leqq 30°$.

Next, a detailed description will be made with regard to the fixing device 190.

As shown in FIG. 20 and FIG. 24, the fixing roller 210 is provided in a housing 240 in a freely rotatable manner, and a drive gear 280 is mounted to one end of the fixing roller 210. Further, the pressure roller 220 is also arranged in the housing 240 in a freely rotatable manner so as to oppose the fixing roller 210. As shown in FIG. 24, the length of the pressure roller 220 in the axial direction is shorter than the length of the fixing roller 210 to create spaces at the both ends of the pressure roller 220, respectively. Bearings 250 are provided in the spaces, respectively, and the both ends of the pressure roller 220 are supported by the bearings 250, respectively. A pressure lever 260 is rotatably provided on each of the bearings 250. Further, as shown in FIG. 20, a pressure spring 270 is arranged between one end of the pressure lever 260 and the housing 240, respectively, by which the pressure roller 220 is being pressed against the fixing roller 210.

As shown in FIG. 21, the fixing roller 210 comprises a metallic cylindrical body 210*b* having in its inside a heat source 210*a* such as a halogen lamp, an elastic layer 210*c* formed of a silicone rubber or the like and provided on the outer periphery of the cylindrical body 210*b*, a surface layer (not shown) formed of fluororubber or fluorocarbon resin (for example, pertetrafluoroethylene (PTFE)) and coated on the surface of the elastic layer 210*c*, and a rotary shaft 210*d* fixed to the cylindrical body 210*b*.

The pressure roller 220 comprises a metallic cylindrical body 220*b*, a rotary shaft 220*d* fixed to the cylindrical body 220*b*, the bearings 250 rotatably supporting the axis of the rotary shaft 220*d*, an elastic layer 220*c* provided on the outer periphery of the cylindrical body 220*b* similar to the fixing roller 210, and a surface layer (not shown) formed of fluororubber or fluorocarbon resin and coated on the surface of the elastic layer 220*c*. The thickness of the elastic layer 210*c* of the fixing roller 210 is made extremely small as compared with the thickness of the elastic layer 220*c* of the pressure roller 220, by which a concave fixing nip part (nip part) 340, at which the pressure roller 220 is depressed, is formed.

As shown in FIG. 20 and FIG. 21, support stems 290 and 300 are provided on both side-faces of the housing 240, respectively. A release member 310 for the fixing roller 210 and a release member 320 for the pressure roller 220 are pivotally mounted on the support stems 290 and 300, respectively. With this arrangement, the release members 310 and 320 are disposed along the axial direction of the fixing roller 210 and the pressure roller 220 on the further downstream side than the fixing nip part 340 in the direction of conveying the recording medium.

As shown in FIG. 22 and FIG. 23, the release member 310 for the fixing roller 210 has a resin sheet or a metal sheet as the base material, and a fluorocarbon resin layer is formed on the surface of the base material. The release member 310 comprises a plate-like release part (base material) 310*a*, a bent part 310*b* provided on the rear side of the release part 310*a* and bent in an L-shape toward the fixing roller 210, support pieces 310*c* respectively provided on the both sides of the release part 310*a* and bent downward, engagement holes 310*d* formed in each of the support pieces 310*c*, and guide parts 310*e* provided on each of the support pieces 310*c* so as to extend frontward therefrom and positioned at the both sides of the release part 310*a*, respectively.

The release part 310*a* is arranged so as to be tilted toward the exit (nip exit 341) of the fixing nip part 340, and the tip of the release part 310*a* is positioned in non-contact with and adjacent to the fixing roller 210. The engagement hole 310*d* of each of the support pieces 310*c* is engaged with the corresponding support stem 290 as shown in FIG. 21. Each guide part 310*e* is biased against the housing 240 by a spring 330 such that the tip of the guide part 310*e* is abutting on the fixing roller 210. As a result, the gap between the tip of the release part 310*a* and the surface of the fixing roller 210 is kept to be constant for all times.

The release member 320 for the pressure roller 220 has substantially the same shape as that for the fixing roller 210. As shown in FIG. 20 and FIG. 21, the release member 320 is arranged so that the tip of the release part 320*a* is located on the further downstream side than the tip of the release part 310*a* in the direction of conveying the recording medium. Further, the tip of each of the guide parts 320*e* is in contact with the circumferential surface of the bearing 250 of the pressure roller 220 at a point P shown in FIG. 21 so that the gap between the tip of the release part 320*a* and the surface of the pressure roller 220 is kept to be constant for all times.

As described above, in this embodiment, as shown in FIG. 20 and FIG. 21, the release members 310 and 320 are disposed along the axial direction of the fixing roller 210 and the pressure roller 220 on the further downstream side than the fixing nip part 340 in the direction of conveying the recording medium. Further, the tip of the release member 310 for the fixing roller 210 is arranged so as to be tilted toward the exit of the nip part 340, and is positioned so as to be in non-contact with and adjacent to the fixing roller 210. Furthermore, the tip of the release member 320 for the pressure roller 220 is located on the further downstream side than the tip of the release member 310 for the fixing roller 210 in the direction of conveying the recording medium.

As shown in FIG. 23, the guide part 310*e* of the release member 310 for the fixing roller 210 is biased against the housing 240 by the spring 330 so that the tip of the guide part 310*e* is abutting on the fixing roller 210. As a result, the release member 310 is positioned with respect to the fixing roller 210 so that the gap between the tip of the release part 310*a* and the surface of the fixing roller 210 is kept to be constant for all times.

As described above, the release member 320 for the pressure roller 220 has substantially the same shape as that for the fixing roller 210, and as shown in FIG. 20 and FIG. 21, the release member 320 is arranged so that the tip of the release part 320*a* is located on the further downstream side than the tip of the release part 310*a* in the direction of conveying the recording medium. Further, the tip of each of the guide parts 320*e* is in contact with the circumferential surface of the bearing 250 of the pressure roller 220 at a point P shown in FIG. 21 so that the gap between the tip of the release part 320*a* and the surface of the pressure roller 220 is kept to be constant for all times. Further, as described above, the length of the pressure roller 220 in the axial direction is shorter than the length of the fixing roller 210 to create spaces at the both ends of the pressure roller 220, respectively, and as shown in FIG. 24, the bearings 250 are provided in the spaces, respectively, and the both ends of the pressure roller 220 are supported by the bearings 250, respectively.

In the case of double-side printing, the recording medium printed on its one side is switched back so as to have its trailing end become the leading end after being released by the release member 310 for the fixing roller 210. The recording medium is then fed to the secondary transfer roller 140 via the conveying path 230 for double-side printing. Then, a full-color toner image on the intermediate transfer belt 110 is transferred onto the recording medium, and it is heated under pressure by the fixing roller 210 to fix the image. At this time, the recording medium which adheres to and is wound around the pressure roller 220 is released by the release member 320 for the pressure roller 220.

As described above, in the fixing device according to this embodiment, the release members are provided adjacent to the fixing roller and the pressure roller along the axial direction of the fixing roller and the pressure roller on the further downstream side than the fixing nip part in the direction of conveying the recording medium. Further, the positioning of the release member for the fixing roller is carried out by the surface of the fixing roller, and the positioning of the release member for the pressure roller is carried out by the surface of the bearing, so that it is possible to improve the releasability of the recording medium from the fixing roller and the pressure roller.

Further, in this embodiment, as shown in FIG. 25, the fixing roller 210 and the pressure roller 220 are arranged almost in the horizontal state, which adopts the system in which the recording medium 500 is fed upward from the fixing nip part 340. In this case, it is preferred that the arrangement angle $\theta_A$ of the release member 310 with respect to a tangent S at the nip exit 341 of the fixing nip part 340 is set to be in the range of −5 to 25°. By setting the arrangement angle $\theta_A$ of the release member 310 with respect to the tangent S at the nip exit 341 of the fixing nip part 340 to a value in such a range, it is possible to avoid the appearance of streaks in the image, and improve releasability. Here, it is preferred that the arrangement angle $\theta_A$ is measured on the basis of the positive angle on the fixing roller side and the negative angle on the pressure roller side.

Moreover, each of the fixing roller 210 and the pressure roller 220 may have such a shape that its external diameter is nearly constant along the axial direction (that is, a nearly cylindrical shape). However, each of them may have such a shape that its external diameter is small in the vicinity of the both ends thereof and large in the vicinity of the central part thereof (that is, the so-called crown shape), or may have such a shape that its external diameter is large in the vicinity of the both ends thereof and small in the vicinity of the central part thereof (that is, the so-called reverse crown shape).

For example, in a case where each of the fixing roller 210 and the pressure roller 220 has, for example, the reverse crown shape as shown in FIG. 26, it is preferred that the release member 310 is formed so as to have the sectional shape as shown in FIG. 27. On the other hand, in a case where each of the fixing roller 210 and the pressure roller 220 has the crown shape as shown in FIG. 28, it is preferred that the release member 310 is formed so as to have the sectional shape as shown in FIG. 29.

As described above, when the release member 310 disposed along the fixing roller 210 has such a shape that is suited for the shape of the nip exit 341 of the nip part 340, the contact area between the side edge of the tip part 310*f* of the release member 310 for the fixing roller 210 and the recording medium is increased, so that it is possible to effectively prevent or suppress disadvantages caused by the concentration of a contact pressure between them at that part, such as winding of the recording medium, and occurrence of irregularity and streaks in the formed image, or the like.

Moreover, as shown in FIG. 30, in the fixing device 190, it is preferred that the gap G2 (μm) between the fixing roller 210 and the release member 310 in the vicinity of each end in the axial direction of the fixing roller 210, is larger than the gap G1 (μm) between the fixing roller 210 and the release member 310 in the vicinity of the central part in the axial direction of the fixing roller 210. When such a relation is satisfied, the following effect can be obtained.

Namely since the release member 310 is arranged through such a smaller gap with respect to the fixing roller 210 in the vicinity of the central part in its longitudinal direction, gap management can be simplified without lowering the releasability too much. Further, the manufacture of the fixing device 190 can also be facilitated. Further, even when the entry of foreign substances or paper jamming occurs, damage to the release member 310 and the fixing roller 210 will be minimized, so that durability and reliability of the release member 310 and the fixing roller 210 as well as durability and reliability of the fixing device 190 and the image forming apparatus 1000 can be improved. In this regard, it is to be noted that the relation between G1 and G2 as described above can be satisfied by, for example, forming the release member 310 in an arch shape, forming the tip part 310*f* of the release member 310 in an arch shape, or forming the fixing roller 210 into a crown shape.

In the fixing device as described above, it is preferable to set the length of the fixing nip part 340 such that the time required for the toner particles to pass through the fixing nip part is 0.02 to 0.2 second, and more preferably 0.03 to 0.1 second. By setting the time required for the toner particle to pass through the fixing nip part 340 to a value in such a range, it is possible to secure sufficient releasability of the fixing roller by raising the temperature of the toner to the melting point without excessively melting it.

Further, the fixing device 190 is constructed so as to be suited for high-speed printing (high-speed fixing and high-speed image formation). Specifically, it is preferred that the feed speed of the recording medium 500 is 0.05 to 1.0 m/s, and more preferably 0.2 to 0.5 m/s. Thus, according to the present invention, even when the toner is fixed to the recording medium 500 at a relatively high speed, it is possible to prevent the occurrence of streaks or irregularity in the image, and avoid defective release such as winding of the recording medium 500.

Furthermore, the temperature of the nip part 340 during the operation is preferably in the range of 100 to 220° C., and more preferably in the range of 120 to 200° C. When the temperature of the fixing nip part is set to such a range, it is possible to sufficiently prevent the fixing strength of the toner from being lowered due to temperature drop during the passing of the paper.

Moreover, it is preferred that the temperature for fixing (set temperature for the surface of the fixing roller 210) is in the range of 110 to 220° C., and more preferably 130 to 200° C. When the temperature of the fixing roller 210 is set to such a range, it is possible to achieve not only securing of the fixing strength of the toner but also reduction in the temperature raise time (warming-up time).

As described above, the fixing device 190 is constructed so as to be suited for high-speed printing (high-speed fixing and high-speed image formation). However, in such a fixing device, the toner is still at high temperature even when the recording medium on which the toner has been fixed makes contact with the release member. Therefore, if the conventional toner is used, there is a possibility that irregularity or streaks are produced in the fixed image through the contact with the release member. Further, if the fixed toner makes contact with the release member in a melted state (state of low viscosity), there is a possibility that it becomes difficult to surely release the recording medium.

However, the toner of the present invention can be preferably applied to such a fixing device 190 described above. Namely, since the toner of the present invention includes the amorphous polyester having a relatively low softening point, the toner can be surely fixed to the recording medium when it passes through the fixing nip part 340. Further, since the toner of the present invention includes the block polyester having crystalline blocks, crystals of high hardness and appropriate size tend to be precipitated within the toner. Because of the presence of such crystals, even at a relatively high temperature as at fixing, it is possible to prevent the melting viscosity of the toner from lowering below a predetermined value, thereby enabling relatively high hardness sites to be partially remained even during the fixing. As a result, even when the fixed image makes contact with the release member, it is possible to avoid irregularity or streaks from being produced in the formed image. Moreover, in the recording medium on which the toner of the present invention is fixed, defective release of the recording medium hardly occurs, and the recording medium can be surely released from the fixing roller by the release member.

In the foregoing, the method for manufacturing a toner, the toner, the fixing device and the image forming apparatus of the present invention were described based on the preferred embodiment, but the present invention is not limited to the embodiment described above.

For example, each of the components of the toner manufacturing device for use in manufacturing the toner of the present invention can be replaced with any component capable of exhibiting the same function, or can have another structure. For example, in the above, the embodiment having a structure for jetting the dispersion liquid in the form of particles (droplets 9) in the vertically downward direction has been described, but the direction in which the dispersion liquid is jetted may be any direction, for example vertically upward direction, horizontal direction, or the like. Further, the embodiment may have a structure in which the direction of the dispersion liquid 3 to be jetted is substantially perpendicular to the direction of the gas to be jetted from the gas outlet. In this case, the direction of travel of the dispersion liquid 3 (droplets 9) jetted in the form of particles is changed by the gas flow, so that the dispersion liquid 3 is conveyed in a direction at right angles to the direction to be jetted from the jetting port M2.

Further, the toner of the present invention is not limited to a toner manufactured by the above-described method. For example, in the above-described embodiment, the toner is manufactured by subjecting the powder obtained through the granulating process to the external additive addition treatment, but the powder obtained through the granulating process may be used as it is as the toner without subjecting it to the external additive addition treatment.

Moreover, in the embodiment described above, the rutile-anatase type titanium oxide is used as a component to be added as an external additive, but the rutile-anatase type titanium oxide may be used as one of the components of the material that is kneaded in the kneading process.

Moreover, in the embodiment described above, a description has been made with regard to ΔT obtained from the measurement of the endothermic peak at the melting point by the differential scanning calorimetry (DSC) as the index of crystallinity, but the index of crystallinity is not limited to this value. For example, as the index, crystallinity measured by the density method, X-ray method, infrared method, nuclear magnetic resonance absorption method, or the like may also be employed.

The powder obtained through the elimination of the dispersion medium from the dispersion liquid may be subjected to the thermal sphering treatment for sphering the powder by heating. This makes it possible for obtained toner particles to have higher roundness. In particular, in the present invention, since the toner contains the block polyester having the crystalline block, it is possible to sufficiently soften the amorphous polyester while keeping the shape stability of the powder (toner particles) at a certain level in the thermal spehring treatment. Therefore, in the present invention, it is possible to efficiently carry out the thermal sphering treatment as compared with a case where the material of the toner does not contain the block polyester, thereby enabling finally obtained toner (toner particles) to have relatively high roundness. As a result, the above-described effect by the thermal sphering treatment can be more effectively exhibited. In this connection, the thermal sphering treatment can be carried out by jetting the powder obtained through the elimination of the dispersion medium from the dispersion liquid (droplets 9) into a heated atmosphere using, for example, a compressed air, or the like. Alternatively, the thermal sphering treatment may be carried out in a liquid.

Moreover, in the embodiment described above, the continuous twin screw extruder is used as the kneading machine, but the kneading machine for use in kneading the material is not limited to this type. For kneading of the material, for example, other kind of kneading machines such as a kneader, batch type triaxial roll, continuous biaxial roll, wheel mixer or blade type mixer may be used.

Moreover, although the kneading machine shown in the drawings and used in the embodiment described above has two screws, the number of screws may be one or three or more.

Moreover, in the embodiment described above, the belt type cooling machine is used, but a cooling machine with rollers (cooling roll type cooling machine) may be used, for example. Further, cooling of the kneaded material extruded from the extrusion port of the kneading machine is not limited to the method using the cooling machine described above, and such cooling may be made through air-cooling, for example.

Moreover, the fixing device and the image forming apparatus of the present invention are not limited to those as in the embodiment, and the components of the fixing device and the image forming apparatus may be replaced with one or ones having other arbitrary structures that can exhibit the same or similar functions.

For example, in the above embodiment, a contact type fixing device is used, but the invention is not limited to such a contact type fixing device, and may be applied to a non-contact type fixing device.

EXAMPLE

<1> Preparation of Polyester

Prior to manufacture of a toner, the following five kinds of polyesters A, A', B, C, and D were prepared.

<1.1> Preparation of Polyester A (Amorphous Polyester)

First, a mixture containing 36 molar parts of neopentyl glycol, 36 molar parts of ethylene glycol, 48 molar parts of 1,4-cyclohexanediol, 90 molar parts of dimethyl terephthalate, and 10 molar parts of phthalic anhydride was prepared.

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of the mixture prepared in the above containing a diol component and a dicarboxylic acid component, and 1 g of a catalyst for esterification (condensation) (titanium tetrabutoxide(PPB)) were placed in the flask. Then, an esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 200° C. In such a state, a resultant reaction mixture in the flask was stirred at a number of revolution of 150 rpm to discharge free diol generated by the condensation reaction to the outside of the system. The thus obtained reaction product was defined as polyester A (PES-A).

For the obtained polyester A, measurement of an endothermic peak at a melting point using a differential scanning calorimeter was tried. However, it was not possible to detect a sharp peak which could be recognized as an absorption peak at a melting point. In this connection, the softening point $T_{1/2}$, the glass transition point $T_g$, and the weight average molecular weight Mw of the polyester A were 111° C., 60° C., and $1.3\times10^4$ respectively.

<1.2> Preparation of Polyester A' (Amorphous Polyester)

First, a mixture containing 96 molar parts of neopentyl glycol, 12 molar parts of ethylene glycol, 12 molar parts of 1,4-cyclohexanediol, and 100 molar parts of dimethyl terephthalate was prepared.

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of the mixture prepared in the above containing a diol component and a dicarboxylic acid component, and 1 g of a catalyst for esterification (condensation) (titanium tetrabutoxide (PPB)) were placed in the flask. Then, an esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 200° C. In such a state, a resultant reaction mixture in the flask was stirred at a number of revolution of 150 rpm to discharge free diol generated by the condensation reaction to the outside of the system. The thus obtained reaction product was defined as polyester A' (PES-A').

For the obtained polyester A', measurement of an endothermic peak at a melting point using a differential scanning calorimeter was tried. However, it was not possible to detect a sharp peak which could be recognized as an absorption peak at a melting point. In this connection, the softening point $T_{1/2}$, the glass transition point $T_g$, and the weight average molecular weight Mw of the polyester A' were 106° C., 58° C., and $1.5\times10^4$, respectively.

<1.3> Preparation of Polyester B (Block Polyester)

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of a mixture containing 70 molar parts of the polyester A obtained in the above <1.1>, 15 molar parts of 1,4-butanediol as a diol component, and 15 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 200° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 220° C. In such a state, a resultant reaction mixture in the flask was stirred at a number of revolution of 150 rpm to discharge free diol generated by the condensation reaction to the outside of the system. The thus obtained reaction product was defined as polyester B (PES-B).

For the obtained polyester B, measurement of an endothermic peak at a melting point was carried out using a differential scanning calorimeter. As a result, the central value $T_{mp}$ and the shoulder peak value $T_{ms}$ of the endothermic peak of the polyester B at its melting point were 218° C. and 205° C., respectively. Further, the heat of fusion $E_f$ of the polyester B determined from the differential scanning calorimetry curve obtained by the measurement was 18 mJ/mg. In this connection, the softening point $T_{1/2}$, the glass transition point $T_g$, and the weight average molecular weight Mw of the polyester B were 149° C., 64° C., and $2.8\times10^4$, respectively.

<1.4> Preparation of Polyester C (Block Polyester)

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of a mixture containing 90 molar parts of the polyester A obtained in the above <1.1>, 5 molar parts of 1,4-butanediol as a diol component and 5 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 200° C. In such a state, a resultant reaction mixture in the flask was stirred at a number of revolution of 150 rpm to discharge free diol generated by the condensation reaction to the outside of the system. The thus obtained reaction product was defined as polyester C (PES-C).

For the obtained polyester C, measurement of an endothermic peak at a melting point was carried out using a differential scanning calorimeter. As a result, the central value $T_{mp}$ and the shoulder peak value $T_{ms}$ of the endothermic peak of the polyester C at its melting point were 195° C. and 182° C., respectively. Further, the heat of fusion $E_f$ of the polyester C determined from the differential scanning calorimetry curve obtained by the measurement was 8 mJ/mg. In this connection, the softening point $T_{1/2}$, the glass transition point $T_g$, and the weight average molecular weight Mw of the polyester C were 122° C., 63° C., and $2.5\times10^4$, respectively.

<1.5> Preparation of Polyester D (Not Block Polyester but Polyester Having High Crystallinity)

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of a mixture containing 50 molar parts of 1,4-butanediol as a diol component, and 60 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 260° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 280° C. In such a state, the resultant reaction mixture in the flask was stirred at a number of revolution of 150 rpm to discharge free diol generated by the condensation reaction to the outside of the system. The thus obtained reaction product was defined as polyester D (PES-D).

For the obtained polyester D, measurement of an endothermic peak at a melting point was carried out using a differential scanning calorimeter. As a result, the central value $T_{mp}$ and the shoulder peak value $T_{ms}$ of the endothermic peak of the polyester D at its melting point were 228° C. and 215° C., respectively. Further, the heat of fusion $E_f$ of the polyester D determined from the differential scanning calorimetry curve obtained by the measurement was 35 mJ/mg. In this connection, the softening point $T_{1/2}$, the glass transition point $T_g$, and the weight average molecular weight Mw of the polyester D were 180° C., 70° C., and $2.0\times10^4$, respectively.

In this regard, it is to be noted that measurement of the melting point, the softening point, the glass transition point, and the weight average molecular weight for each of the resin materials described above was carried out as follows.

The melting point $T_m$ was measured using a differential scanning calorimeter DSC ("DSC 220" which is a product of Seiko Instruments Inc.). First, a resin sample was heated to 200° C. at a temperature rise rate of 10° C./min, and was cooled to 0° C. at a temperature drop rate of 10° C./min. Then, the resin sample was again heated at a temperature rise rate of 10° C./min, and the maximum peak temperature on an endothermic peak obtained by crystal fusion at that time (at the second run) was defined as a melting point $T_m$.

The softening point $T_{1/2}$ was measured using a capillary rheometer ("flowmeter CFT-500" which is a product of Shimadzu Manufacturing Co.). Specifically, 1 g of sample was prepared, and was extruded under the conditions of a die hole diameter of 1 mm, a die length of 1 mm, a load of 20 kgf, a pre-heating time of 300 seconds, a measurement start temperature of 50° C., and a temperature rise rate of 5° C./min, and a temperature at the time when the amount of travel of a piston was ½ of the total amount of travel of the piston between the time when the sample was started to flow and the time when the flow of the sample was completed (that is a temperature determined by the bisection method) was defined as a softening point $T_{1/2}$ (see FIG. 3).

The glass transition point $T_g$ was measured using a differential scanning calorimeter DSC ("DSC 220" which is a product of Seiko Instruments Inc.), which was simultaneously carried out with the measurement of the melting point. A temperature at the intersection point between the tangent of the maximum differential value between a designated point on a base line before glass transition and a designated point on a base line after glass transition (that is a point having the maximum gradient on the DSC data), and the extension of the base line before glass transition, at the second run described above was defined as a glass transition point $T_g$.

The weight average molecular weight Mw was measured according to gel permeation chromatography (GPC) by the use of "HLC-8220" (which is a product of TOSOH CORPORATIION) as follows.

First, 1 g of a resin sample was dissolved in tetrahydrofuran (THF) to obtain 1 ml of THF solution (including undissolved component). The THF solution was poured into a sample bottle for centrifugation, and was subjected to centrifugal separation under the conditions of 2,000 rpm and for 5 minutes. The thus obtained supernatant was filtered by Samprep LCR13-LH (pore diameter: 0.5 μm) to obtain filtrate.

The thus obtained filtrate was separated by gel permeation chromatography using an apparatus for GPC ("HLC-8220" which is a product of TOSOH CORPORATION) and a column ("TSKgel SuperHZ4000+SuperHZ4000" which is a product of TOSOH CORPORATION) under the conditions of a flow rate of 0.5 mL/min, a temperature of 25° C., and a solvent of THF to obtain a chart. Based on the chart, the weight average molecular weight Mw of the resin sample was determined. In this connection, a used standard sample was monodisperse polystyrene.

<2> Manufacture of Toner

A toner was manufactured as follows.

Example 1

First, 80 parts by weight of the polyester A as amorphous polyester, 20 parts by weight of the polyester B as block polyester, 6 parts by weight of quinacridon (P.R. 122) as a coloring agent, 1 part by weight of chromium salicylate complex (Bontron E-81) as a charge control agent, and 2 parts by weight of carnauba wax as a wax were prepared.

These components were mixed using a 20 liter type Henschel mixer to obtain a material for manufacturing a toner.

Next, the material (mixture) was kneaded using a twin screw extruder (kneader) ("TEM-41" which is a product of Toshiba Machine Co., Ltd.) as shown in FIG. 1.

The entire length of the process section, the length of the first region, the length of the second region, and the length of the third region of the twin screw extruder were set to 160 cm, 32 cm, 80 cm, and 16 cm, respectively.

The temperature of the process section was set such that the temperatures of the material in the first region, second region, and third region were 240° C., 100° C., and 100° C., respectively.

The rotational speed of the screws was set to 120 rpm, and the charging rate of the material was set to 20 kg/hr.

The time required for the material to pass through the first region and the time required for the material to pass through the second region determined based on the conditions described above were about 1.5 minutes and 3 minutes, respectively.

The material which has been kneaded in the process section (kneaded material) was extruded to the outside of the twin screw extruder through the head section. The temperature of the kneaded material in the head section was adjusted to be 110° C.

The kneaded material which has been extruded from the extrusion port of the twin screw extruder was cooled using a cooling machine as shown in FIG. 1. The temperature of the kneaded material just after cooling was about 46° C.

The cooling rate of the kneaded material was −7° C./s. In this connection, the length of time from the completion of the kneading process to the completion of the cooling process was 10 seconds.

The kneaded material which has been cooled in such a manner was roughly ground using a hammer mill into a powder having an average particle size of 1.5 mm.

The thus obtained 200 g of kneaded material in powder form was added to 800 g of toluene, and then they were subjected to an ultrasonic homogeneizer (output: 400 μA) for 1 hour, thereby obtaining a resin solution in which various components of the kneaded material were dispersed or soluble.

On the other hand, 1,000 parts by weight of an aqueous solution containing 5 parts by weight of sodium polyacrylate (which is available from Wako Pure Chemical Industries, Ltd. and has an average degree of polymerization "n" in the range of 2,700 to 7,500) as a dispersant was prepared. Then, 0.5 part by weight of sodium alkyl diphenyl ether disulfonate (available from Wako Pure Chemical Industries, Ltd.) was added as a dispersion aid to the aqueous solution prepared in the above, and they were homogeneously mixed to obtain an aqueous solution.

The thus obtained 1,000 g of aqueous solution was placed in a 3-liter round-bottomed stainless steel vessel. The above-described resin solution was dropped little by little at a rate of 400 g/10 min into the aqueous solution while the aqueous solution was being stirred with a TK homomixer (which is a product of Tokushu Kika Kogyo K.K) at a number of revolutions of 4,000 rpm.

The thus obtained mixture was further stirred for 10 minutes after the completion of the dropping of the resin solution, thereby obtaining an emulsion. Thereafter, the toluene contained in the emulsion was eliminated under the conditions of a temperature of 55 to 58° C. and an ambient pressure of 150 to 80 mmHg, and then the emulsion was cooled to room temperature to obtain a water-based suspension in which solid fine particles were dispersed. The viscosity of the suspension at 25° C. was 15 MPa·s, and the solid content (dispersoid) thereof was 30.8 wt %. The average particle size of the dispersoid (solid fine particles) dispersed in the suspension was 0.4 μm. In this connection, the average particle size of particles of the dispersoid was measured using a laser scattering particle size distribution analyzer ("LA-920" which is a product of HORIBA, Ltd.).

The thus obtained suspension (dispersion liquid) was placed in the dispersion liquid feeder of the toner manufacturing device having the structure shown in FIGS. 4 and 5. The dispersion liquid was supplied to the nozzle using a metering pump while being stirred, and was then jetted into the solidifying section from the nozzle. In this connection, the temperature of the dispersion liquid in the dispersion liquid feeder was adjusted to 25° C.

The dispersion liquid was jetted by spraying it at 20 ml/min with a compressed air having a pressure of 0.7 MPa.

In this connection, the initial velocity of the dispersion liquid at the time when jetted from the nozzle was 4.2 m/s, and the average amount of one drop of the particle of the dispersion liquid jetted from the nozzle was 0.38 pl (diameter of particle Dd: 9.2 μm). The dispersion liquid was jetted in such a manner that at least adjacent nozzles among the plurality of nozzles jetted the dispersion liquid at different times.

Further, when the dispersion liquid was jetted, air was injected from a gas injecting port (not shown) provided between the nozzles at a flow rate of 0.9 $m^3$/min in the vertical downward direction. In this connection, the temperature and the humidity of the air were 130° C. and 30% RH, respectively. The pressure in the housing was adjusted to 0.109 to 0.110 Pa. Further, a voltage was applied to the housing of the solidifying section so that the electric potential of the internal surface thereof was −200V to prevent the dispersion liquid (toner particles) from being attached to the internal surface.

In the solidifying section, the dispersion medium was eliminated from the jetted dispersion liquid, and then particles were formed as the agglomerations of the particles of the dispersoid.

The thus formed particles in the solidifying section were collected by a cyclone. The collected particles have an average roundness R of 0.974, and a standard deviation of the roundness of 0.026. The average particle size Dt on weight basis was 5.8 μm. The standard deviation of the particle size on weight basis was 1.12. In this connection, the circulality was measured in water dispersion system using a flow particle image analyzer ("FPIA-2000" which is a product of Sysmex Corporation). The average circulality was determined by the following formula (I).

$$R=L_0/L_1 \quad \text{(I)}$$

(where, $L_1$ (μm) is a circumferential length of a projected image of a particle which is an object to be measured, and $L_0$ (μm) is a circumferential length of a true circle having an area equal to the area of the projected image of the particle which is an object to be measured.)

Thereafter, 100 parts by weight of the obtained particles and 2.5 parts by weight of an external additive were mixed using a 20 liter type Henschel mixer, to thereby obtain a toner. The average particle size on weight basis of the finally obtained toner was 5.8 μm. The used external additive was a mixture containing 1 part by weight of negatively-chargeable silica with relatively small grain size (average grain size: 12 nm), 0.5 part by weight of negatively-chargeable silica with relatively large grain size (average grain size: 40 nm), and 1 part by weight of rutile-anatase type titanium oxide (having a nearly fusiform shape and an average major axial diameter of 30 nm). In this connection, the used negatively-chargeable silica (negatively-chargeable silica with relatively small grain size and negatively-chargeable silica with relatively large grain size) was silica which has been subjected to a surface treatment (hydrophobic treatment) with hexamethyl disilazane. Further, the used rutile-anatase type titanium oxide was a mixture of rutile type titanium oxide and anatase type titanium oxide in a ratio of 90:10, which absorbs light in the wavelength region of 300 to 350 nm.

It is to be noted that the toner was manufactured under such a condition that the change rate of the weight average molecular weight of each resin material before and after manufacture was within ±10% and the amounts of change of the melting point, softening point, and glass transition point of each resin material before and after manufacture were respectively within ±10° C.

The acid value of the toner finally obtained was 0.8 KOHmg/g, and the average length of crystals in the toner was 400 nm. Further, the coating ratio with the external additive in the toner was 160%. Furthermore, the ratio (liberation ratio) of the rutile-anatase type titanium oxide existing as a free external additive among the rutile-anatase type titanium oxide contained in the toner was 1.2%.

Further, the average length of crystals in the toner was determined from a result obtained by measurement using a transmission electron microscope (TEM).

Example 2

A toner was manufactured in the same manner as Example 1 except that the polyester C was used as block polyester.

Example 3

A toner was manufactured in the same manner as Example 1 except that the nozzle shown in FIG. 6 was used and the amount of the rutile-anatse type titanium oxide added as the external additive was 0.2 part by weight.

Example 4

A toner was manufactured in the same manner as Example 1 except that the nozzle shown in FIG. 7 was used and the amount of the ritile-anatase type titanium oxide added as the external additive was 2 parts by weight.

Examples 5–7

Toners were manufactured in the same manner as Example 1 except that the amount of the polyester A and the amount of the polyester B contained in the material to be kneaded in the kneading process were changed as shown in Table 1.

Examples 8 to 10

Toners were manufactured in the same manner as Example 1 except that the polyester A' was used instead of the polyester A and that the amount of the polyester A' and the amount of the polyester B contained in the material to be kneaded in the kneading process were set as shown in Table 1.

Example 11

A toner was manufactured in the same manner as Example 1 except that the nozzle shown in FIGS. 8 to 10 was used and that the negatively-chargeable silica with relatively large grain size (average grain size: 40 nm) was not used as the external additive.

Example 12

A toner was manufacture in the same manner as Example 1 except that the nozzle shown in FIGS. 11 to 13 was used and 1 part by weight of the positively-chargeable silica (average grain size: 40 nm) was further added as the external additive. In this connection, the used positively-chargeable silica was obtained by subjecting negatively-chargeable silica to a surface treatment (hydrophobic treatment) using a silane coupling agent (aminosilane) having an amino group.

Example 13

A toner was manufactured in the same manner as Example 1 except that 2 parts by weight of low-melting point polyester was further added to the material to be kneaded in the kneading process. In this connection, the used low-melting point polyester was a polymer of 1,6-hexanediol and hexane dicarboxylic acid, and the weight average molecular weight Mw, the melting point $T_m$, the softening point $T_{1/2}$ and the glass transition point $T_g$ thereof were $4.8\times10^3$, 79° C., 82° C., and 57° C., respectively.

Example 14

A toner was manufactured in the same manner as Example 1 except that the polyester D was used instead of the polyester B.

Comparative Example 1

A toner was manufactured in the same manner as Example 1 except that the amount of the polyester A was 100 parts by weight and the polyester B was not used.

Comparative Example 2

A toner was manufactured in the same manner as Example 1 except that 100 parts by weight of the polyester C was used instead of 80 parts by weight of the polyester A and 20 parts by weight of the polyester B.

Comparative Example 3

First, a kneaded material was obtained in the same manner as Example 14. Then, the kneaded material was roughly ground.

Next, the thus roughly ground kneaded material was finely ground (pulverized) using a jet mill ("200AFG" which is a product of Hosokawa Micron Corporation). In this connection, the fine grinding (pulverization) was carried out at a grinding air pressure of 500 kPa and a rotor rotation number of 7,000 rpm.

The thus obtained ground material was classified using an air classifier ("100 ATP" which is a product of Hosokawa Micron Corporation).

The ground material (powder for manufacturing a toner) which has been classified was subjected to the thermal sphering treatment. The treatment was carried out using an apparatus for thermal spehring treatment ("SFS3" which is a product of Nippon Pneumatic Mfg. Co., Ltd.). In this connection, an atmospheric temperature during the thermal shpering treatment was set to 270° C.

Then, a toner was obtained by adding the external additive under the same condition as the Example 1 to the powder which has been subjected to the thermal sphering treatment.

Comparative Example 4

A toner was manufactured in the same manner as Comparative Example 3 except that 100 parts by weight of the polyester C was used instead of 80 parts by weight of the polyester A and 20 parts by weight of the polyester D.

In manufacture of each of the toners of Examples 1 to 14, excellent grindability was shown in the grinding process for grinding (pulverizing) the kneaded material (the amount of the kneaded material which was ground per unit time was about 4 to 6 kg/hr).

The components of each of the toners manufactured in Examples 1 to 14 and comparative Examples 1 to 4 are shown in Table 1. Further, for each of the toners, the average roundness R, the standard deviation of roundness, the average particle size Dt on weight basis and the standard deviation of particle size of the particles manufactured using the toner manufacturing device (that is, particles before the addition of silica), the average particle size of the finally obtained toner, and the conditions of the dispersion liquid used for manufacturing the toner are shown in Table 2. The acid value of the toner, the average length of crystals in the toner, the coating ratio with the external additive and the ratio of the free rutile-anatase type titanium oxide are shown in Table 3. In these tables, the polyesters A, A', B, C and D are indicated as PES-A, PES-A', PES-B, PES-C and PES-D, respectively, and the charge control agent is indicated as CCA.

Further, for each of the toners of Examples 1 to 14 and Comparative Examples 1 to 4, G(0.01)/G(Δt) which is a ratio between G(0.01) (Pa) and G(Δt) (Pa) was determined as follows, where G(0.01) (Pa) is the initial relaxation modulus G of the toner at 0.01 second and G(Δt) is the relaxation modulus G of the toner at Δt second. In this case, Δt was set to 0.05 second.

First, about 1 g of the toner was sandwiched between parallel plates, and was melted by heating so as to have a height of 1.0 to 2.0 mm. The viscoelasticity of the thus obtained sample was measured using an ARES viscoelasticity measurement apparatus (which is a product of Rheometric Scientific F. E. Ltd.) in a stress relaxation mode under the following conditions.

Measurement temperature: 150° C.

Amount of strain applied: maximum strain within the linear viscoelastic region

Geometry: parallel plates (diameter of 25 mm)

In this way, for each of the toners, the initial relaxation modulus (relaxation modulus at 0.01 second) G(0.01)(Pa), and the relaxation modulus G(Δt)(Pa) at Δt=0.05 second were measured. From the measurement values, the ratio G(0.01)/G(Δt) was determined, which is shown in Table 3.

<3> Evaluation

For each of the toners, a bulk density, a temperature range in which the toner can exhibit a good fixing property, durability in development, and storage stability were evaluated.

<3.1> Bulk Density

For each of the toners manufactured in Example 1 to 14 and Comparative Examples 1 to 4, a bulk density was measured using a powder tester (which is a product of Hosokawa Micron Ltd.). In this connection, a temperature and a humidity upon the measurement were 20° C. and 58 % RH, respectively.

<3.2> Temperature Range in Which the Toner Can Exhibit Good Fixing Property

First, a fixing device as shown in FIGS. 20 to 27 and 30 was prepared. In this fixing device, the time required for the toner to pass through the nip part (Δt) was set to 0.05 second. By using such a fixing device, an image forming apparatus (color printer) as shown in FIGS. 18 and 19 was manufactured. An unfixed image sample was made by the image forming apparatus, and then the following test was made using the fixing device of the image forming apparatus. In this connection, the amount of the toner to be deposited on solid fills in the sample was regulated to 0.40 to 0.50 $mg/cm^2$.

The surface temperature of a fixing roller in the fixing device constituting the image forming apparatus was set to a predetermined temperature, and in such a state, a sheet of paper to which an unfixed toner image has been transferred (high quality plain paper made by Seiko Epson Corporation) was introduced into the inside of the fixing device to fix the toner image onto the paper. After the fixation of the toner was completed, the presence or absence of the occurrence of offset was checked with naked eyes.

Such a test was successively made while changing the surface temperature of the fixing roller in the range of 100 to 250° C., and the presence or absence of the occurrence of offset was checked at various surface temperatures. The temperature range in which offset did not occur was defined as a "temperature range in which good fixation is ensured", which was evaluated according to the following four criteria.

A: The width of the temperature range in which good fixation is ensured was 60° C. or more.

B: The width of the temperature range in which good fixation is ensured was 45° C. or more but less than 60° C.

C: The width of the temperature range in which good fixation is ensured was 30° C. or more but less than 45° C.

D: The width of the temperature range in which good fixation is ensured was less than 30° C.

<3.3> Durability in Development 30 g of the toner was set in a developing device of the image forming apparatus used in <3.2>, and was then aged with nothing being supplied thereto to measure the time that elapsed before filming occurred on a development roller. Durability of the toner in development was evaluated according to the following four criteria.

A: Occurrence of filming was not recognized even after a lapse of 120 minutes or more from the start of aging.

B: Filming occurred when 80 to 120 minutes have elapsed from the start of aging.

C: Filming occurred when 50 to 80 minutes have elapsed from the start of aging.

D: Filming occurred within less than 50 minutes from the start of aging.

<3.4> Storage Stability 10 g of the toner of each of Examples and Comparative Examples was placed in a sample bottle, and was then allowed to stand in a thermostat at 50° C. for 48 hours. Thereafter, the presence or absence of agglomerations (that is, whether or not cohesion occurred) was checked with naked eyes, which was evaluated according to the following four criteria.

A: The existence of agglomerations was not recognized at all.

B: The existence of a few small agglomerations was recognized.

C: The existence of quite a few small agglomerations was recognized.

D: The existence of agglomerations was clearly recognized.

These evaluation results are shown in Table 4.

As is apparent from Table 4, each of the toners according to the present invention had excellent durability in development and exhibited an excellent fixing property in a wide temperature range. Also, each of the toners according to the present invention had a large bulk density and excellent storage stability. In particular, in the toners containing a polyester-based resin having a preferred composition and a suitable external additive, extremely excellent results were obtained.

On the other hand, in the toners of Comparative Examples, satisfactory results could not be obtained. In particular, the toner of Comparative Example 1 containing no block polyester exhibited poor mechanical strength, and durability in development thereof was especially poor.

Further, the toner of Comparative Example 2 containing no amorphous polyester exhibited a low fixing strength so that a fixing property thereof was poor.

Each of the toners of Comparative Examples 3 and 4 manufactured by the kneading method (without using the dispersion liquid containing the components of the toner) had poor durability and storage stability. Also, the temperature range in which good fixation is ensured was narrow. Among these toners, the toner of Comparative Example 4 containing only one kind of polyester as a resin component had extremely poor properties.

Moreover, for each of the toners, the amount of change in the relaxation modulus G (t) during Δt (sec) which is the time required for the toner to pass through the nip part of the fixing device, was measured. As a result, in each of the toners of Examples 1 to 13, the amount of change in the relaxation modulus G (t) was 100 Pa or less. In this connection, a temperature in the nip part when the toner particles were passed through the nip part was 180° C.

Moreover, toners were manufactured in the same manner as Examples 1 to 14 and Comparative Examples 1 to 4, respectively, except that copper phthalocyanine pigment was used as a coloring agent instead of quinacridon (P. R. 122). In a like manner, toners containing pigment red 57:1 as a coloring agent, toners containing C. I. Pigment Yellow 93, and toners containing carbon black were manufactured according to Examples 1 to 14 and Comparative Examples 1 to 4, respectively. For each of these toners, evaluations as to the same items described above were also made. Evaluation results of each of the toners were similar to those obtained in the corresponding Examples or Comparative Examples.

As has been described above, according to the present invention, it is possible to provide a toner having high mechanical strength (sufficient physical stability) and exhibiting a sufficient fixing property (fixing strength) in a wide temperature range. Further, according to the present invention, it is possible to provide a fixing device and an image forming apparatus in which the toner of the present invention can be suitably used.

Such effects can be made more excellent by adjusting the composition of the polyester-based resin (constituent monomer and average molecular weight of the block polyester, abundance ratio of the crystalline block, constituent monomer and average molecular weight of the amorphous polyester, and compounding ratio between the block polyester and the amorphous polyester, for example), conditions for jetting the dispersion liquid (temperature and viscosity of the dispersion liquid to be jetted, amount and average particle size of the dispersoid contained in the dispersion liquid, average particle size of particle of the jetted dispersion liquid, pressure and temperature in the solidifying section, and the like), and the kind and amount of the external additive.

Finally, it is to be understood that the present invention is not limited to the embodiments and examples described above, and many changes or additions may be made without departing from the scope of the invention which is determined by the following claims.

TABLE 1

| | Amorphous PES | | Block PES | | Other PES | | Coloring agent | CCA | Wax | External additive Content with respect to 100 parts by weight of powder for manufacturing toner (pts.wt) | | | |
|---|---|---|---|---|---|---|---|---|---|---|---|---|---|
| | Kind | Content (pts.wt) | Kind | Content (pts.wt) | Kind | Content (pts.wt) | Content (pts.wt) | Content (pts.wt) | Content (pts.wt) | Rutile-anatase type titanium oxide | Silica with relatively small size | Silica with relatively large size | Positively-chargeable silica |
| Example 1 | PES-A | 80 | PES-B | 20 | — | — | 6 | 1 | 2 | 1 | 1 | 0.5 | — |
| Example 2 | PES-A | 80 | PES-C | 20 | — | — | 6 | 1 | 2 | 1 | 1 | 0.5 | — |
| Example 3 | PES-A | 80 | PES-B | 20 | — | — | 6 | 1 | 2 | 0.2 | 1 | 0.5 | — |
| Example 4 | PES-A | 80 | PES-B | 20 | — | — | 6 | 1 | 2 | 2 | 1 | 0.5 | — |
| Example 5 | PES-A | 95 | PES-B | 5 | — | — | 6 | 1 | 2 | 1 | 1 | 0.5 | — |
| Example 6 | PES-A | 55 | PES-B | 45 | — | — | 6 | 1 | 2 | 1 | 1 | 0.5 | — |
| Example 7 | PES-A | 40 | PES-B | 60 | — | — | 6 | 1 | 2 | 1 | 1 | 0.5 | — |
| Example 8 | PES-A' | 95 | PES-B | 5 | — | — | 6 | 1 | 2 | 1 | 1 | 0.5 | — |
| Example 9 | PES-A' | 55 | PES-B | 45 | — | — | 6 | 1 | 2 | 1 | 1 | 0.5 | — |
| Example 10 | PES-A' | 40 | PES-B | 60 | — | — | 6 | 1 | 2 | 1 | 1 | 0.5 | — |
| Example 11 | PES-A | 80 | PES-B | 20 | — | — | 6 | 1 | 2 | 1 | 1 | — | — |
| Example 12 | PES-A | 80 | PES-B | 20 | — | — | 6 | 1 | 2 | 1 | 1 | 0.5 | 1 |
| Example 13 | PES-A | 80 | PES-B | 20 | — | — | 6 | 1 | 2 | 1 | 1 | 0.5 | — |
| Example 14 | PES-A | 80 | — | — | PES-D | 20 | 6 | 1 | 2 | 1 | 1 | 0.5 | — |
| Com. Ex. 1 | PES-A | 100 | — | — | — | — | 6 | 1 | 2 | 1 | 1 | 0.5 | — |
| Com. Ex. 2 | — | — | PES-C | 100 | — | — | 6 | 1 | 2 | 1 | 1 | 0.5 | — |
| Com. Ex. 3 | PES-A | 80 | — | — | PES-D | 20 | 6 | 1 | 2 | 1 | 1 | 0.5 | — |
| Com. Ex. 4 | — | — | PES-C | 100 | — | | 6 | 1 | 2 | 1 | 1 | 0.5 | — |

TABLE 2

| | Dispersion liquid | | Toner particle (before external additive addition) | | | | |
|---|---|---|---|---|---|---|---|
| | Average particle size of dispersoid Dm(μm) | Average particle size of particle of dispersion liquid Dd (μm) | average roundness R | Standard deviation of roundness | Average particle size Dt (μm) | Standard deviation of particle size | Average particle size of toner (after external additive addition) |
| Example 1 | 0.4 | 9.2 | 0.974 | 0.026 | 5.8 | 1.12 | 5.8 |
| Example 2 | 0.4 | 10.2 | 0.981 | 0.027 | 6.2 | 1.37 | 6.2 |
| Example 3 | 0.3 | 9.1 | 0.982 | 0.023 | 6.1 | 1.07 | 6.1 |
| Example 4 | 0.2 | 8.8 | 0.979 | 0.018 | 5.8 | 0.98 | 5.9 |
| Example 5 | 0.3 | 10.4 | 0.986 | 0.020 | 5.6 | 1.21 | 5.7 |
| Example 6 | 0.5 | 7.9 | 0.982 | 0.023 | 6.1 | 0.89 | 6.1 |
| Example 7 | 0.6 | 9.5 | 0.974 | 0.027 | 6.3 | 0.99 | 6.3 |

TABLE 2-continued

| | Dispersion liquid | | Toner particle (before external additive addition) | | | | Average particle |
|---|---|---|---|---|---|---|---|
| | Average particle size of dispersoid Dm(μm) | Average particle size of particle of dispersion liquid Dd (μm) | average roundness R | Standard deviation of roundness | Average particle size Dt (μm) | Standard deviation of particle size | size of toner (after external additive addition) |
| Example 8 | 0.4 | 10.6 | 0.981 | 0.015 | 5.2 | 0.97 | 5.2 |
| Example 9 | 0.3 | 9.8 | 0.977 | 0.022 | 5.8 | 1.11 | 5.8 |
| Example 10 | 0.7 | 9.6 | 0.974 | 0.025 | 5.9 | 1.21 | 5.9 |
| Example 11 | 0.5 | 11.0 | 0.982 | 0.026 | 6.2 | 1.06 | 6.3 |
| Example 12 | 0.4 | 9.1 | 0.982 | 0.023 | 6.0 | 1.02 | 6.1 |
| Example 13 | 0.3 | 8.9 | 0.981 | 0.019 | 6.0 | 1.18 | 6.1 |
| Example 14 | 0.3 | 9.4 | 0.983 | 0.021 | 5.8 | 1.17 | 5.8 |
| Com. Ex. 1 | 0.2 | 10.0 | 0.984 | 0.044 | 6.1 | 1.89 | 6.1 |
| Com. Ex. 2 | 0.3 | 9.9 | 0.964 | 0.043 | 6.0 | 1.92 | 6.2 |
| Com. Ex. 3 | — | — | 0.961 | 0.051 | 5.8 | 1.72 | 5.9 |
| Com. Ex. 4 | — | — | 0.963 | 0.041 | 5.8 | 1.68 | 5.9 |

TABLE 3

| | Acid value of toner | Average length of crystal (nm) | Coating ratio with external additive (%) | Ratio of free rutile-anatase type titanium oxide (wt %) | G(0.01)/G(Δt) |
|---|---|---|---|---|---|
| Example 1 | 0.8 | 400 | 160 | 1.2 | 2.8 |
| Example 2 | 0.8 | 400 | 160 | 1.4 | 3.7 |
| Example 3 | 0.8 | 400 | 120 | 0.8 | 2.8 |
| Example 4 | 0.8 | 400 | 220 | 2.0 | 2.8 |
| Example 5 | 0.8 | 200 | 160 | 1.4 | 6.5 |
| Example 6 | 0.8 | 500 | 160 | 1.2 | 2.6 |
| Example 7 | 0.8 | 600 | 160 | 1.1 | 2.3 |
| Example 8 | 0.8 | 200 | 160 | 1.4 | 7.2 |
| Example 9 | 0.8 | 500 | 160 | 1.2 | 2.6 |
| Example 10 | 0.8 | 600 | 160 | 1.1 | 2.3 |
| Example 11 | 0.8 | 400 | 150 | 1.2 | 2.8 |
| Example 12 | 0.8 | 400 | 190 | 1.2 | 2.8 |
| Example 13 | 0.8 | 400 | 160 | 1.2 | 2.8 |
| Example 14 | 0.8 | 900 | 160 | 1.2 | 2.8 |
| Com. Ex. 1 | 0.6 | — | 160 | 1.5 | 9.5 |
| Com. Ex. 2 | 0.7 | 1,000 | 160 | 1.5 | 2.0 |
| Com. Ex. 3 | 0.8 | 3,000 | 160 | 1.6 | 7.8 |
| Com. Ex. 4 | 0.8 | 1,000 | 160 | 1.6 | 7.8 |

TABLE 4

| | Bulk density ($g/cm^3$) | Evaluation of temperature range in which good fixaion is ensured | Durability in development | Storage stability |
|---|---|---|---|---|
| Example 1 | 0.437 | A | A | A |
| Example 2 | 0.442 | B | B | A |
| Example 3 | 0.451 | A | B | A |
| Example 4 | 0.453 | B | A | A |
| Example 5 | 0.448 | B | B | A |
| Example 6 | 0.432 | B | A | A |
| Example 7 | 0.429 | B | A | A |
| Example 8 | 0.439 | B | C | A |
| Example 9 | 0.445 | B | A | A |
| Example 10 | 0.441 | B | A | A |
| Example 11 | 0.442 | A | B | A |
| Exmaple 12 | 0.438 | A | B | A |
| Example 13 | 0.451 | A | B | A |
| Example 14 | 0.446 | C | C | B |
| Com. Ex. 1 | 0.411 | D | D | D |
| Com. Ex. 2 | 0.405 | D | B | A |

TABLE 4-continued

| | Bulk density ($g/cm^3$) | Evaluation of temperature range in which good fixaion is ensured | Durability in development | Storage stability |
|---|---|---|---|---|
| Com. Ex. 3 | 0.416 | D | D | C |
| Com. Ex. 4 | 0.412 | D | D | D |

What is claimed is:

1. A method for manufacturing a toner, comprising the steps of:

mixing a polyester-based resin containing two or more kinds of polyesters having different degrees of crystallinity with a coloring agent and a wax;

kneading the mixture with a kneader;

grinding the kneaded material into powder;

dissolving the powder into a solvent to obtain a resin solution in which the components of the kneaded material are dispersed and dissolved;

dropping the resin solution into an aqueous solution to obtain a dispersion liquid which comprises a dispersoid containing the polyester-based resin and a dispersion medium in which the dispersoid is dispersed;

jetting the dispersion liquid so as to be in the form of fine particles; and solidifying the fine particles of the dispersion liquid while they are being conveyed in a solidifying section.

2. The method as claimed in claim 1, wherein the polyester-based resin contains two kinds of polyesters which have different softening points $T_{1/2}$, wherein a difference between them is 5° C. or more in absolute value.

3. The method as claimed in claim 1, wherein the fine particles of the dispersion liquid are formed by spreading the dispersion liquid into a laminar flow by pressing it against a smooth surface using a gas flow, and then jetting the laminar flow released from the smooth surface to form the fine particles.

4. The method as claimed in claim 3, wherein the gas flow is formed by jetting a pressurized gas from a gas outlet into an open space, and the gas flow is jetted toward the smooth surface in a direction that the dispersion liquid flows so that the gas flow can be made to come into contact with the smooth surface and to flow in parallel with the smooth surface in a predetermined direction, wherein the dispersion liquid is supplied on the smooth surface and below the gas flow flowing on the smooth surface such that the direction of the dispersion liquid to be supplied crosses the direction of the gas flow, wherein the dispersion liquid is pressed against the smooth surface by the gas flow and is spread into the laminar flow.

5. The method as claimed in claim 3, wherein the smooth surface is provided as an inclined surface.

6. The method as claimed in claim 5, wherein there are provided the two inclined surfaces which provide a sharp edge as a boundary of them, wherein the gas flow is made to flow along each of the inclined surfaces to make them come into collision with each other to generate air vibration at the edge, wherein the dispersion liquid is supplied on the inclined surface to make it flow along the inclined surface so that the dispersion liquid is spread into the laminar flow by the gas flow and conveyed to the edge, wherein the laminar flow is divided into fine particles by the air vibration at the tip end of the edge and then the fine particles are jetted into the air.

7. The method as claimed in claim 1, wherein the dispersoid contained in the fine particles released from the smooth surface is agglomerated while being conveyed in the solidifying section.

8. The method as claimed in claim 1, wherein the dispersion medium is mainly comprised of water and/or a liquid having excellent compatibility with water.

9. The method as claimed in claim 1, wherein the dispersion liquid contains an emulsifying and dispersing agent.

10. The method as claimed in claim 1, wherein the dispersion liquid is a suspension.

11. The method as claimed in claim 1, wherein the dispersion liquid is obtained by dispersing a kneaded material in the dispersion medium, wherein the kneaded material contains at least the polyester-based resin.

12. The method as claimed in claim 11, wherein various components constituting the polyester-based resin are soluble with each other in the kneaded material.

13. The method as claimed in claim 1, wherein the dispersion liquid is prepared by adding a material containing the polyester-based resin or a precursor thereof to a liquid containing at least water.

14. The method as claimed in claim 1, wherein the dispersion liquid is prepared through a process of mixing a resin solution which contains at least a resin or a precursor of the resin and a solvent capable of dissolving at least a part of the resin or the precursor of the resin, and an aqueous solution containing at least water.

15. The method as claimed in claim 14, wherein the resin solution and the aqueous solution are mixed by dropping the resin solution into the aqueous solution.

16. The method as claimed in claim 14, wherein the dispersion liquid is prepared by eliminating at least a part of the solvent after the mixing process.

17. The method as claimed in claim 16, wherein the solvent is eliminated by heating.

18. The method as claimed in claim 1, wherein the average particle size of the particle of the dispersoid in the dispersion liquid is in the range of 0.05 to 10 μm.

19. The method as claimed in claim 1, wherein when the average particle size of the particle of the dispersoid in the dispersion liquid is defined as Dm (μm), and the average particle size of a manufactured toner particle is defined as Dt (μm), Dm and Dt satisfy the relation $0.005 \leqq Dm/Dt \leqq 0.5$.

20. The method as claimed in claim 1, wherein the content of the dispersoid in the dispersion liquid is in the range of 1 to 99 wt %.

21. The method as claimed in claim 1, wherein the volume of one drop of the dispersion liquid in the form of a fine particle is in the range of 0.05 to 500 pl.

22. The method as claimed in claim 1, wherein when the average particle size of the dispersion liquid in the form of a fine particle is defined as Dd (μm) and the average particle size of the dispersoid in the dispersion liquid is defined as Dm (μm), Dm and Dd satisfy the relation $Dm/Dd<0.5$.

23. The method as claimed in claim 1, wherein when the average particle size of the particle of the dispersion liquid in the form of a fine particle is defined as Dd (μm) and the average particle size of a manufactured toner particle is defined as Dt (μm), Dd and Dt satisfy the relation $0.05 \leqq Dt/Dd \leqq 1.0$.

24. The method as claimed in claim 1, wherein the dispersion liquid is jetted in the form of fine particles from a plurality of jetting ports.

25. The method as claimed in claim 24, wherein the dispersion liquid is jetted at different times from at least adjacent two jetting ports among the plurality of jetting ports.

26. The method as claimed in claim 1, wherein the dispersion liquid is jetted in a state where it is heated.

27. The method as claimed in claim 1, wherein the dispersion liquid is heated in the solidifying section after it is jetted.

28. The method as claimed in claim 1, wherein the dispersion liquid is jetted in a state where a voltage with polarity that is the same as that of the dispersion liquid is applied to the solidifying section.

29. The method as claimed in claim 1, wherein the initial velocity of the dispersion liquid when jetted in the form of fine particles is in the range of 0.1 to 10 m/s.

30. The method as claimed in claim 1, wherein the viscosity of the dispersion liquid is in the range of 5 to 3,000 cps.

31. The method as claimed in claim 1, wherein the dispersion medium is eliminated in the solidifying section.

32. The method as claimed in claim 1, wherein a pressure in the solidifying section is 0.15 MPa or less.

33. The method as claimed in claim 1, wherein the polyester-based resin contains block polyester mainly composed of a block copolymer, and amorphous polyester having crystallinity lower than that of the block polyester, wherein the block polyester has a crystalline block obtained by condensation of a diol component with a dicarboxylic acid component, and an amorphous block having crystallinity lower than that of the crystalline block.

34. The method as claimed in claim 33, wherein the melting point of the block polyester is higher than the softening point of the amorphous polyester.

35. The method as claimed in claim 33, wherein the amorphous polyester contains a monomer component and the block polyester contains a monomer component, in which 50 mol % or more of the monomer component of the amorphous polyester is the same as the monomer component of the amorphous block of the block polyester.

36. The method as claimed in claim 33, wherein the compounding ratio between the block polyester and the amorphous polyester is in the range of 5:95 to 45:55 in weight ratio.

37. The method as claimed in claim 33, wherein the content of the crystalline block in the block polyester is in the range of 5 to 60 mol %.

38. The method as claimed in claim 33, wherein 80 mol % or more of the diol component constituting the crystalline block of the block polyester is aliphatic diol.

39. The method as claimed in claim 33, wherein the diol component of the crystalline block of the block polyester has a straight-chain molecular structure containing 3 to 7 carbon atoms and hydroxyl groups at both ends of the chain.

40. The method as claimed in claim 33, wherein 50 mol % or more of the dicarboxylic acid component constituting the crystalline block of the block polyester has a terephthalic acid structure.

41. The method as claimed in claim 33, wherein the amorphous block of the block polyester contains a diol component, and at least a part of the diol component is aliphatic diol.

42. The method as claimed in claim 33, wherein the amorphous block of the block polyester contains a diol component, and at least a part of the diol component has a branched chain.

43. The method as claimed in claim 33, wherein the melting point of the block polyester is 190° C. or higher.

44. The method as claimed in claim 33, wherein the heat of fusion of the block polyester determined by measuring the endothermic peak of the block polyester at its melting point according to differential scanning calorimetry is 5 mJ/mg or greater.

45. The method as claimed in claim 33, wherein the weight average molecular weight Mw of the block polyester is in the range of $1\times10^3$ to $3\times10^5$.

46. The method as claimed in claim 33, wherein the block polyester is a liner polymer.

47. The method as claimed in claim 33, wherein the amorphous polyester contains a dicarboxylic acid component, and 80 mol % or more of the dicarboxylic acid component has a terephthalic acid structure.

48. The method as claimed in claim 33, wherein the weight average molecular weight Mw of the amorphous polyester is in the range of $5\times10^3$ to $4\times10^4$.

49. The method as claimed in claim 33, wherein the amorphous polyester is a linear polymer.

50. The method as claimed in claim 33, wherein the block polyester and the amorphous polyester are soluble with each other.

51. The method as claimed in claim 1, wherein the content of the polyester-based resin in the dispersoid is in the range of 2 to 98 wt %.

52. The method as claimed in claim 1, wherein the dispersion liquid contains a wax.

53. The method as claimed in claim 52, wherein the content of the wax in the dispersion liquid is 1.0 wt % or less.

54. A toner manufactured by the method as claimed in claim 1.

55. The toner as claimed in claim 54, wherein the average particle size is in the range of 1 to 20 μm.

56. The toner as claimed in claim 54, wherein the standard deviation of the particle size among individual particles of the toner is 1.5 μm or less.

57. The toner as claimed in claim 54, wherein the average roundness R determined by the following formula (I) is in the range of 0.91 to 0.98.

$$R=L_0/L_1 \quad (I)$$

(where, $L_0$ is a circumferential length of a projected image of a toner particle of the toner which is an object to be measured, and $L_1$ is a circumferential length of a true circle having an area equal to the area of the projected image of the toner particle of the toner which is an object to be measured.)

58. The toner as claimed in claim 54, wherein the standard deviation of the average roundness among individual particles of the toner is 0.02 or less.

59. The toner as claimed in claim 54, wherein the toner is composed of agglomerations of the dispersoid.

60. The toner as claimed in claim 54, wherein the content of the polyester-based resin in the toner is in the range of 50 to 98 wt %.

61. The toner as claimed in claim 54, wherein the toner contains crystals mainly formed of crystalline blocks.

62. The toner as claimed in claim 61, wherein the average length of the crystals is in the range of 10 to 1,000 nm.

63. The toner as claimed in claim 54, further comprising a wax.

64. The toner as claimed in claim 63, wherein the content of the wax is 5 wt % or less.

65. The toner as claimed in claim 54, wherein the polyester-based resin contains block polyester mainly composed of a block copolymer, wherein the weight average molecular weight Mw of the block polyester is in the range of $1\times10^4$ to $3\times10^5$.

66. The toner as claimed in claim 54, wherein the polyester-based resin contains block polyester mainly composed of a block copolymer, and an amorphous polyester having crystallinity lower than that of the block polyester, wherein the weight average molecular weight Mw of the amorphous polyester is in the range of $5\times10^3$ to $4\times10^4$.

67. The toner as claimed in claim 54, further comprising an external additive.

68. The toner as claimed in claim 54, wherein the toner is to used with with a fixing device which comprises a fixing roller, a pressure roller which is in contact with the fixing roller under pressure through a fixing nip part, and a release member for use in releasing a recording medium, which has been passed through the fixing nip part, from the fixing roller.

69. The toner as claimed in claim 68, wherein the fixing device has a recording medium feed speed of 0.05 to 1.0 m/s.

70. The toner as claimed in claim 68, wherein the release member is a plate-shaped member having a predetermined length in the axial direction of the fixing roller and/or the pressure roller.

71. The toner as claimed in claim 68, wherein the release member is disposed on the further downstream side than the fixing nip part in the direction of conveying the recording medium.

72. The toner as claimed in claim 68, wherein the release member is disposed in the vicinity of the fixing roller and/or the pressure roller.

73. The toner as claimed in claim 68, wherein the fixing roller and the pressure roller are arranged almost in the horizontal state.

74. The toner as claimed in claim 68, wherein the release member is disposed such that a gap between the fixing roller and the release member is kept substantially constant when the fixing device is operated.

75. The toner as claimed in claim 68, wherein the release member is disposed along the axial direction of the fixing roller, and has a shape that is suited for the shape of the exit of the fixing nip part.

76. The toner as claimed in claim 68, wherein when an angle on the side of the fixing roller with respect to a tangent at the exit of the fixing nip part is defined as a positive angle and an angle on the side of the pressure roller with respect to the tangent at the exit of the fixing nip part is defined as a negative angle, the arrangement angle $\mathbf{0}_A$ of the release member with respect to the tangent at the exit of the fixing nip part is in the range of −5 to +25°.

77. The toner as claimed in claim 68, wherein the release member extends along the axial direction of the fixing roller and the pressure roller, and is disposed in the vicinity of the fixing roller and the pressure roller on the further downstream side than the fixing nip part in the direction of conveying the recording medium, and the fixing device further comprises a release member for the pressure roller, wherein the positioning of the release member for the fixing roller is performed by the surface of the fixing roller and the positioning of the release member for the pressure roller is performed by the surfaces of both bearings of the pressure roller.

78. The toner as claimed in claim 77, wherein the length in the axial direction of the pressure roller is shorter than that of the fixing roller so that spaces are created at each end of the pressure roller, wherein the bearings are provided in the spaces, respectively.

79. The toner as claimed in claim 68, wherein a gap G2 (μm) between the fixing roller and the release member in the vicinity of each end in the axial direction of the fixing roller is larger than a gap G1 (μm) between the fixing roller and the release member in the vicinity of the central part in the axial direction of the fixing roller.

* * * * *